US005340694A

United States Patent [19]

Hioki et al.

[11] Patent Number: 5,340,694

[45] Date of Patent: Aug. 23, 1994

[54] SILVER HALIDE PHOTOGRAPHIC MATERIAL

[75] Inventors: Takanori Hioki; Ryoji Nishimura, both of Kanagawa, Japan

[73] Assignee: Fuji Photo Film Co., Ltd., Kanagawa, Japan

[21] Appl. No.: 12,350

[22] Filed: Feb. 2, 1993

[30] Foreign Application Priority Data

Feb. 6, 1992 [JP] Japan ..... 4-054124

[51] Int. Cl.[5] ..... G03C 1/06

[52] U.S. Cl. ..... 430/264; 430/598; 430/588; 430/551

[58] Field of Search ..... 430/264, 598, 588, 551

[56] References Cited

U.S. PATENT DOCUMENTS

| | | | |
|---|---|---|---|
| 4,571,380 | 2/1986 | Noguchi et al. | 430/589 |
| 4,777,118 | 10/1988 | Kitchin et al. | 430/264 |
| 4,975,354 | 12/1990 | Machonkin et al. | 430/264 |
| 5,190,853 | 3/1993 | Seto et al. | 430/264 |

FOREIGN PATENT DOCUMENTS

| | | |
|---|---|---|
| 0283040 | 9/1988 | European Pat. Off. . |
| 0382455 | 8/1990 | European Pat. Off. . |
| 0420005 | 4/1991 | European Pat. Off. . |
| 0473342 | 3/1992 | European Pat. Off. . |

*Primary Examiner*—Thomas R. Neville
*Attorney, Agent, or Firm*—Sughrue, Mion, Zinn, Macpeak & Seas

[57] ABSTRACT

A silver halide photographic material contains at least one hydrazine compound of formula (I):

(I)

where $R_1$, $R_2$, $R_3$ and $R_4$ each represents an alkyl group, an aryl group or a heterocyclic group; and $R_1$ and $R_2$, $R_3$ and $R_4$, $R_1$ and $R_3$, and $R_2$ and $R_4$ each may be bonded to each other to form a non-aromatic ring; provided that the carbon atom of $R_1$, $R_2$, $R_3$ and $R_4$ which is directly bonded to a nitrogen atom of the hydrazine core of the compound is not substituted by an oxo group. The material has a high sensitivity and does not tend to fog. After storage, depression of the sensitivity of the material is small.

18 Claims, No Drawings

SILVER HALIDE PHOTOGRAPHIC MATERIAL

FIELD OF THE INVENTION

The present invention relates to a high-sensitivity silver halide photographic material.

BACKGROUND OF THE INVENTION

Heretofore, provision of high-sensitivity silver halide photographic materials has been desired. In particular, provision of color-sensitized high-sensitivity silver halide photographic materials has especially been desired.

Color sensitization technology is extremely important and is indispensable for producing high-sensitivity photographic materials with excellent color reproducibility. A color sensitizer inherently has a function of absorbing light with a long wavelength range which is not substantially absorbed by silver halide photographic emulsions and of transmitting the energy of the absorbed light to the silver halide. Therefore, increasing the amount of light to be captured by a color sensitizer is advantageous for elevating the photographic sensitivity of a photographic material. Accordingly, attempts have heretofore been made to elevate the amount of light to be captured by a color sensitizer by increasing the amount of the color sensitizer to be added to the silver halide emulsion. However, if the amount of the color sensitizer to be added to the silver halide is significantly greater than an optimum amount (i.e., an amount which gives the highest color sensitivity), the result is severe desensitization. This is generally called dye desensitization, which is a phenomenon resulting in desensitization in the light-sensitive range intrinsic to a silver halide substantially free from color absorption by a sensitizing dye. If dye desensitization of a photographic material is great, then the total sensitivity of the photographic material will be low even though the material may be heavily color-sensitized. In other words, decreasing dye desensitization causes a proportional elevation of the sensitivity of the light-absorbing range by a color sensitizer (namely, the color sensitivity of a color sensitizer itself). Therefore, the solution of the problem of dye desensitization is an important theme in color sensitization technology. In general, a sensitizing dye having a light-sensitivity in a longer wavelength range involves greater dye desensitization. These matters are described in C. E. K. Mees, *The Theory of the Photographic Process,* pages 1067 to 1069 (published by Macmillan Co., 1942).

Methods of elevating the sensitivity of a photographic material by decreasing the dye desensitization thereof are known, as described in JP-A- 47-28916, JP-A-49-46738, JP-A-54-118236 and U.S. Pat. No. 4,011,083. (The term "JP-A" as used herein means an "unexamined published Japanese patent application".) However, these proposed methods are limited to specific sensitizing dyes and the effects thereof are still unsatisfactory. The most effective means of eliminating dye desensitization presently known is a method of using bisaminostilbene compounds substituted by pyrimidine derivatives or triazine derivatives, for example, as described in JP-B-45-22189, JP-A-54-18726, JP-A-52-4822, JP-A-52-151026 and U.S. Pat. No. 2,945,762. (The term "JP-B" as used herein means an "examined Japanese patent publication".) However, the proposed compounds are only effective with a limited class of sensitizing dyes: the so-called M-band sensitizing dyes which show a gently-sloping sensitization peak in a relatively long wavelength range, such as dicarbocyanines, tricarbocyanines, rhodacyanines and merocyanines.

U.S. Pat. No. 3,695,888 mentions combination of a tricarbocyanine and an ascorbic acid to yield infrared sensitization of a photographic material; British Patent 1,255,084 mentions combination of a particular dye and an ascorbic acid to yield elevation of the minus-blue sensitivity of a photographic material; British Patent 1,064,193 mentions combination of a particular dye and an ascorbic acid to yield elevation of the sensitivity of a photographic material; and U.S. Pat. No. 3,809,561 mentions combination of a desensitizing nucleus-containing cyanine dye and a supercolor sensitizer such as an ascorbic acid or the like.

However, the preceding technology often displays an unsatisfactory sensitizing effect of the dyes used, and even if a high sensitizing effect is attained, it often causes an increase of fog of the photographic material.

Attempts at adding hydrazines to a silver halide photographic material or to a developer have been made for various purposes.

For instance, U.S. Pat. No. 2,419,975, JP-A-63-261362 and JP-B-51-15745 mention addition of hydrazines to a developer.

JP-B-58-9410 and JP-B-58-9411 mention provision of a hard gradation silver halide photographic material by adding acylhydrazines thereto.

However, addition of hydrazines causes increase of fog of photographic materials, though displaying a low sensitizing effect.

JP-A-63-95444 and JP-A-63-43145 mention combination of magenta couplers and particular hydrazines to elevate the heat and light stability of color images formed in photographic materials.

JP-A-63-220142, JP-A-63-256951 and JP-A-63-229455 mention combination of organic color substances and particular hydrazines to prevent photographic materials from fading under light.

SUMMARY OF THE INVENTION

A first object of the present invention is to provide a silver halide photographic material, preferably a color-sensitized silver halide photographic material, which has increased sensitivity and which does not tend to fog.

A second object of the present invention is to provide a silver halide photographic material with high storage stability.

These objects have been attained by a silver halide photographic material, especially preferably a color-sensitized one, which contains at least one hydrazine compound of formula (I):

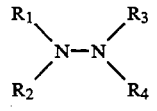

(I)

wherein $R_1$, $R_2$, $R_3$ and $R_4$ each represents an alkyl group, an aryl group or a heterocyclic group; and $R_1$ and $R_2$, $R_3$ and $R_4$, $R_1$ and $R_3$, and $R_2$ and $R_4$ each may be bonded to each other to form a non-aromatic ring; provided that the carbon atom of $R_1$, $R_2$, $R_3$ and $R_4$ which is directly bonded to a nitrogen atom of the hydrazine core of the compound is not substituted by an oxo group. The hydrazine core of the compound refers to the following structure:

> N–N <

In the case where $R_1$, $R_2$, $R_3$ or $R_4$ is a heterocyclic group, the heterocyclic group is bonded to the hydrazine core by a carbon atom in the heterocyclic group, and not by the hetero atom in the heterocyclic group.

The prior art does not disclose use of the hydrazines of the present invention in photographic materials.

As preferred embodiments of the present invention, compounds of formula (I) are selected from those of the following formulae (II), (III) and (IV) for attaining further increases in the sensitivity of the photographic material:

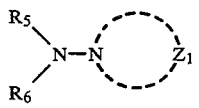

(II)

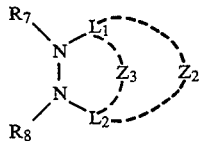

(III)

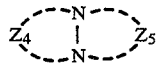

(IV)

wherein $R_5$, $R_6$, $R_7$ and $R_8$ each represents an alkyl group, an aryl group or a heterocyclic group; and $R_5$ and $R_6$, and $R_7$ and $R_8$ each may be bonded to each other to form a non-aromatic ring;

$Z_1$ represents an alkylene group having 4 or 6 carbon atoms;

$Z_2$ represents an alkylene group having 2 carbon atoms;

$Z_3$ represents an alkylene group having 1 or 2 carbon atoms;

$Z_4$ and $Z_5$ each represents an alkylene group having 3 carbon atoms; and $L_1$ and $L_2$ each represents a methine group;

provided that the carbon atom of $R_5$, $R_6$, $R_7$, $R_8$, $Z_1$, $Z_4$ and $Z_5$ which is directly bonded to a nitrogen atom of the hydrazine core of each compound is not substituted by an oxo group.

The compounds of formulae (II) and (III) are preferred; and those of formula (II) are especially preferred.

DETAILED DESCRIPTION OF THE INVENTION

The compounds of formula (I) for use in the present invention are described in detail below.

$R_1$, $R_2$, $R_3$ and $R_4$ each preferably represents, for example, an unsubstituted alkyl group (e.g., methyl, ethyl, propyl, isopropyl, butyl, isobutyl, hexyl, octyl, dodecyl, octadecyl, cyclopentyl, cyclopropyl, cyclohexyl), or a substituted alkyl group. The substituent of the substituted alkyl group is referred to as V. V is not specifically limited and includes, for example, a carboxyl group, a sulfo group, a cyano group, a halogen atom (e.g., fluorine, chlorine, bromine, iodine), a hydroxyl group, an alkoxycarbonyl group (e.g., methoxycarbonyl, ethoxycarbonyl, phenoxycarbonyl, benzyloxycarbonyl), an alkoxy group (e.g., methoxy, ethoxy, benzyloxy, phenethyloxy), an aryloxy group having from 6 to 18 carbon atoms (e.g., phenoxy, 4-methylphenoxy, α-naphthoxy), an acyloxy group (e.g., acetyloxy, propionyloxy), an acyl group (e.g., acetyl, propionyl, benzoyl, mesyl), a carbamoyl group (e.g., unsubstituted carbamoyl, N,N-dimethylcarbamoyl, morpholinocarbonyl, piperidinocarbonyl), a sulfamoyl group (e.g., unsubstituted sulfamoyl, N,N-dimethylsulfamoyl, morpholinosulfonyl, piperidinosulfonyl), an aryl group (e.g., phenyl, 4-chlorophenyl, 4-methylphenyl, α-naphthyl), a heterocyclic group (e.g., 2-pyridyl, tetrahydrofurfuryl, morpholino, 2-thiopheno), an amino group (e.g., unsubstituted amino, dimethylamino, anilino, diphenylamino), an alkylthio group (e.g., methylthio, ethylthio), an alkylsulfonyl group (e.g., methylsulfonyl, propylsulfonyl), an alkylsulfinyl group (e.g., methylsulfinyl), a nitro group, a phosphoric acid group, an acylamino group (e.g., acetylamino), an ammonium group (e.g., trimethylammonium, tributylammonium), a mercapto group, a hydrazino group (e.g., trimethylhydrazino), a ureido group (e.g., unsubstituted ureido, N,N-dimethylureido), an imido group, and an unsaturated hydrocarbon group (e.g., vinyl, ethynyl, 1-cyclohexenyl, benzilidine, benzylidene). The number of the carbon atoms in V is preferably from 0 to 18. The substituent V may further be substituted by one or more V's.

More specifically, the substituted alkyl group includes carboxymethyl, 2-carboxyethyl, 3-carboxypropyl, 4-carboxybutyl, 2-sulfoethyl, 3-sulfopropyl, 4-sulfobutyl, 3-sulfobutyl, 2-hydroxy-3-sulfopropyl, 2-cyanoethyl, 2-chloroethyl, 2-bromoethyl, 2-hydroxyethyl, 3-hydroxypropyl, propyl, hydroxymethyl, 2-hydroxyethyl, 2-methoxyethyl, 2-ethoxyethyl, 2-ethoxycarbonylethyl, methoxycarbonylmethyl, 2-methoxyethyl, 2-ethoxyethyl, 2-phenoxyethyl, 2-acetyloxyethyl, 2-propionyloxyethyl, 2-acetylethyl, 3-benzoylpropyl, 2-carbamoylethyl, 2-morpholinocarbonylethyl, sulfamoylethyl, 2-(N,N-dimethylsulfamoyl)ethyl, benzyl, 2-naphthylethyl, 2-(2-pyridyl)ethyl, allyl, 3-aminopropyl, 3-diethylaminopropyl, methylthiomethyl, 2-methylsulfonylethyl, methylsulfinylmethyl, 2-acetylaminoethyl, 3-trimethylammoniumethyl, 2-mercaptoethyl, 2-trimethylhydrazinoethyl, methylsulfonylcarbamoylmethyl, and (2-methoxy)ethoxymethyl groups.

As further preferred embodiments $R_1$, $R_2$, $R_3$ and $R_4$ each represents an aryl group (e.g., (i) phenyl, α-naphthyl, β-naphthyl, (ii) phenyl or naphthyl substituted by one or more of the preceding V groups), or a heterocyclic group (e.g., (i) 2-pyridyl, 2-thiazolyl, (ii) 2-pyridyl substituted by one or more of the preceding V groups).

$R_1$ and $R_2$, $R_3$ and $R_4$, $R_1$ and $R_3$, and $R_2$ and $R_4$ each may be bonded to each other to form a non-aromatic ring. The ring may optionally be substituted by one or more of the preceding V groups.

The carbon atom of $R_1$, $R_2$, $R_3$ and $R_4$ which is directly bonded to a nitrogen atom of the hydrazine core of the compound is not substituted by an oxo group. For instance, $R_1$, $R_2$, $R_3$ and $R_4$ are not an acetyl group, a carboxyl group, a benzoyl group or a formyl group; or where two of them form a ring, they are not a malonyl group, a succinyl group, a glutaryl group or an adipoyl group.

It is preferred that the carbon atom of $R_1$, $R_2$, $R_3$ and $R_4$ which is directly bonded to a nitrogen atom of the hydrazine core of the compound is not substituted by a thioxo group (e.g., thioacetyl, thioaldehyde, thiocarboxy, thiobenzoyl).

More preferably, $R_1$, $R_2$, $R_3$ and $R_4$ each represents an unsubstituted alkyl group or a substituted alkyl group as described above; or $R_1$ and $R_2$, $R_3$ and $R_4$, $R_1$ and $R_3$, and $R_2$ and $R_4$ each are bonded to each other to form a ring of an alkylene group having no hetero atoms (e.g., oxygen, sulfur, nitrogen) other than carbon atoms constituting the ring. The alkylene group may optionally be substituted by one or more of the preceding V groups.

Especially preferably, $R_1$, $R_2$, $R_3$ and $R_4$ each is such that the carbon atom thereof which is directly bonded to a nitrogen atom of the hydrazine core of the compound is in an unsubstituted methylene group or a methylene group substituted by one or more alkyl groups (e.g., methyl, ethyl). Most preferably, $R_1$, $R_2$, $R_3$ and $R_4$ each represents an unsubstituted alkyl group (e.g., methyl, ethyl, propyl, butyl), or a substituted alkyl group (e.g., a sulfoalkyl group such as 2-sulfoethyl, 3-sulfopropyl, 4-sulfobutyl, 3-sulfobutyl; a carboxyalkyl group such as carboxymethyl or 2-carboxyethyl; a hydroxyalkyl group such as 2-hydroxyethyl); or $R_1$ and $R_2$, $R_3$ and $R_4$, R1 and $R_3$, and $R_2$ and $R_4$ each are bonded to each other to form a 5-membered or 7-membered ring of an alkylene group.

The hydrazine compounds of formula (I) may be isolated in the form of salts, without difficulty, if the salt forms are advantageous for production and storage of the compounds. The salt forms include any and every compound capable of forming a salt with hydrazines. The hydrazine compounds can be used in the form of salts in the present invention. Preferred salts include, for example, arylsulfonates (e.g., p-toluenesulfonates, p-chlorobenzenesulfonates), aryldisulfonates (e.g., 1,3-benzenedisulfonates, 1,5-naphthalenedisulfonates, 2,6-naphthalenedisulfonates), thiocyanates, piclinates, carboxylates (e.g., oxalates, acetates, benzoates, hydrogenoxalates), halides (e.g., hydrochlorides, hydrofluorides, hydrobromides, hydroiodides), sulfates, perchlorates, tetrafluoroborates, sulfites, nitrates, phosphates, carbonates and bicarbonates.

Among the salts, hydrogenoxalates, oxalates and hydrochlorides are preferred.

The compounds of formula (II) are described in detail below.

$R_5$ and $R_6$ have the same meanings as $R_1$, $R_2$, $R_3$ and $R_4$; and the preferred examples stated in regard to $R_1$, $R_2$, $R_3$ and $R_4$ also apply for $R_5$ and $R_6$.

Especially preferably, $R_5$ and $R_6$ each represents a methyl group, or $R_5$ and $R_6$ are bonded to each other to form an unsubstituted tetramethylene group.

$Z_1$ represents an alkylene group having 4 or 6 carbon atoms, preferably an alkylene group having 4 carbon atoms; provided that the carbon atom of $Z_1$ which is directly bonded to a nitrogen atom of the hydrazine core of the compound is not substituted by an oxo group.

The alkylene group may be unsubstituted or substituted. Suitable substituents of the alkylene group include the groups included in the definition of V. The carbon atom of the alkylene group which is directly bonded to a nitrogen atom of the hydrazine core of the compound is preferably an unsubstituted methylene or a methylene group substituted by at least one alkyl group (e.g., methyl, ethyl).

$Z_1$ is especially preferably an unsubstituted tetramethylene group.

The compounds of formula (III) are described in detail below.

$R_7$ and $R_8$ have the same meanings as $R_1$, $R_2$, $R_3$ and $R_4$; and the preferred examples stated in regard to $R_1$, $R_2$, $R_3$ and $R_4$ also apply to $R_7$ and $R_8$.

Especially preferably, $R_7$ and $R_8$ each represents a methyl group, or $R_7$ and $R_8$ are bonded to each other to form a trimethylene group.

$Z_2$ represents an alkylene group having 2 carbon atoms.

$Z_3$ represents an alkylene group having 1 or 2 carbon atoms.

The alkylene groups represented by $Z_2$ and $Z_3$ may be unsubstituted or substituted. Suitable substituents include the groups included in the definition of V.

$Z_2$ is more preferably an unsubstituted ethylene group.

$Z_3$ is more preferably an unsubstituted methylene or ethylene group.

$L_1$ and $L_2$ each represents an unsubstituted or substituted methine group. Suitable substituents include the groups included in the definition of V. A preferred substituent is an unsubstituted alkyl group (e.g., methyl, t-butyl).

More preferably, $L_1$ and $L_2$ each is an unsubstituted methine group.

The compounds of formula (IV) are described in more detail below.

$Z_4$ and $Z_5$ each represents an alkylene group having 3 carbon atoms, provided that the carbon atom of the group which is directly bonded to a nitrogen atom of the hydrazine core of the compound is not substituted by an oxo group.

The alkylene group may be unsubstituted or substituted. Suitable substituents for the alkylene group include the groups included in the definitin of V, provided that the carbon atom of the group which is directly bonded to a nitrogen atom of the hydrazine core of the compound is preferably in the form of an unsubstituted methylene group or a methylene group substituted by one or more alkyl groups (e.g., methyl, ethyl).

Especially preferably, $Z_4$ and $Z_5$ each is an unsubstituted trimethylene group or a trimethylene group substituted by one or more unsubstituted alkyl groups (e.g., 2,2-dimethyltrimethylene).

The compounds of formulae (II), (III) and (IV) may be isolated in the form of salts, like the compounds of formula (I). Suitable salts of the compounds of formulae (II), (III) and (IV) include the same salts discussed with respect to the compounds of formula (I). Preferred salts are hydrogenoxalates, oxalates and hydrochlorides.

Specific examples of compounds of formulae (I), (II), (III) and (IV) are given below, which, however, are not limitative. Examples of compounds of formula (I):

The compounds of formula (I) include but are not limited to the compounds of formulae (II), (III) and (IV). The following examples are examples of compounds of formula (I) which are outside the scope of formulae (II), (III) and (IV).

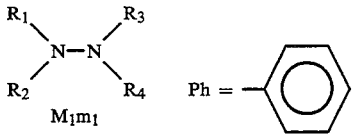

| Compound No. | $R_1$ | $R_2$ | $R_3$ | $R_4$ | $M_1$ | $m_1$ |
|---|---|---|---|---|---|---|
| (1-1) | $-CH_3$ | $-CH_3$ | $-(CH_2)_2CH_3$ | $-(CH_2)_2CH_3$ | — | — |
| (1-2) | " | " | " | " | $(CO_2H)_2$ | 1 |
| (1-3) | $-C_2H_5$ | $-C_2H_5$ | $-C_2H_5$ | $-C_2H_5$ | " | " |
| (1-4) | $-CH_3$ | $-CH_3$ | $-CH_3$ | $-CH_3$ | " | " |
| (1-5) | $-(CH_2)_4CH_3$ | $-(CH_2)_4CH_3$ | $-(CH_2)_4CH_3$ | $-(CH_2)_4CH_3$ | " | " |
| (1-6) | $-CH(CH_3)_2$ | $-CH_3$ | $-CH(CH_3)_2$ | $-CH_3$ | " | " |
| (1-7) | $-CH_3$ | $-CH_3$ | $-CH_2CH(CH_3)_2$ | $-CH_2CH(CH_3)_2$ | " | " |
| (1-8) | $-CH(CH_3)_2$ | $-CH(CH_3)_2$ | $-CH(CH_3)_2$ | $-CH_3$ | " | " |
| (1-9) | $-(CH_2)_3CH_3$ | $-(CH_2)_3CH_3$ | $-(CH_2)_3CH_3$ | $-(CH_2)_3CH_3$ | " | " |
| (1-10) | $-C(CH_3)_3$ | $-CH_3$ | $-C(CH_3)_3$ | $-CH_3$ | " | " |
| (1-11) | $-(CH)_2OCH_3$ | $-(CH)_2OCH_3$ | $-(CH)_2OCH_3$ | $-(CH_2)_2OCH_3$ | $(CO_2H)_2$ | 1 |
| (1-12) | $-(CH_2)_2CO_2H$ | $-CH_3$ | $-(CH_2)_2CO_2H$ | $-CH_3$ | — | — |
| (1-13) | $-CH_2CO_2H$ | $-CH_2CO_2H$ | $-CH_3$ | " | — | — |
| (1-14) | $-(CH_2)_2CO_2H$ | $-CH_3$ | " | " | — | — |
| (1-15) | $-(CH_2)_4SO_3H$ | " | " | " | — | — |
| (1-16) | $-(CH_2)_3SO_3H$ | $-(CH_2)_3SO_3H$ | " | " | — | — |
| (1-17) | $-(CH_2)_2(CH_3)SO_3H$ | $-CH_3$ | $-(CH_2)_2(CH_3)SO_3H$ | " | — | — |
| (1-18) | $-(CH_2)_2CN$ | " | $-CH_3$ | " | — | — |
| (1-19) | " | $-(CH_2)_2CN$ | " | " | — | — |
| (1-20) | $-(CH_2)_2OH$ | $-(CH_2)_2OH$ | $-(CH_2)_2OH$ | $-(CH_2)_2OH$ | — | — |
| (1-21) | $-(CH_2)_3OH$ | $-(CH_2)_2OH$ | $-C_2H_5$ | $-C_2H_5$ | — | — |
| (1-22) | $-(CH_2)_2SCH_3$ | $-(CH_2)_2SCH_3$ | " | " | — | — |
| (1-23) | $-Ph$ | $-CH_3$ | $-(CH_2)_2CH_3$ | $-(CH_2)_2CH_3$ | — | — |
| (1-24) | $-CH_2Ph$ | $-CH_2Ph$ | $-CH_2Ph$ | $-CH_2Ph$ | — | — |
| (1-25) | $-CH_2CONHSO_2CH_3$ | $-CH_3$ | $-CH_2CONHSO_2CH_3$ | $-CH_3$ | — | — |
| (1-26) | $-(CH_2)_2OCOCH_3$ | $-(CH_2)_2OCOCH_3$ | $-CH_3$ | " | — | — |
| (1-27) | $-CH_2CH{=}CH_2$ | $-CH_2CH{=}CH_2$ | " | " | $(CO_2H)_2$ | 1 |
| (1-28) | $-(CH_2)_2NHCOCH_3$ | $-CH_3$ | $-(CH_2)_2NHCOCH_3$ | " | — | — |
| (1-29) | $-(CH_2)_2N(CH_3)_2$ | " | $-(CH_2)_2N(CH_3)_2$ | " | — | — |

(1-30)

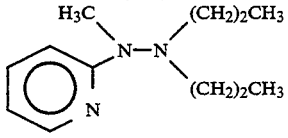

(1-31)

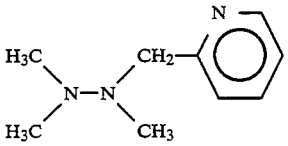

(1-32)

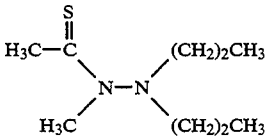

(1-33)

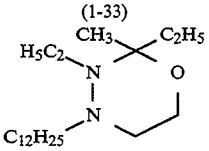

(1-34)

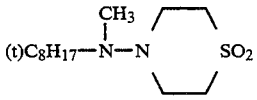

(1-35)

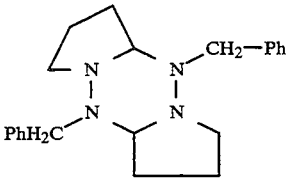

(1-36)

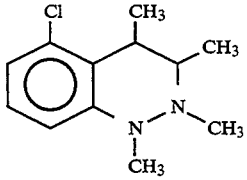

(1-37)

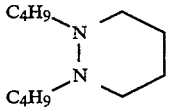

(1-38)

(1-39)

-continued

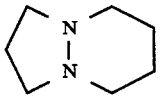

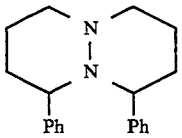

(1-40)

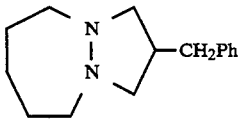

(1-41)

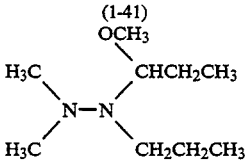

(1-42)

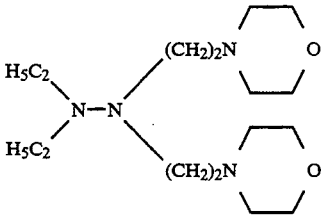

(1-43)

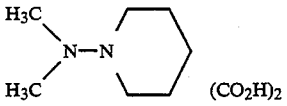

(1-44)

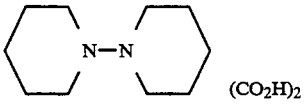

(1-45)

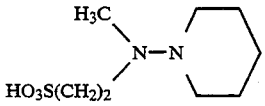

The following are examples of compounds of formula (II):

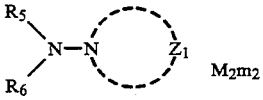

| Compound No. | $Z_1$ | $R_5$ | $R_6$ | $M_2$ | $m_2$ |
|---|---|---|---|---|---|
| (2-1) | $-(CH_2)_4-$ | | $-(CH_2)_4-$ | $(CO_2H)_2$ | 1 |
| (2-2) | " | | " | HCl | 1 |
| (2-3) | " | | " | — | — |
| (2-4) | " | $-CH_3$ | $-CH_3$ | $(CO_2H)_2$ | 1 |
| (2-5) | " | " | " | — | — |
| (2-6) | " | | $-(CH_2)_5-$ | $(CO_2H)_2$ | 1 |
| (2-7) | " | | $-(CH_2)_6-$ | " | " |
| (2-8) | " | $-CH_3$ | $-(CH_2)_4SO_3H$ | — | — |
| (2-9) | " | $-CH_3$ | $-CH_2CO_2H$ | — | — |
| (2-10) | " | $-CH_2CO_2H$ | $-CH_2CO_2H$ | — | — |
| (2-11) | $-(CH_2)_4-$ | $-(CH_2)_2SO_3H$ | $-(CH_2)_2SO_3H$ | — | — |
| (2-12) | " | $-CH_3$ | $-(CH_2)_2SO_3H$ | — | — |
| (2-13) | " | $-CH_3$ | $-(CH_2)_2CH(CH_3)SO_3H$ | — | — |
| (2-14) | " | $-CH_3$ | $-(CH_2)_2CN$ | — | — |
| (2-15) | $-(CH_2)_6-$ | | $-(CH_2)_5-$ | $(CO_2H)_2$ | 1 |
| (2-16) | " | | $-(CH_2)_6-$ | $(CO_2H)_2$ | 1 |
| (2-17) | " | $-CH_3$ | $-(CH_2)_2PO_3H_2$ | — | — |
| (2-18) | " | $-CH_3$ | $-CH_3$ | $(CO_2H)_2$ | 1 |
| (2-19) | " | $-CH_3$ | $-(CH_2)_4SO_3H$ | — | — |
| (2-20) | " | $-(CH_2)_2CO_2H$ | $-(CH_2)_2CO_2H$ | — | — |
| (2-21) | " | $-CH_3$ | $\oplus$ $-(CH_2)_2-N(CH_3)_3$ | HCl | 2 |
| (2-22) | " | $-(CH_2)_2CH_3$ | $-(CH_2)_2OH$ | — | — |
| (2-23) | $-(CH_2)_4-$ | $-CH_3$ | $\oplus$ $-(CH_2)_3N(CH_3)_3$ | HCl | 2 |
| (2-24) | " | $-CH_3$ | $-(CH_2)_3OH$ | — | — |
| (2-25) | " | $-(CH_2)_2CO_2C_2H_5$ | $-(CH_2)_2CO_2C_2H_5$ | — | — |
| (2-26) | " | $-(CH_2)_2OH$ | $-(CH_2)_4SO_3H$ | — | — |
| (2-27) | " | $-CH_3$ | $-(CH_2)_3SO_3H$ | — | — |

(2-28) (2-29)

-continued
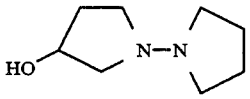
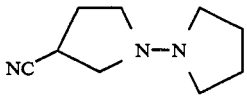
(2-30)
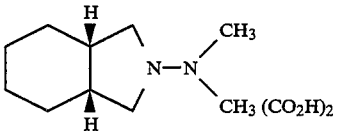
(2-31)
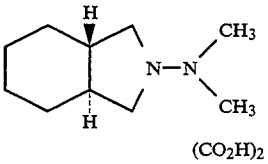
(2-32)
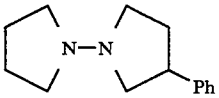
(2-33)
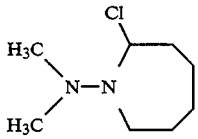
(2-34)
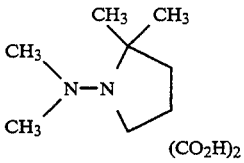
The following are examples of compounds of formula (III):
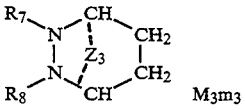
| Compound No. | $Z_3$ | $R_7$ | $R_8$ | $M_3$ | $m_3$ |
|---|---|---|---|---|---|
| (3-1) | $-CH_2-$ | $-CH_3$ | $-CH_3$ | $(CO_2H)_2$ | 1 |
| (3-2) | " | " | " | — | — |
| (3-3) | " | $-(CH_2)_3-$ | | $(CO_2H)_2$ | 1 |
| (3-4) | " | " | | HCl | 1 |
| (3-5) | " | $-CH_2OH$ | $-CH_2OH$ | — | — |
| (3-6) | $-(CH_2)_2-$ | $-CH_3$ | $-CH_3$ | $(CO_2H)_2$ | 1 |
| (3-7) | " | " | " | — | — |
| (3-8) | " | $-(CH_2)_3-$ | | $(CO_2H)_2$ | 1 |
| (3-9) | " | " | | HCl | 1 |
| (3-10) | " | $-CH_2OH$ | $-CH_2OH$ | — | — |
| (3-11) | $-CH_2-$ | $-(CH_2)_4-$ | | $(CO_2H)_2$ | 1 |
| (3-12) | " | $-(CH_2)_5-$ | | $(CO_2H)_2$ | 1 |
| (3-13) | $-(CH_2)_2-$ | $-(CH_2)_4-$ | | HCl | 1 |
| (3-14) | " | $-(CH_2)_5-$ | | $(CO_2H)_2$ | 1 |
| (3-15) | $-CH_2-$ | $-CH_3$ | $-C(CH_3)_3$ | " | " |
(3-16)
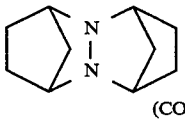
(3-17)
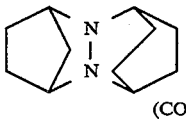
(3-18)
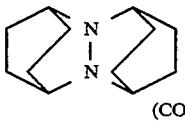
(3-19)
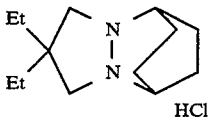
-continued
(3-20)
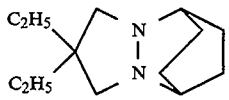
(3-21)
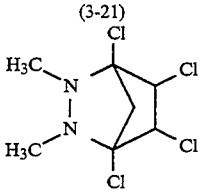
(3-22)
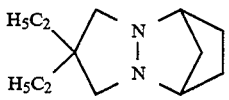
(3-23)
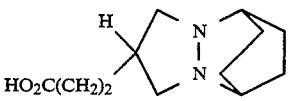
(3-24)
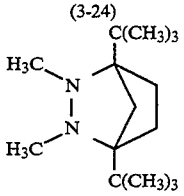
(3-25)
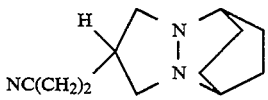
(3-26)
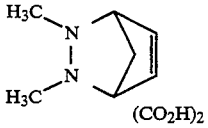
(3-27)
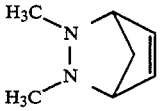
The following are examples of compounds of formula (IV):

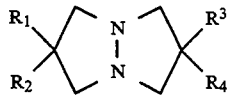

$M_4m_4$

| Compound No. | $R_1$ | $R_2$ | $R_3$ | $R_4$ | $M_4$ | $m_4$ |
|---|---|---|---|---|---|---|
| (4-1) | $-CH_3$ | $-CH_3$ | $-CH_3$ | $-CH_3$ | $(CO_2H)_2$ | 1 |
| (4-2) | $-H$ | $-H$ | $-H$ | $-H$ | " | " |
| (4-3) | $-C_2H_5$ | $-C_2H_5$ | $-C_2H_5$ | $-C_2H_5$ | " | " |
| (4-4) | $-H$ | $-CH_3$ | $-H$ | $-CH_3$ | " | " |
| (4-5) | " | $-C_2H_5$ | " | $-C_2H_5$ | " | " |
| (4-6) | " | $-CH_2CO_2H$ | " | $-CH_2CO_2H$ | — | — |
| (4-7) | $-CH_3$ | $-CH_3$ | $-CH_3$ | $-CH_3$ | HCl | 1 |
| (4-8) | " | " | " | " | — | — |
| (4-9) | " | $-C_2H_5$ | " | $-C_2H_5$ | $(CO_2H)_2$ | 1 |
| (4-10) | " | $-(CH_2)_2SO_3H$ | " | $-(CH_2)_2SO_3H$ | " | " |
| (4-11) | $-H$ | $-H$ | $-H$ | $-H$ | HCl | " |
| (4-12) | " | " | " | " | $H_2SO_4$ | " |

(4-13)

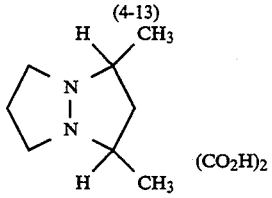

(4-14)

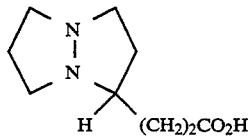

(4-15)

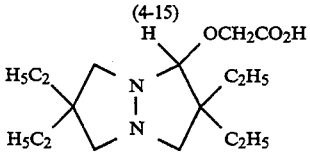

(4-16)

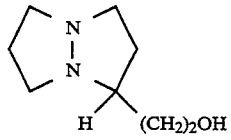

The hydrazines for use in the present invention may be produced by various methods. For instance, they may be produced by alkylating hydrazine. Known methods for alkylating hydrazine include a method of direct alkylation of hydrazine with an alkyl halide or an alkyl sulfonate; a method of reductive alkylation of hydrazine with a carbonyl compound and sodium borocyanide hydride; and a method of acylation of hydrazine followed by reduction of the acylated hydrazine with lithium hydride. Such methods are described, for instance, in S. R. Sandler & W. Karo, *Organic Functional Group Preparation,* Vol. 1, Chap. 14, pp. 434 to 465 (published by Academic Press, 1968).

The compounds of formula (I) are described in E. L. Clenna, *Journal of The American Chemical Society,* Vol. 112, No. 13, p. 5080 (1990), and they may be produced with reference to the disclosure of that publication.

Examples of production of some typical compounds of formula (I) are given below.

PRODUCTION EXAMPLE 1

Production of Compound (1-1)

70 g (1.2 mols) of propionaldehyde was added to 0.2 mol of 1,1-dimethylhydrazine and 500 ml of acetonitrile and stirred at room temperature, to which was dropwise added 25 g (0.396 mol) of sodium borohydride cyanide still with stirring. This mixture was further stirred for one hour, and 48.3 g (0.804 mol) of acetic acid was added thereto with cooling with ice and further stirred for 2 hours at room temperature. 100 ml of concentrated hydrochloric acid was dropwise added thereto with cooling with ice, and the solvent was removed by distillation. After further distillation under reduced pressure, 3.95 g (yield: 14%) of Compound (1-1) was obtained as a colorless liquid, having a boiling point of 48° to 52° C./16 mmHg.

PRODUCTION EXAMPLE 2

Production of Compound (1-2)

A mixture comprising 2.5 g (0.027 mol) of oxalic acid and 50 ml of ethyl acetate was added to 3.95 g (0.027 mol) of Compound (1-1) and stirred at room temperature. The crystals precipitated out were taken out by suction filtration and dried to obtain 5.3 g (yield: 83%) of Compound (1-2) as colorless crystals, having a melting point of 128° to 131° C.

The compounds of formula (II) are described in, for example, S. F. Nelsen et al., *Journal of the American Chemical Society,* Vol. 98, No. 12, p. 5269 (1976) and S. F. Nelsen & G. R. Weisman, *Tetrahedron Letter,* Vol. 26, p. 2321 (1973) and they may be produced with reference to the disclosures of those publications.

Examples of production of some typical compounds of formula (II) are given below.

PRODUCTION EXAMPLE 3

Production of Compound (2-3)

Reaction Route:

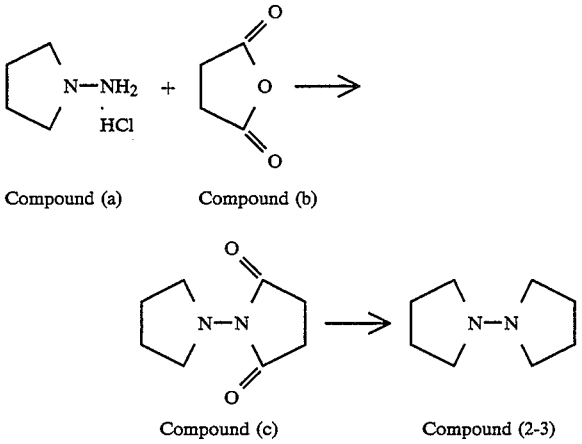

20 g (0.163 mol) of Compound (a), 16.3 g (0.163 mol) of Compound (b) and 80 ml of acetic acid were heated under reflux for 15 hours, 50 ml of water and 100 ml of 5% sodium hydroxide solution were added thereto, and the resulting mixture was extracted with 200 ml of chloroform. After being dried with anhydrous sodium sulfate, the solvent was removed by distillation under reduced pressure. 200 ml of ethyl acetate was added to the oil obtained, and 200 ml of hexane was added thereto to precipitate crystals. The crystals were taken out by suction filtration and dried to obtain 8.65 g (yield: 32%) of Compound (c) as colorless crystals.

8.9 g (0.235 mol) of aluminum lithium hydride and 100 ml of tetrahydrofuran were cooled to 0° C., and 70 ml of tetrahydrofuran solution containing 7.9 g (0.047 mol) of Compound (c) was gradually added thereto with stirring whereupon the reaction solution was kept at 5° C. or lower. After being stirred for 4 hours at room temperature, the reaction solution was again cooled to 0° C., and 9 ml of water, 9 ml of 15% aqueous sodium hydroxide solution and 27 ml of water were added thereto in this order. The colorless crystals thus precipitated out were taken out by suction filtration. The resulting filtrate was dried with anhydrous sodium sulfate, and the solvent was removed by distillation under reduced pressure. The residue was subjected to further distillation under reduced pressure to obtain 1.44 g (yield: 17%) of Compound (2-3) as a colorless liquid, having a boiling point of 85° to 90° C./25 mmHg.

PRODUCTION EXAMPLE 4

Production of Compound (2-1)

120 ml of ethyl acetate solution containing 4.3 g (0.048 mol) of oxalic acid was added to 6 g (0.043 mol) of Compound (2-3) and 100 ml of ethyl acetate and stirred. The crystals precipitated out were taken out by suction filtration and dried to obtain 9.3 g (yield: 94%) of Compound (2-1) as colorless crystals, having a melting point of 129° to 131° C.

PRODUCTION EXAMPLE 5

Production of Compound ( 2-5 )

Reaction Route:

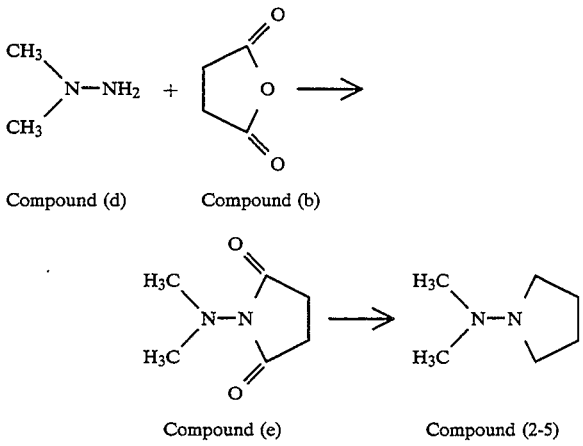

40 g (0.4 mol) of Compound (d), 25.2 g (0.42 mol) of Compound (b) and 200 ml of acetic acid were heated under reflux for 2 hours. 100 ml of water and 100 ml of 5% aqueous sodium hydroxide were added to the reaction liquid, which was then extracted with 200 ml of chloroform. The chloroform layer was dried with magnesium sulfate, and the solvent was removed by distillation under reduced pressure. 50 ml of ethyl acetate and 150 ml of hexane were added to the residue and stirred to precipitate crystals. The crystals were taken out by suction filtration and dried to obtain 26 g (yield: 44%) of Compound (e) as colorless crystals.

26.7 g (0.7 mol) of aluminum lithium hydride and 300 ml of tetrahydrofuran were cooled to 0° C., and 100 ml of tetrahydrofuran solution containing 20 g (0.14 mol) of Compound (e) was dropwise added thereto with stirring while the reaction liquid was kept at 10° C. or lower. After being stirred for 2 hours at room temperature, the reaction liquid was again cooled to 0° C., and 27 ml of water, 27 ml of 15% aqueous sodium hydroxide solution and 71 ml of water were dropwise added thereto while the temperature of the reaction liquid was kept at 25° C. or lower. The crystals thus precipitated out were taken out by suction filtration, and 200 ml of water and 200 ml of methylene chloride were added to the resulting filtrate to effect an extraction. The methylene chloride layer was dried with anhydrous sodium sulfate, and the solvent was removed by distillation at normal pressure. The residue was subjected to further distillation at normal pressure to obtain 1.42 g (yield: 9%) of Compound (2-5) as a liquid, having a boiling point of 75° to 78° C./760 mmHg.

PRODUCTION EXAMPLE 6

Production of Compound (2-4)

A mixture comprising 10 ml of ethyl acetate and 0.63 g (0.007 mol) of oxalic acid was added to 0.8 g (0.007 mol) of Compound (2-5) and 10 ml of ethyl acetate and stirred. The crystals thus precipitated out were taken out by suction filtration to obtain 1.26 g (yield: 88%) of Compound (2-4) as colorless crystals, having a melting point of 104° to 106° C.

The compounds of formula (III) are described in, for example, H. R. Snyder, JR & J. G. Michels, *Journal of*

*Organic Chemistry,* Vol. 28, p. 1144 (1963); J. E. Anderson & L. M. Lehn, *Journal of the American Chemistry,* Vol. 89, No. 1, p. 81 (1967); Hermann Stetter & Peter Woernle, *Justus Liebigs Annalen der Chemie,* Vol. 724, p. 150 (1969); and S. F. Nelsen et al., *Tetrahedron,* Vol. 42, No. 6, p. 1769 (1986); and they may be produced in accordance with the disclosures of these publications.

Examples of production of some typical compounds of formula (III) are given below.

PRODUCTION EXAMPLE 7

Production of Compound (3-20)

Reaction Route:

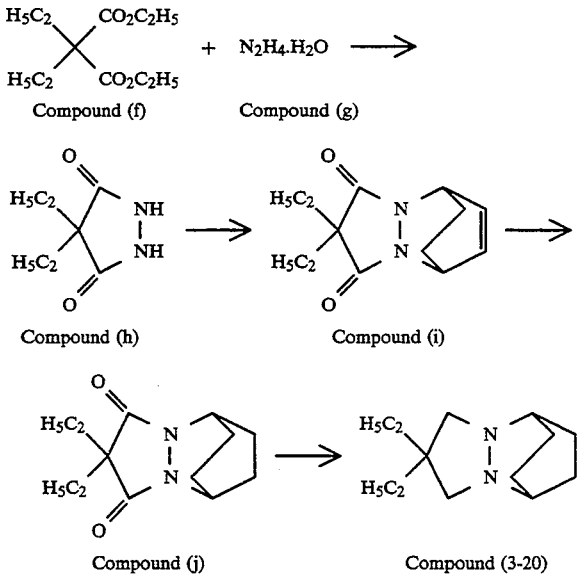

120 g (0.554 mol) of Compound (f), 55.5 g (1.11 mol) of Compound (g), 30 g (0.554 mol) of sodium methoxide and 150 ml of ethanol were heated under reflux for one hour, then ethanol was removed by distillation under reduced pressure, and 600 ml of water and 450 ml of ether were added to the residue and stirred at room temperature. The aqueous layer was separated and adjusted to a pH of 2 with concentrated hydrochloric acid. The crystals as precipitated out were separated by suction filtration to obtain 26 g (yield: 30%) of Compound (h) as colorless crystals.

25 g (0.16 mol) of Compound (h), 12.8 g (0.16 mol) of 1,3-cyclohexadiene and 150 ml of methylene chloride were cooled with ice, and 250 ml of methylene chloride solution containing 78.8 g (0.178 mol) of lead tetraacetate was dropwise added thereto while still cooling. After being stirred with cooling with ice for 6 hours, the crystals precipitated out were taken out by suction filtration, and 0.8 liter of water was added to the filtrate to effect an extraction. The methylene chloride layer was dried with anhydrous sodium sulfate, then the solvent was removed by distillation, and the residue was recrystallized from ligroin to obtain 21 g (yield: 56 %) of Compound (i) as colorless crystals.

20.5 g (0.087 mol) of Compound (i), 260 ml of ethanol and 2 g of 5% palladium-carbon were subjected to catalytic hydrogenation with hydrogen gas at a pressure of 16 kg/cm$^2$ for 12 hours. The 5% palladium-carbon was removed by sellaite filtration, then the solvent was removed by distillation, and the residue was recrystallized from ligroin to obtain 17.4 g (yield: 85%) of Compound (j) as colorless crystals.

4 g (0.105 mol) of aluminum lithium hydride and 10 ml of tetrahydrofuran were stirred at room temperature, and 210 ml of a tetrahydrofuran solution containing 16.5 g (0.07 mol) of Compound (j) were added dropwise thereto still with stirring whereupon the reaction liquid was maintained at 30° C. or lower. After being stirred for 3 hours, the reaction liquid was cooled to 0° C., then 4 ml of water, 4 ml of 15 % aqueous sodium hydroxide solution and 12 ml of water were added thereto, and the crystals as precipitated out were taken out by suction filtration. The resulting filtrate was dried with anhydrous sodium sulfate and the solvent was removed by distillation. The residue was subjected to further distillation under reduced pressure to obtain 6.4 g (44%) of Compound (3-20) as a liquid, having a boiling point of 125° to 128° C./4.5 mmHg.

PRODUCTION EXAMPLE 8

Production of Compound (3-19)

Hydrogen chloride gas was introduced into a mixture of 1.5 g of Compound (3-20) and 50 ml of ethyl acetate, whereupon crystals precipitated out. The crystals were taken out by suction filtration and dried to obtain 1.17 g (66%) of Compound (3-19) as colorless crystals, having a melting point of 128° to 130° C.

PRODUCTION EXAMPLE 9

Production of Compound (3-2)

Reaction Route:

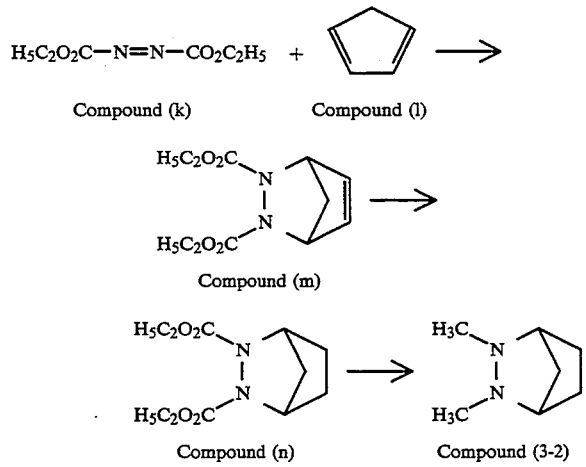

84.5 g (0.485 mol) of Compound (k) and 100 ml of ether were cooled to 5° C. or lower. With stirring, 60 ml of an ether solution containing 48.1 g (0.728 mol) of cyclopentadiene, produced by pyrolysis of dicyclopentadiene, were added dropwise thereto. The reaction system was then stirred for one hour, and the solvent was removed by distillation under reduced pressure. By further distillation under reduced pressure, 101 g (86%) of Compound (m) were obtained as a colorless liquid, having a boiling point of 104° to 105° C./0.48 mmHg.

50 g (0.21 mol) of Compound (m), 500 ml of methanol and 5 g of 5% palladium-carbon were subjected to catalytic hydrogenation with hydrogen gas at a pressure of 14 kg/cm$^2$ for 12 hours. The 5% palladium-carbon was removed by sellaite filtration, the solvent of the filtrate was removed by distillation under reduced pressure, and the residue was subjected to further distillation under reduced pressure to obtain 48 g (yield: 95%) of Compound (n) as a colorless liquid, having a boiling point of 135° C./1.5 mmHg.

50 ml of an ether solution containing 15 g (0.062 mol) of Compound (n) were added dropwise to 7.1 g (0.186 mol) of aluminum lithium hydride and 75 ml of ether, whereupon the temperature of the reaction liquid rose to 35° C.

The reaction liquid was stirred for 2 hours at room temperature, and 13 ml of water was added thereto. The crystals thus precipitated out were taken out by suction filtration, the filtrate was dried with magnesium sulfate, and the solvent was removed by distillation under reduced pressure. The residue was subjected to further distillation under reduced pressure to obtain 2.9 g (yield: 14%) of Compound (3-2) as a colorless liquid, having a boiling point of 60° to 67° C./25 mmHg.

PRODUCTION EXAMPLE 10

Production of Compound ( 3-1 )

30 ml of an ethyl acetate solution containing 2.25 g (0.025 mol) of oxalic acid were added to 2.9 g (0.023 mol ) of Compound ( 3-2 ) and 30 ml of ethyl acetate, and then the crystals precipitated out were taken out by suction filtration and dried to obtain 4.2 g (yield: 85%) of Compound (3-1) as colorless crystals, having a melting point of 118° to 120° C.

PRODUCTION EXAMPLE 11

Production of Compound (3-27)

50 ml of an ether solution containing 10 g ( 0.042 mol) of Compound (m) were added dropwise to 4.8 g (0.125 mol) of aluminum lithium hydride and 50 ml of ether, whereupon the temperature of the reaction liquid rose to 35° C.

The reaction liquid was stirred for one hour at room temperature, then 13 ml of water were added thereto, and the crystals precipitated out were taken out by suction filtration. The resulting filtrate was dried with magnesium sulfate, then the solvent was removed by distillation under reduced pressure, and the residue was subjected to further distillation under reduced pressure to obtain 0.9 g (yield: 17%) of Compound (3-27) as a colorless liquid, having a boiling point of 80° to 88° C./75 mmHg.

PRODUCTION EXAMPLE 12

Production of Compound (3-26)

10 ml of an ethyl acetate solution containing 0.7 g (0.008 mol) of oxalic acid were added to 0.9 g (0.0071 mol) of Compound (3-27) and 10 ml of ethyl acetate, and the crystals precipitated out were taken out by suction filtration and dried to obtain 1.2 g (76%) of Compound (3-26) as colorless crystals, having a melting point of 106° to 108° C.

The compounds of formula (IV) are described in, for example, S. F. Nelsen at al., *Journal of the American Chemical Society,* Vol. 96, No. 9, p- 2916 (1974); and E. L. Buhle et al., *Journal of the American Chemical Society,* Vol. 65, p- 29 (1943), and they may be produced in accordance with the disclosures of these publications.

Examples of production of some typical compounds of formula (IV) are given below.

PRODUCTION EXAMPLE 13

Production of Compound (4-1)

Reaction Route:

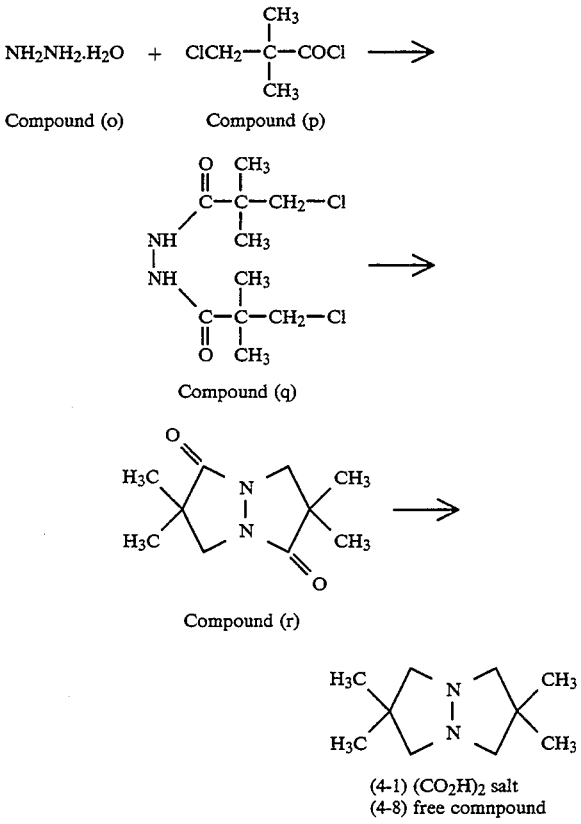

16 g of Compound (o), 300 ml of water and 200 g of ice were stirred, and 100 g of Compound (p) were added dropwise thereto. After one hour, 200 ml of methanol, 100 ml of water and 500 ml of ethyl acetate were added thereto to effect an extraction. The ethyl acetate layer was dried with magnesium sulfate, then the solvent was removed by distillation under reduced pressure, and water was added to the residue. The crystals thus precipitated out were taken out by suction filtration and dried to obtain 81 g (yield: 94%) of Compound (q) as colorless crystals, having a melting point of 206° to 207° C.

200 ml of a 28% methanol solution of sodium methoxide were added to 80 g of Compound (q) and 200 ml of methanol. After being heated under reflux for 5 hours, the methanol was removed by distillation under reduced pressure.

200 ml of methanol were added to the residue, the solids were removed by filtration, and the filtrate was concentrated and purified by column chromatography using Sephadex LH-20 as a carrier and methanol as an eluent. The purified product was recrystallized from water to obtain 21 g ( yield: 36% ) of Compound (r) as colorless crystals, having a melting point of 164° to 167° C.

7 g of aluminum lithium hydride were gradually added to 17 g of Compound (r) and 200 ml of tetrahydrofuran. After being heated under reflux for 6 hours, the reaction liquid was poured into ice water and made alkaline with sodium hydroxide. The reaction liquid was thereafter extracted with 300 ml of ethyl acetate.

The ethyl acetate layer was dried with anhydrous sodium sulfate, then the solvent was removed by distillation under reduced pressure, and the residue was purified by column chromatography using alumina as a carrier and ethyl acetate as an eluent. The intended fraction was distilled under reduced pressure to remove the solvent therefrom and then dissolved in 20 ml of ethyl acetate. 10 g of oxalic acid were added thereto and dissolved under heat. After being cooled, the crystals precipitated out were taken out by suction filtration and dried to obtain 4.5 g (yield: 20%) of Compound (4-1) as colorless crystals, having a melting point of 203° to 206° C.

PRODUCTION EXAMPLE 14

Production of Compound (4-8).

Compound (4-1) was dissolved in methanol, an excess amount of $NaHCO_3$ was added thereto for neutralization, the solids formed were removed by filtration, and the solvent was removed from the filtrate by distillation under reduced pressure to obtain Compound (4-8) as a colorless liquid.

Suitable color sensitizing dyes for use in the present invention include all conventional dyes such as cyanine dyes, merocyanine dyes, rhodacyanine dyes, oxonole dyes, hemicyanine dyes, benzilidene dyes and xanthene dyes. For example, all the dyes described in T. H. James, *The Theory of the Photographic Process,* 3rd Ed., pp. 198–228 (published by Macmillan Co., 1966) may be used in the present invention.

Preferred for use in the present invention are sensitizing dyes having an oxidation potential of 0.95 ($V_{vs}$SCE) or less. (The term "SCE" as used herein means a "saturated calomel electrode".) These dyes are generally known to involve high dye desensitization. More preferred are panchromatic or near-infrared sensitizing dyes having an oxidation potential of 0.95 ($V_{vs}$SCE) or less and a spectral sensitivity peak at 600 nm or more.

Measurement of the oxidation potential of sensitizing dyes for use in the present invention is effected with phase fractionating secondary higher harmonics alternating current polarography. The details of the measurement are as follows: Acetonitrile (of a spectrometric grade) as dried in 4A-1/16 molecular sieves is used as a solvent. Normal-tetrapropylammonoium perchlorate (special reagent for polarography) is used as a supporting electrolyte. A sample solution is prepared by dissolving from $10^{-3}$ to $10^{-5}$ mol/liter of a sensitizing dye sample in acetonitrile containing 0.1 M supporting electrolyte. Before measurement, the sample solution is subjected to deoxygenation with an ultra-high-purity argon gas (99,999% purity) as previously passed through a high-alkaline aqueous solution of pyrogallol and through calcium chloride, for 15 minutes or more. A rotary platinum electrode is used as a working electrode. A saturated calomel electrode (SCE) is used as a reference electrode. Platinum is used as a pair electrode. The reference electrode and the sample solution are connected with each other via Luggin tube filled with acetonitrile containing 0.1 M supporting electrolyte. Vycor glass is used as a liquid-junction. The top of Luggin tube is separated from the top of the rotary platinum electrode by a distance of from 5 mm to 8 mm. The measurement is effected at 25° C. The measurement of the oxidation potential by the preceding phase fractionating secondary higher harmonics alternating current volutanmetry is described in *Journal of Imaging Science,* Vol. 30, pp. 27–35 (1986). Under these conditions, the oxidation potential of Dye (XIV-9) mentioned below was measured to be 0.915 (V vsSCE).

Sensitizing dyes which satisfy the preceding conditions with respect to the oxidation potential and the spectral sensitivity peak and which are represented by the following formulae (XI), (XII) and (XIII) are especially preferably used in the present invention.

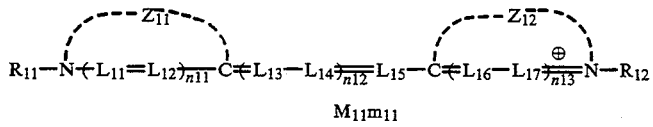

(XI)

$M_{11}m_{11}$

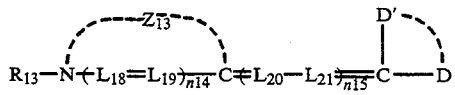

(XII)

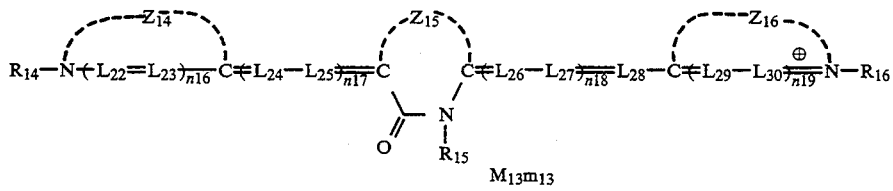

(XIII)

$M_{13}m_{13}$

In these formulae, $Z_{11}$, $Z_{12}$, $Z_{13}$, $Z_{14}$, $Z_{15}$ and $Z_{16}$ each represents a group of atoms necessary for forming a 5-membered or 6-membered nitrogen-containing heterocyclic ring.

D and D' each represents a group of atoms necessary for forming a non-cyclic or cyclic acidic nucleus.

$R_{11}$, $R_{12}$, $R_{13}$, $R_{14}$ and $R_{16}$ each represents an alkyl group.

$R_{15}$ represents an alkyl group, an aryl group or a heterocyclic group.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$ and $L_{30}$ each represents a methine group.

$M_{11}$, $M_{12}$ and $M_{13}$ each represents a charge-neutralizing pair ion; and $m_{11}$, $m_{12}$ and $m_{13}$ each represent a number of 0 or more, which is necessary for neutralizing the molecular charge.

$n_{11}$, $n_{13}$, $n_{14}$, $n_{16}$ and $n_{19}$ each represents 0 or 1; $n_{12}$ represents 1, 2 or 3; $n_{15}$ represents 2 or 3; and $n_{17}$ and $n_{18}$ each represents an integer of 0 or more, provided that the sum of $n_{17}$ and $n_{18}$ is 1, 2, 3 or 4.

The sensitizing dyes of formula (XI) are especially preferred.

The compounds of formulae (XI), (XII) and (XIII) are explained in more detail below.

Preferably, $R_{11}$, $R_{12}$, $R_{13}$, $R_{14}$ and $R_{16}$ each represents an unsubstituted alkyl group having from 1 to 18 carbon atoms (e.g., methyl, ethyl, propyl, butyl, pentyl, hexyl octyl, decyl, dodecyl, octadecyl), or a substituted alkyl group in which the alkyl moiety has from 1 to 18 carbon atoms. Suitable substituents of the substituted alkyl group include, for example, a carboxyl group, a sulfo group, a cyano group, a halogen atom (e.g., fluorine, chlorine, bromine), a hydroxyl group, an alkoxycarbonyl group having from 2 to 8 carbon atoms (e.g., methoxycarbonyl, ethoxycarbonyl, phenoxycarbonyl, benzyloxycarbonyl), an alkoxy group having from 1 to 8 carbon atoms (e.g., methoxy, ethoxy, benzyloxy, phenethyloxy), a monocyclic aryloxy group having from 6 to 10 carbon atoms (e.g., phenoxy, p-tolyloxy), an acyloxy group having from 1 to 3 carbon atoms (e.g., acetyloxy, propionyloxy), an acyl group having from 1 to 8 carbon atoms (e.g., acetyl, propionyl, benzoyl, mesyl), a carbamoyl group (e.g., unsubstituted carbamoyl, N,N-dimethylcarbamoyl, morpholinocarbonyl, piperidinocarbonyl), a sulfamoyl group (e.g., unsubstituted sulfamoyl, N,N-dimethylsulfamoyl, morpholinosulfonyl, piperidinosulfonyl), a sulfonylcarbamoyl group (e.g., methanesulfonylcarbamoyl) and an aryl group having from 6 to 10 carbon atoms (e.g., phenyl, 4-chlorophenyl, 4-methylphenyl, $\alpha$-naphthyl). More preferably, $R_{11}$, $R_{12}$, $R_{13}$, $R_{14}$ and $R_{16}$ each represents an unsubstituted alkyl group (e.g., methyl, ethyl, n-propyl, n-butyl, n-pentyl, n-hexyl), a carboxyalkyl group (e.g., 2-carboxyethyl, carboxymethyl), a sulfoalkyl group (e.g., 2-sulfoethyl, 3-carboxymethyl), 4-sulfopropyl, 4-sulfobutyl, 3-sulfobutyl), or a methanesulfonylcarbamoylmethyl group. $M_{11}m_{11}$, $M_{12}m_{12}$ and $M_{13}m_{13}$ are in the formulae to indicate the presence or absence of cations or anions, if necessary for neutralizing the ionic charges of the dyes. Whether a dye is cationic or anionic and whether it has net ionic charge(s) or not depend upon the auxochrome (such as a basic nucleus or an acidic nucleus of the end of the dye) and the substituents in the dye. Typical cations are inorganic or organic ammonium ions and alkali metal ions; while anions may be either inorganic ones or organic ones, including, for example, halide ions (e.g., fluoride ion, chloride ion, bromide ion, iodide ion), substituted arylsulfonato ions (e.g., p-toluenesulfonato ion, p-chlorobenzenesulfonato ion), aryldisulfonato ions (e.g., 1,3-benzenedisulfonato ion, 1,5-naphthalenedisulfonato ion, 2,6-naphthalenedisulfonato ion), alkylsulfato ions (e.g., methylsulfato ion), sulfato ions, thiocyanato ions, perchlorato ions, tetrafluoroborato ions, piclinato ions, acetato ions, and trifluoromethanesulfonato ions.

Of the various ions, ammonium ion, iodide ion and p-toluenesuofonato ion are preferred.

The nucleus to be formed by $Z_{11}$, $Z_{12}$, $Z_{13}$, $Z_{14}$ or $Z_{16}$ includes, for example, thiazole nuclei (such as thiazole nuclei (e.g., thiazole, 4-methylthiazole, 4-phenylthiazole, 4,5-dimethylthiazole, 4,5-diphenylthiazole), benzothiazoles (e.g., benzothiazole, 4-chlorobenzothiazole, 5-chlorobenzothiazole, 6-chlorobenzothiazole, 5-nitrobenzothiazole, 4-methylbenzothiazole, 5-methylthiobenzothiazole, 5-methylbenzothiazole, 6-methylbenzothaizole, 5-bromobenzothiazole, 6-bromobenzothiazole 5-iodobenzothiazole, 5-phenylbenzothiazole, 5-methoxybenzothiazole, 6-methoxybenzothiazole, 6-methylthiobenzothiaozle, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethylthiobenzothiazole, 5,6-dimethoxybenzothiazole, 5-hydroxy-6-methylbenzothiazole, tetrahydrobenzothiazole, 4-phenylbenzothiazole), naphthothiazole nuclei (e.g., naphtho [2,1-d ]thiazole, naphtho [1,2-d ]thiazole, naphtho [2,3-d thiazole, 5-methoxynaphtho [1 , 2-d ]thiazole, 7-ethoxynaphtho [2,1-d ]thiazole, 8-methoxynaphtho [2,1-d ]thiazole 5-methoxynaphtho[2,3-d]thiazole) , thiazoline nuclei (e.g. thiazoline, 4-methylthiazoline, 4-nitrothiazoline) oxazole nuclei ( such as oxazole nuclei ( e. g. , oxazole, 4-methyloxazole, 4-nitroxazole, 5-methyloxaozle, 4-phenyloxazole, 4,5-diphenyloxazole, 4-ethyloxazole) bnezoxazole nuclei ( e . g . , benzoxazole , 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole 6-methylbenzoxazole, 6-chlorobenzoxazole, 6-nitrobenzoxazole, 6-methoxybenzoxazole, 6-hydroxybenzoxazole, 5,6-dimethylbenzoxazole, 4 , 6-dimethylbenzoxazole , 5-ethoxybenzoxazole), naphthoxazole nuclei (e.g., naphtho[2,1-d]oxazole, naphtho[1,2-d]oxazole, naphtho [2,3-d]oxazole, 5-nitronaphtho[2,1-d]oxazole)), oxazoline nuclei (e.g., 4,4-dimethyloxazoline), selenazole nuclei (such as selenazole nuclei (e.g., 4-methylselenazole, 4-nitroselenazole, 4-phenylselenazole), benzoselenazole nuclei (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), naphthoselenazole nuclei (e.g., naphtho [2,1-d ]selenazole, naphtho[1,2-d]selenazole)), selenazoline nuclei (e.g., selenazoline, 4-methylselenazoline), tellurazole nuclei (such as tellurazole nuclei (e.g., tellurazole, 4-methyltellurazole, 4-phenyltellurazole), benzotellurazole nuclei (e.g., benzotellurazole, 5-chlorobenzotellurazole, 5-methylbenzotellurazole, 5,6-dimethylbenzotellurazole, 6-methoxybenzotellurazole), naphthotellurazole nuclei (e.g., naphtho[2,1-d]tellurazole, naphtho[1,2-d]tellurazole), tellurazoline nuclei (e.g., tellurazoline, 4-methyltellurazoline), 3,3-dialkylindolenine nuclei (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine), imidazole nuclei (such as imidazole nuclei (e.g., 1-alkylimidazoles, 1-alkyl-4-phenylimidazoles, 1-arylimidazoles), benzimidazole nuclei (e.g., 1-alkylbenzimidaozles, 1-alkyl-5-chlorbenzimidazoles, 1-alkyl-5,6-dichlorobenzimidazoles, 1-alkyl-5-methoxybenzimidazoles, 1-alkyl-5-cyanobenzimidazoles, 1-alkyl-5-fluorobenzimidazoles, 1-alkyl-5-trifluoromethylbenzimidazoles, 1-alkyl-6-chloro-5-cyanobenzimidazoles, 1-alkyl-6-chloro-5-trifluoromethylbenzimidazoles, 1-allyl-5,6-dichlorobenzimidazole, 1-allyl-5-chlorobenzimidazole, 1-arylbenzimidazoles, 1-aryl-5-chlorobenzimidazoles, 1-aryl-5,6-dichlorobenzimidazoles, 1-aryl-5-methoxybenzimidazoles, 1-aryl-5-cyanobenzimidazoles), naphthimidazole nuclei (e.g., alkylnaphtho[1,2-d]imidazoles, 1-arylnaphtho[1,2-d]imidazoles), pyridine nuclei (e.g., 2-pyridine, 4-pyridine, 5-methyl-2-pyridine, 3-methyl-4-pyridine), quinoline nuclei (such as quinoline nuclei (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro- 4-quinoline), isoquinoline nuclei (e.g., 6-nitro-1-isoquinoline, 3,4-dihydro-l-isoquinoline, 6-nitro-3-isoquinoline)), imidazo[4,5-b]quinoxaline nuclei (e.g., 1,3-diethylimidazo[4,5-b]quinoxazoline, 6-chloro-l,3-diallylimidazo[4,5-b]quinoxazoline), oxadiazole nuclei, thiadiazole nuclei, tetrazole nuclei, and pyrimidine nuclei.

In the preceding description, the alkyl group moiety is preferably an unsubstituted alkyl group having from 1 to 8 carbon atoms such as a methyl, ethyl, propyl, isopropyl or butyl group, or a hydroxyalkyl group such as a 2-hydroxyethyl or 3-hydroxypropyl group; it is especially preferably a methyl or ethyl group; and the aryl group moiety is preferably a phenyl group, a halogen-substituted phenyl group such as a chloro-substituted phenyl group, an alkyl-substituted phenyl group such as a methyl-substituted phenyl group, or an alkoxy-substituted phenyl group such as a methoxy-substituted phenyl group.

In formula (XI), both $Z_{11}$ and $Z_{12}$ must not be oxazole nuclei or imidazole nuclei when $n_{12}$ is 1.

Preferred examples of the nuclei to be formed by $Z_{11}$, $Z_{12}$, $Z_{13}$, $Z_{14}$ or $Z_{16}$ are benzothiazole nuclei, naphthothiazole nuclei, benzoxazole nuclei, naphthoxazole nuclei, benzimidazole nuclei, 2-quinoline nuclei and 4-quinoline nuclei.

D and D' each represents a group of atoms necessary for forming an acidic nucleus, which may have any form of acidic nuclei of ordinary merocyanine dyes. The acidic nucleus as referred to herein is, for example, one as defined by T. H. James, *The Theory of the Photographic Process,* 4th ed., page 198 (published by Macmillan Co., 1977). As preferred embodiments, the substituent contributing to the resonance of D includes, for example, a carbonyl group, a cyano group, a sulfonyl group or a sulfinyl group. D' represents the remaining group of atoms necessary for forming the acidic nucleus.

Specifical examples of acidic nuclei are those described in U.S. Pat. Nos. 3,567,719, 3,575,869, 3,804,634, 3,837,862, 4,002,480, 4,925,777, and JP-A-3-167546.

Where the acidic nucleus is non-cyclic, the end group of the methine bond is malononitrile, alkanesulfonylacetonitrile, cyanomethyl benzofuranyl ketone, or cyanomethyl phenyl ketone.

Where D and D' form a cyclic group, they form a 5-membered or 6-membered heterocyclic ring including carbon, nitrogen or chalcogen (typically, oxygen, sulfur, selenium and tellurium) atoms.

Preferred acidic nuclei include 2-pyrazolin-5-one, pyrazolidine-3,5-dione, imidazolin-5-one, hydantoin, 2- or 4-thiohydantoin, 2-iminoxazolidin-4-one, 2-oxazolin-5-one, 2-thioxazolidine-2,4-dione, isoxazolin-5-one, 2-thiazolin-4-one, thiazolidin-4-one, thiazolidine-2,4-dione, rhodanine, thiazolidine-2,4-dione, isorhodanine, indane-1,3-dione, thiophen-3-one, thiophen-3-one-1,1-dioxide, indolin-2-one, indolin-3-one, indazolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,4-dione, barbituric acid, 2-thiobarbituric acid, chroman-2,4-dione, indazolin-2-one, and pyrido[1,2-a]pyrimidine-l,3-dione.

More preferred are 3-alkylrhodanines, 3-alkyl-2-thioxazolidine-2,4-diones and 3-alkyl-2-thiohydantoins.

As the substituent to be bonded, if any, to the nitrogen atom constituting the preceding nuclei and also as $R_{15}$, preferred groups include, for example, a hydrogen atom, an alkyl group having from 1 to 18, preferably from 1 to 7, more preferably from 1 to 4 carbon atoms (e.g., methyl, ethyl, propyl, isopropyl, butyl, isobutyl, pentyl, hexyl, octyl, dodecyl, octadecyl), a substituted alkyl group (such as an aralkyl group (e.g., benzyl, 2-phenylethyl a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfatoalkyl group (e.g., 3-sulfatopropyl, 4-sulfatobutyl), a heteroring-substituted alkyl group (e.g., 2-(pyrrolidin-2-on-1-yl)ethyl, tetrahydrofurfuryl, 2-morpholinoethyl), 2-acetoxyethyl, carbomethoxymethyl, 2-methanesulfonylaminoethyl), an allyl group, an aryl group (e.g., phenyl, 2-naphthyl), a substituted aryl group (e.g., 4-carboxyphenyl, 4-sulfophenyl, 3-chlorophenyl, 3-methylphenyl), and a heterocyclic group (e.g., 2-pyridyl, 2-thiazolyl).

More preferred are an unsubstituted alkyl group (e.g., methyl, ethyl, n-propyl, n-butyl, n-pentyl, n-hexyl), a carboxyalkyl group (e.g., carboxymethyl, 2-carboxyethyl), and a sulfoalkyl group (e.g., 2-sulfoethyl).

The 5-membered or 6-membered nitrogen-containing hetero ring to be formed by $Z_{15}$ is derived from a cyclic hetero ring, such as the ring to be formed by D and D', by removing the oxo group or thioxo group therefrom. The group of atoms represented by $Z_{15}$ is more preferably a group derived from a rhodanine nucleus by removing the thioxo group therefrom.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$ and $L_{30}$ each represents a methine group or a substituted methine group. The substituted methine group is, for example, a methine groups substituted by one or more substituents selected from a substituted or unsubstituted alkyl group (e.g., methyl, ethyl, 2-carboxyethyl), a substituted or unsubstituted aryl group (e.g., phenyl, o-carboxyphenyl), a heterocyclic group (e.g., barbituric acid), a halogen atom (e.g., chlorine, bromine), an alkoxy group (e.g., methoxy, ethoxy), an amino group (e.g., N,N-diphenylamino, N-methyl-N--phenylamino, N-methylpiperazino), and an alkylthio group (e.g., methylthio, ethylthio). Each of $L_{11}$ to $L_{30}$ may form a ring along with one or more other methine groups, or each of $L_{11}$ to $L_{30}$ may also form a ring along with one or more auxochromic groups (such as a basic nucleus or an acidic nucleus of the end of the dye).

Preferably, $L_{11}$, $L_{12}$, $L_{16}$, $L_{17}$, $L_{18}$, $L_{19}$, $L_{22}$, $L_{23}$, $L_{29}$ and $L_{30}$ are unsubstituted methine groups.

$L_{13}$, $L_{14}$ and $L_{15}$ form a trimethine, pentamethine or heptamethine dye. Where $n_{12}$ is 2 or 3, the unit composed of $L_{13}$ and $L_{14}$ is repeated in the dye molecule but the repeated units need not be the same.

Preferred examples of $L_{13}$, $L_{14}$ and $L_{15}$ are given below.

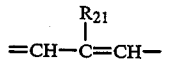

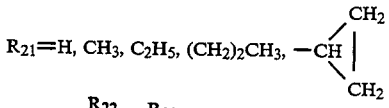

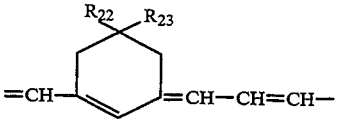

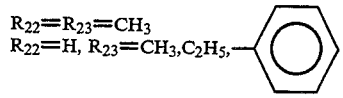

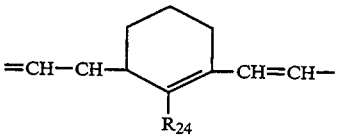

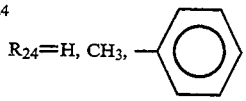

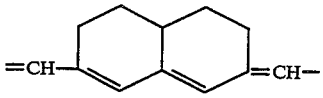

$L_{20}$ and $L_{21}$ form a tetramethine or hexamethine dye. The unit composed of $L_{20}$ and $L_{21}$ is repeated in the dye molecule, but the repeated units need not be the same.

Preferred examples of $L_{20}$ and $L_{21}$ are given below.

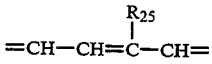

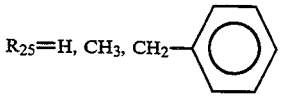

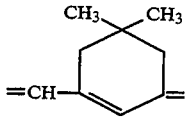

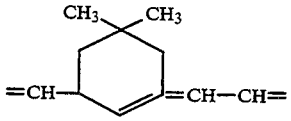

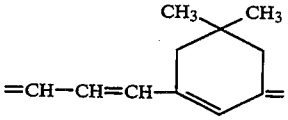

-continued

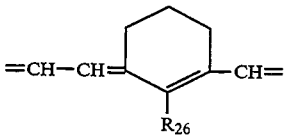

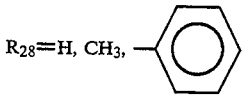

$L_{24}$ and $L_{25}$ form a dimethine, tetramethine or hexamethine. Where $n_{17}$ is 2 or more, the unit composed of $L_{24}$ and $L_{25}$ is repeated in the dye molecule, but the repeated units need not be the same.

Preferred examples of $L_{24}$ and $L_{25}$ are given below.

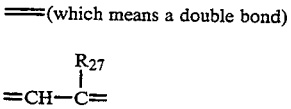

$R_{27}$=H, $CH_3$, $C_2H_5$

Where $n_{17}$ is 2 or more, it is especially preferred that $L_{20}$ and $L_{21}$ each represents one of the preferred examples of $L_{20}$ and $L_{21}$ given above.

$L_{26}$, $L_{27}$ and $L_{28}$ form a monomethine, trimethine or pentamethine. Where $n_{18}$ is 2 or more, the unit composed of $L_{26}$ and $L_{27}$ is repeated in the dye molecule, but the repeated units need not be the same.

Preferred examples of $L_{26}$, $L_{27}$ and $L_{28}$ are given below.

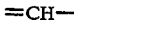

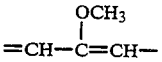

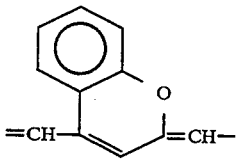

In addition, preferred examples of $L_{26}$, $L_{27}$ and $L_{28}$ include the preferred groups previously mentioned for $L_{13}$, $L_{14}$ and $L_{15}$.

Of the compounds of formula (XI), those of the following formula (XIV) are especially preferred:

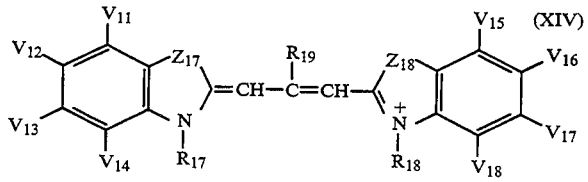

(XIV)

$M_{14}m_{14}$ wherein $Z_{17}$ and $Z_{18}$ each represents a sulfur atom or a selenium atom;

$R_{17}$ and $R_{18}$ each represents an alkyl group; $R_{19}$, $V_{11}$, $V_{12}$, $V_{13}$, $V_{14}$, $V_{15}$, $V_{16}$, $V_{17}$ and $V_{18}$ each represents a hydrogen atom or a monovalent substituent; and $M_{14}$ represents a charge-neutralizing pair ion; and $m_{14}$ represents a number of 0 or more necessary for neutralizing the molecular charge.

The compounds of formula (XIV) are described in more detail below.

Preferred examples of $R_{17}$ and $R_{18}$ include the preferred $R_{11}$, $R_{12}$, $R_{13}$, $R_{14}$ and $R_{15}$ groups described previously.

The substituents of $R_{19}$, $V_{11}$, $V_{12}$, $V_{13}$, $V_{14}$, $V_{15}$, $V_{16}$, $V_{17}$ and $V_{18}$ are not specifically limited. Preferred examples of such substituents include the groups included in the definition of V given previously.

Any two of $V_{11}$, $V_{12}$, $V_{13}$, $V_{14}$, $V_{15}$, $V_{16}$, $V_{17}$ and $V_{18}$, which are bonded to adjacent carbon atoms may together form a condensed ring.

Examples of the condensed ring which may be formed include benzene rings and hetero rings (e.g., pyrrole, thiophene, furan, pyridine, imidazole, triazole, thiazole).

Preferably, $R_{19}$ is a methyl, ethyl, propyl or cyclopropyl group; and more preferably $R_{19}$ is an ethyl group.

$V_{11}$, $V_{12}$, $V_{14}$, $V_{15}$, $V_{16}$ and $V_{18}$ are preferably hydrogen atoms.

$V_{13}$ and $V_{17}$ each are preferably a chlorine atom, or a methyl, methoxy, phenyl or carboxyl group.

$V_{13}$ and $V_{14}$, or $V_{17}$ and $V_{18}$, are preferably bonded to each other to form a benzene ring.

$M_{14}m_{14}$ has the same meaning as any one of $M_{11}m_{11}$, $M_{12}m_{12}$ and $M_{13}m_{13}$.

Specific examples of sensitizing dyes suitable for use in the present invention are given below as the dyes of groups (A), (B), (C), (D), and (E), which, however, are not limitative.

The term "λmax" and "Eox" as referred to hereunder mean a "spectral sensitivity peak on AgBr (cubic)" and an "oxidation potential (V vsSCE) measured by the above-mentioned method", respectively.

(A) Sensitizing dyes suitable for use in the present invention having an oxidation potential of more than 0.95 (V vsSCE):

(A-1)

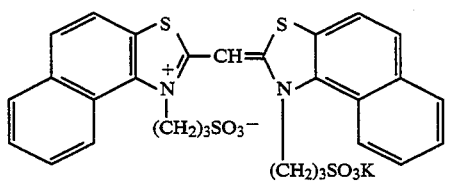

λmax = 490nm
Eox = 1.16

(A-2)

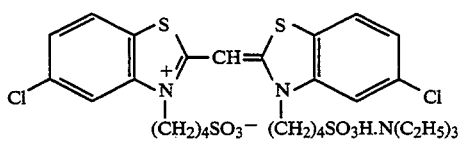

λmax = 470nm
Eox = 1.29

(A-3)

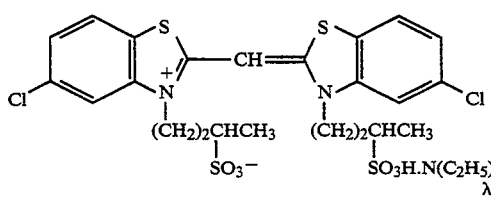

λmax = 471nm
Eox = 1.30

(A-4)

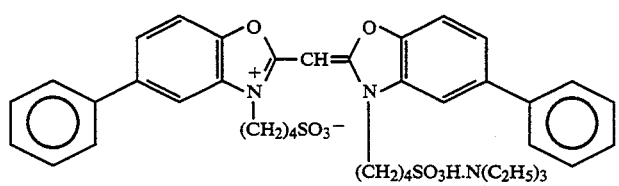

λmax = 417nm
Eox = 1.40

(A-5)

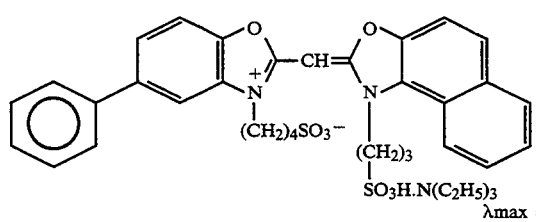

λmax = 423nm
Eox = 1.52

-continued
(A-6)
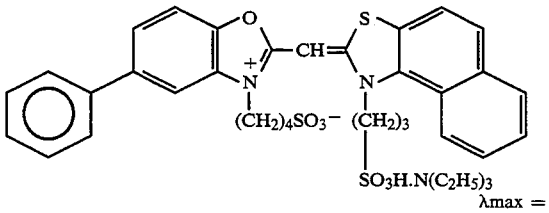
λmax = 455nm
Eox = 1.15
(A-7)
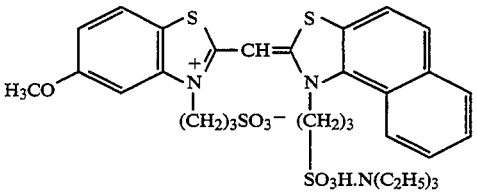
λmax = 482nm
Eox = 1.1
(A-8)
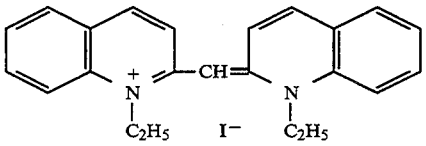
λmax = 578nm
Eox = 1.07
(A-9)
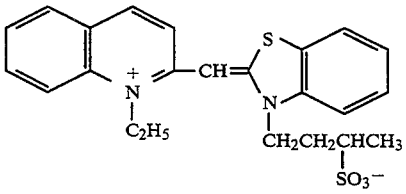
λmax = 531nm
Eox = 1.3
(A-10)
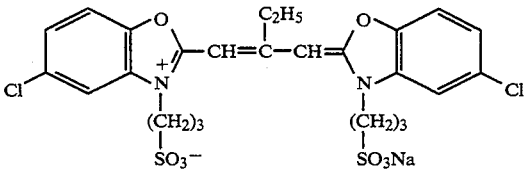
λmax = 553nm
Eox = 1.00
(A-11)
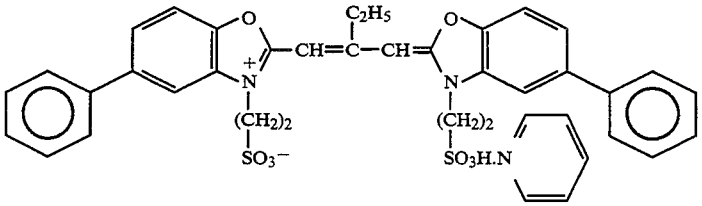
λmax = 548nm
Eox = 0.96
(A-12)
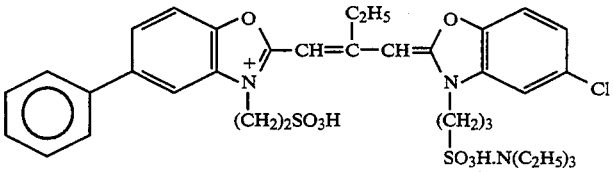
λmax = 553nm
Eox = 0.951

-continued
(A-13)
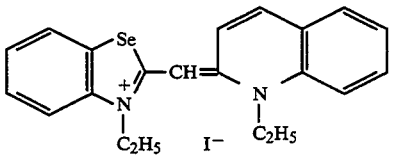
λmax = 530nm
Eox = 1.28
(A-14)
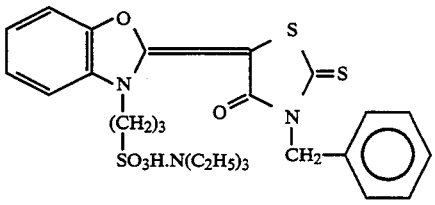
λmax = 410nm
Eox = 0.98
(A-15)
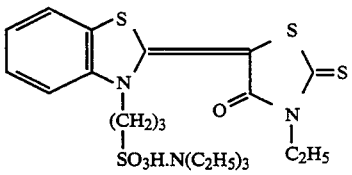
λmax = 432nm
Eox = 0.96
(A-16)
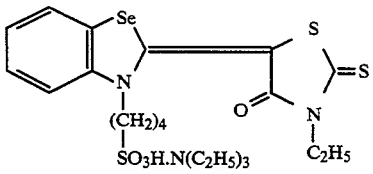
λmax = 450nm
Eox = 0.96
(A-17)
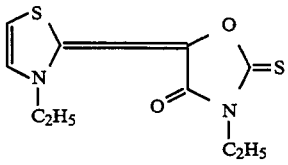
λmax = 410nm
Eox = 1.02
(A-18)
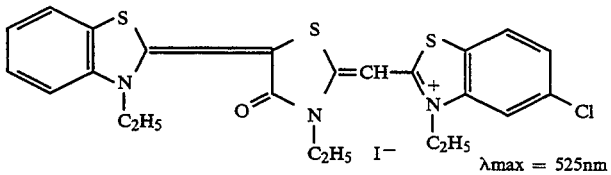
λmax = 525nm
Eox = 1.0
(A-19)
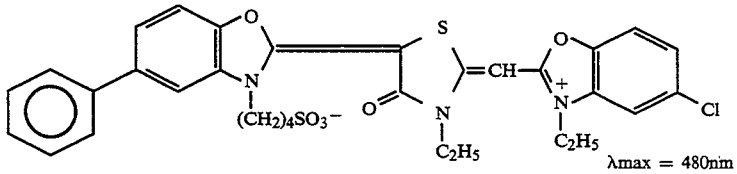
λmax = 480nm
Eox = 1.15
(B) Sensitizing dyes suitable for use in the present invention having an oxidation potential of 0.95 (V vsSCE) or less and having a spectral sensitivity peak at less than 600 nm:

(B-1)
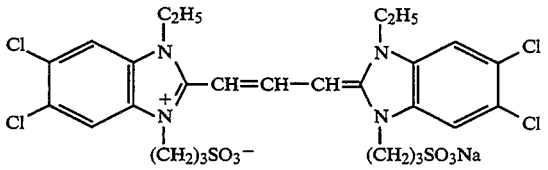
λmax = 570 nm
Eox = 0.44
(B-2)
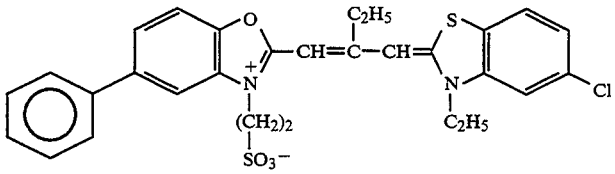
λmax = 595 nm
Eox = 0.91
(B-3)
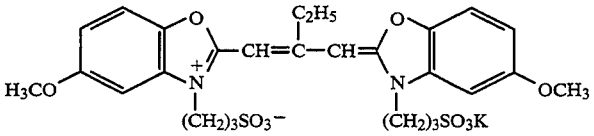
λmax = 565 nm
Eox = 0.8
(B-4)
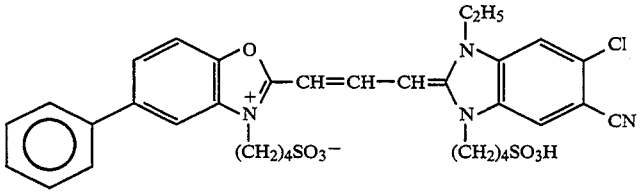
λmax = 555 nm
Eox = 0.93
(B-5)
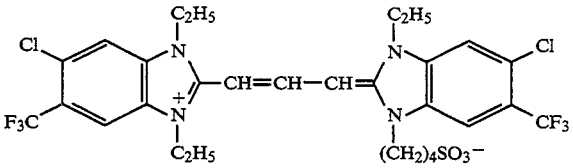
λmax = 565 nm
Eox = 0.625
(B-6)
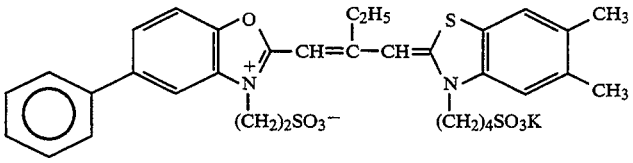
λmax = 590 nm
Eox = 0.75
(B-7)
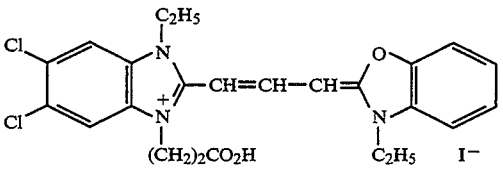
λmax = 545 nm
Eox = 0.87
(B-8)
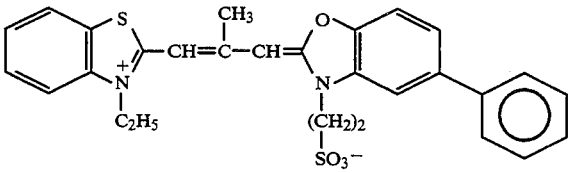
λmax = 565 nm
Eox = 0.94
(B-9)
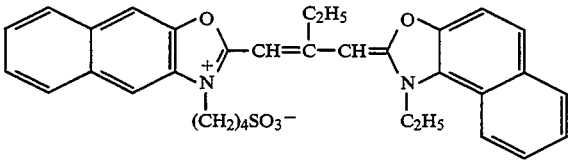
λmax = 570 nm
Eox = 0.9

-continued (B-10)

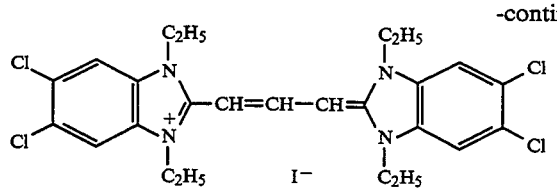

λmax = 568 nm
Eox = 0.53

(B-11)

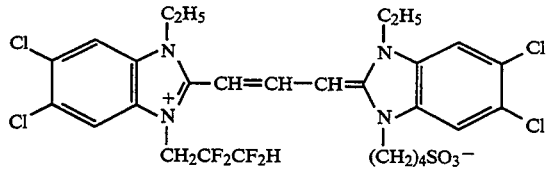

λmax = 570 nm
Eox = 0.6

(B-12)

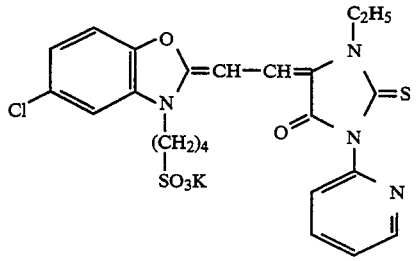

λmax = 500 nm
Eox = 0.8

(B-13)

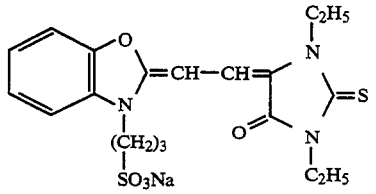

λmax = 505 nm
Eox = 0.78

(B-14)

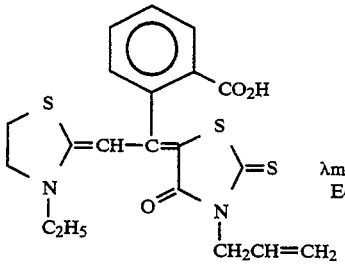

λmax = 480 nm
Eox = 0.82

(B-15)

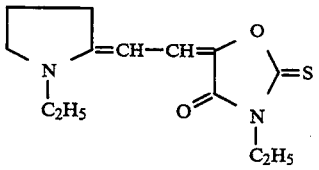

λmax = 460 nm
Eox = 0.85

(B-16)

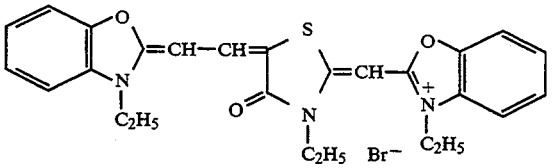

λmax = 560 nm
Eox = 0.94

(B-17)

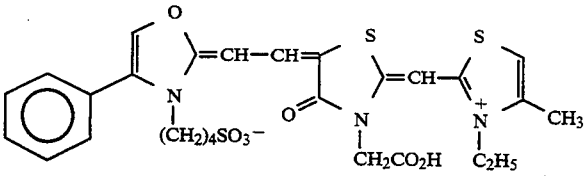

λmax = 550 nm
Eox = 0.9

(C) Sensitizing dyes suitable for use in the present invention having an oxidation potential of 0.95 (V VSSCE or less and having a spectral sensitivity perk at 600 nm or more, provided that the examples of the dyes are outside the scope of the dyes represented by formular (XI), (XII) and (XIII):

(C-1)

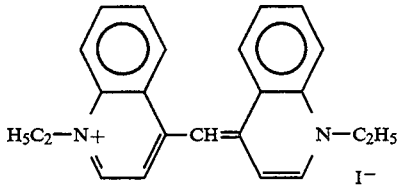

λmax = 610 nm
Eox = 0.7

(C-2)

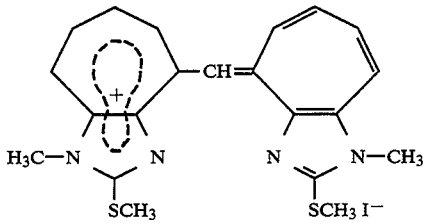

λmax = 780 nm
Eox = 0.9

(C-3)

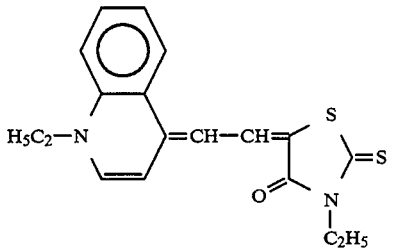

λmax = 660 nm
Eox = 0.5 V

-continued (C-4)

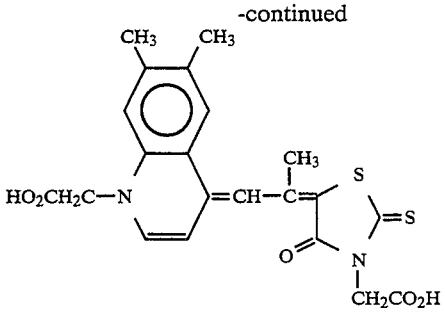

λmax = 660 nm
Eox = 0.47

(C-5)

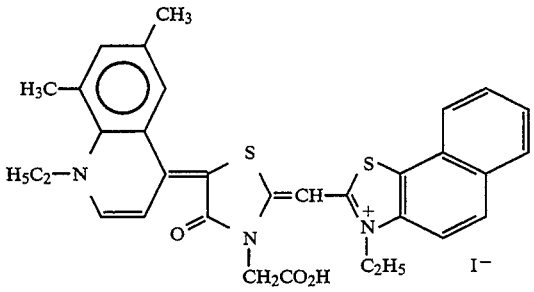

λmax = 610 nm
Eox = 0.85

(D) Sensitizing dyes satisfying the same conditions relating to oxidation potential and spectral sensitivity peak as the dyes of groups (C) immediately above and represented by formulae (XI), (XII) and (XIII), provided the examples of the dyes are outside the scope of the dyes represented by formula (XIV).

(D-1) Sensitizing dyes of formula (XI):

(XI-1)

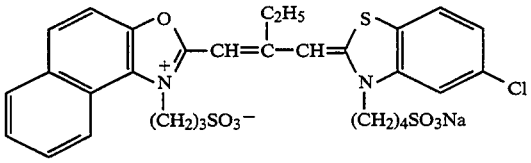

λmax = 613 nm
Eox = 0.86

(XI-2)

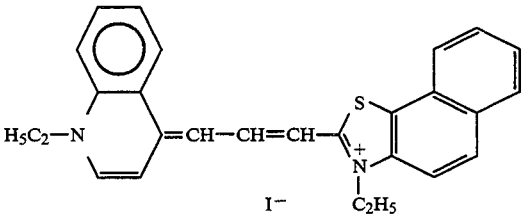

λmax = 680 nm
Eox = 0.5

(XI-3)

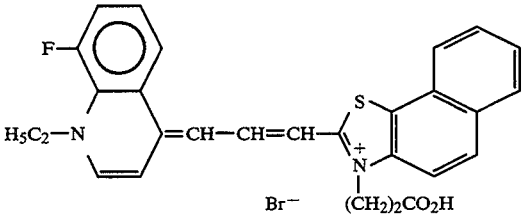

λmax = 675 nm
Eox = 0.55

-continued
(XI-4)
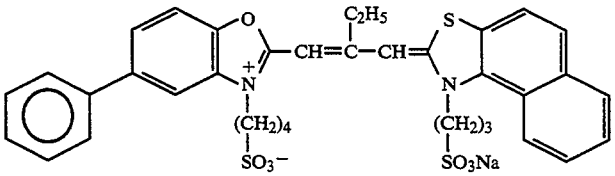
λmax = 605 nm
Eox = 0.94
(XI-5)
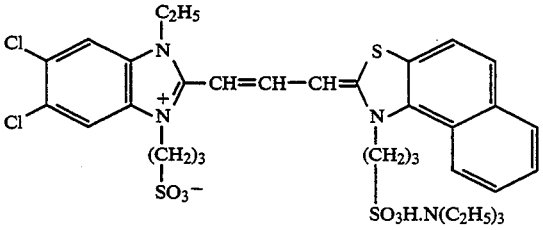
λmax = 620 nm
Eox = 0.6
(XI-6)
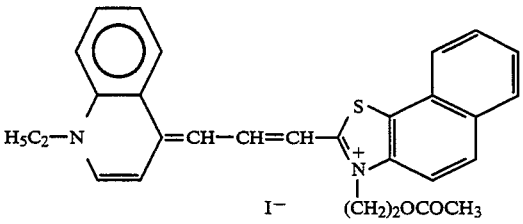
λmax = 680 nm
Eox = 0.72
(XI-7)
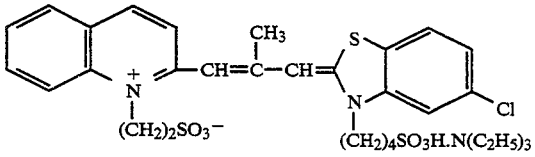
λmax = 710 nm
Eox = 0.78
(XI-8)
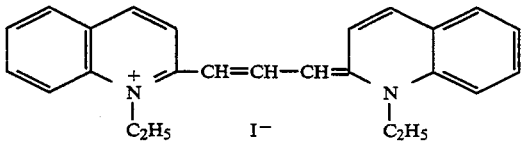
λmax = 650 nm
Eox = 0.5
(XI-9)
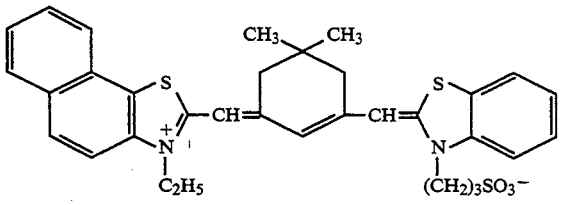
λmax = 640 nm
Eox = 0.85
(XI-10)
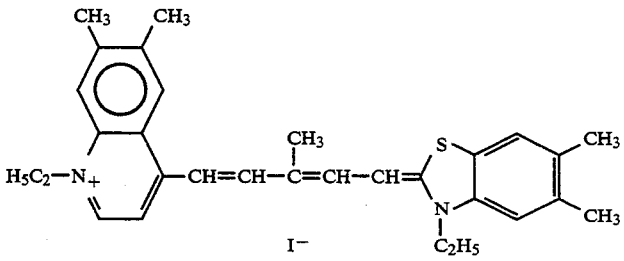
λmax = 770 nm
Eox = 0.38
(XI-11)
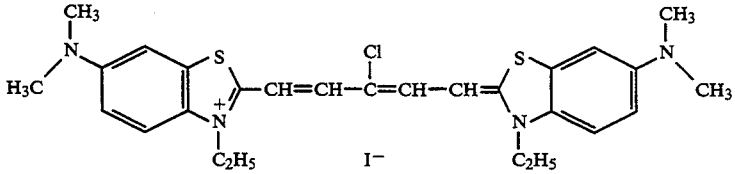
λmax = 750 nm
Eox = 0.4

-continued
(XI-12)
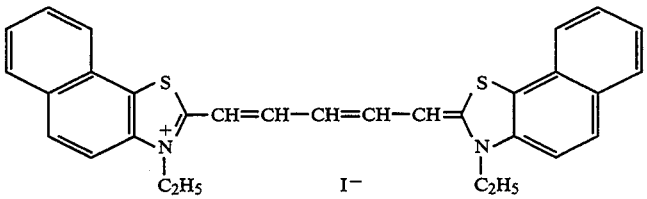
λmax = 740 nm
Eox = 0.5
(XI-13)
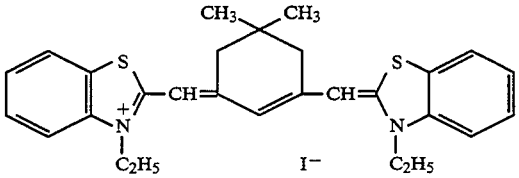
λmax = 696 nm
Eox = 0.58
(XI-14)
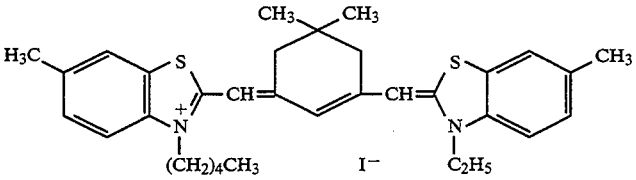
λmax = 690 nm
Eox = 0.53
(XI-15)
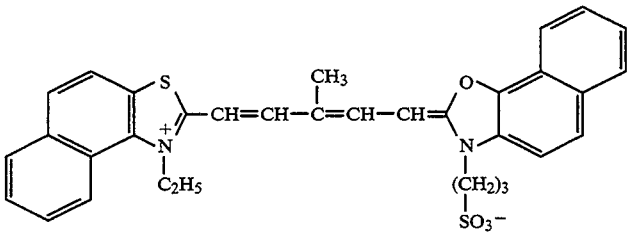
λmax = 670 nm
Eox = 0.59
(XI-16)
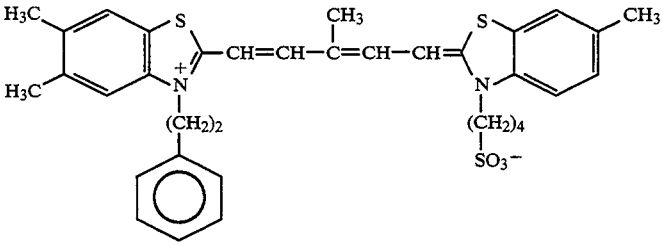
λmax = 704 nm
Eox = 0.53
(XI-17)
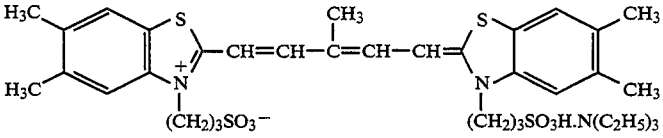
λmax = 708 nm
Eox = 0.52
(XI-18)
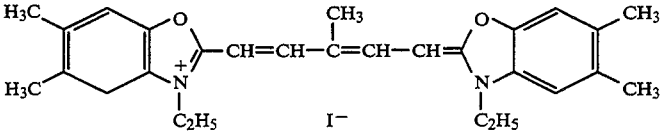
λmax = 650 nm
Eox = 0.65
(XI-19)
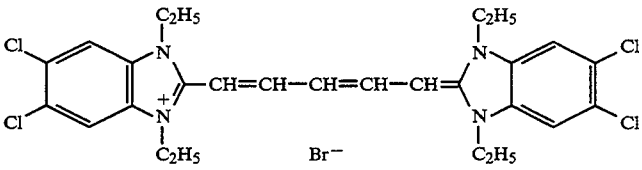
λmax = 650 nm
Eox = 0.28

-continued
(XI-20)
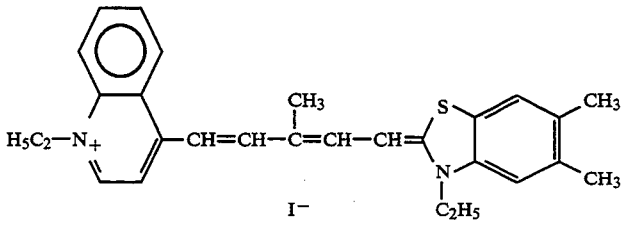
λmax = 780 nm
Eox = 0.39
(XI-21)
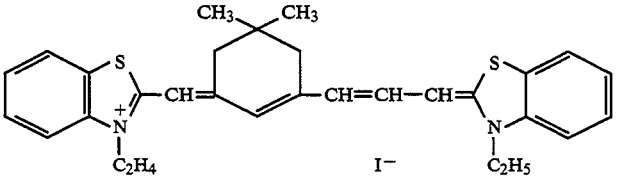
λmax = 810 nm
Eox = 0.35
(XI-22)
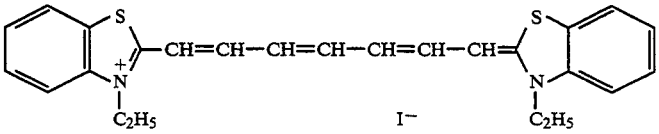
λmax = 820 nm
Eox = 0.38
(XI-23)
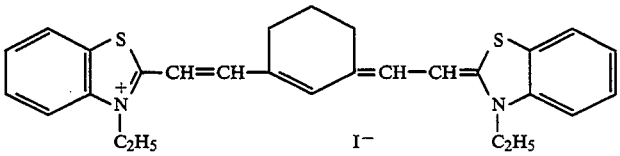
λmax = 810 nm
Eox = 0.34
(XI-24)
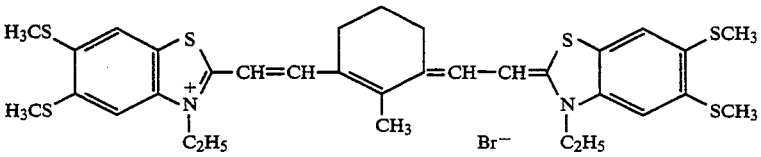
λmax = 840 nm
Exo = 0.33
(XI-25)
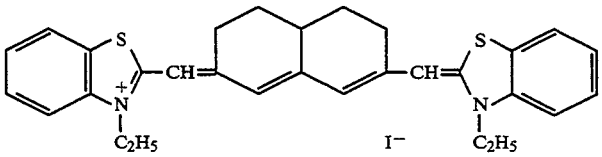
λmax = 790 nm
Eox = 0.36
(XI-26)
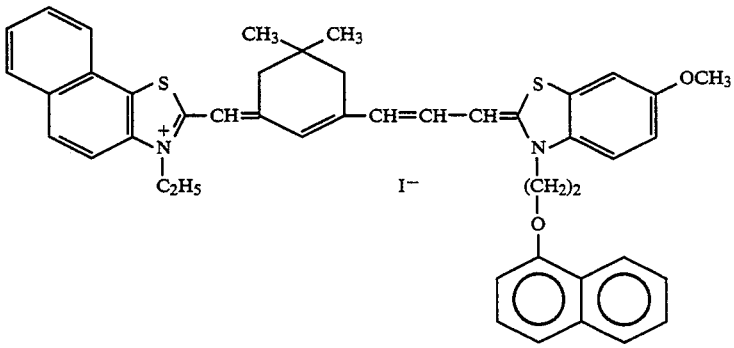
λmax = 840 nm
Eox = 0.28
(D-2) Sensitizing dyes of formula (XII):

(XII-1)
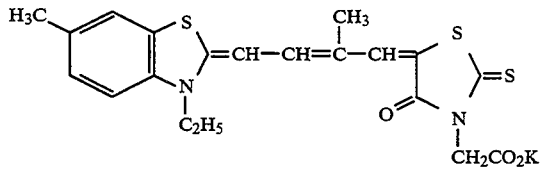
λmax = 680 nm
Eox = 0.42
(XII-2)
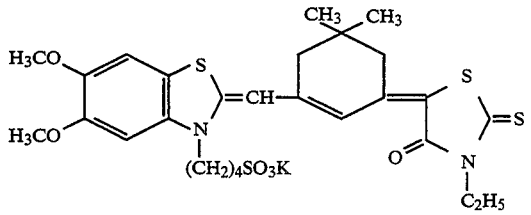
λmax = 690 nm
Eox = 0.43
(XII-3)
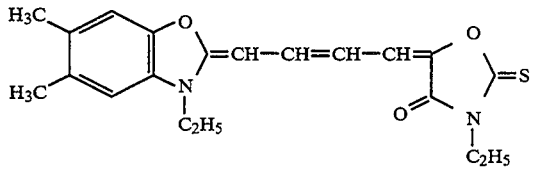
λmax = 630 nm
Eox = 0.5
(XII-4)
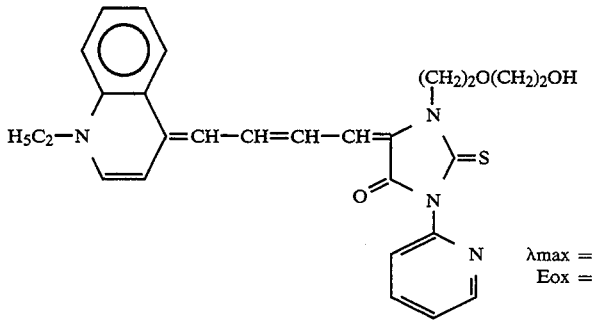
λmax = 710 nm
Eox = 0.39
(XII-5)
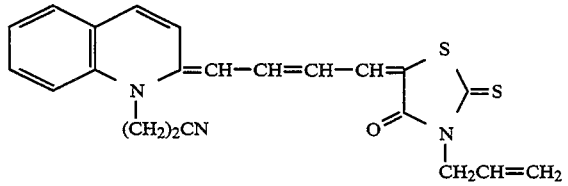
λmax = 730 nm
Eox = 0.4
(XII-6)
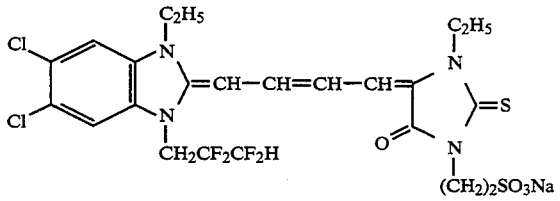
λmax = 650 nm
Eox = 0.2
(XII-7)
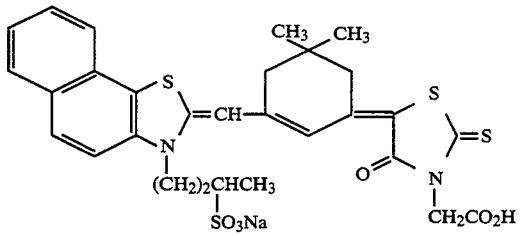
λmax = 695 nm
Eox = 0.45

-continued
(XII-8)
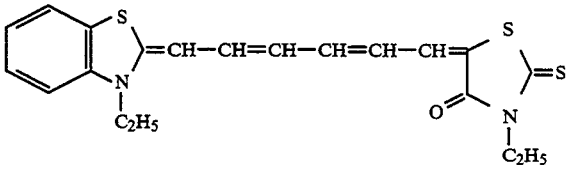
λmax = 805 nm
Eox = 0.25
(XII-9
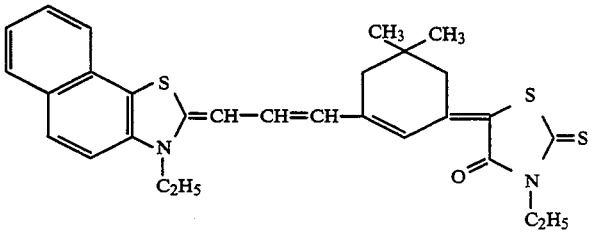
λmax = 820 nm
Eox = 0.25
(XII-10)
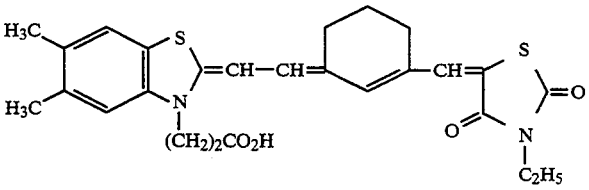
λmax = 800 nm
Eox = 0.23
(D-3) Sensitizing dyes of formula (XIII):
(XIII-1)
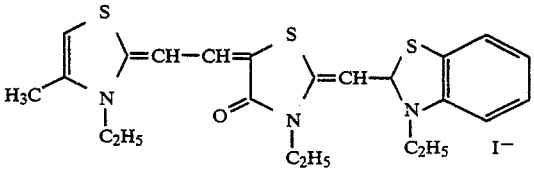
λmax = 642 nm
Eox = 0.47
(XIII-2)
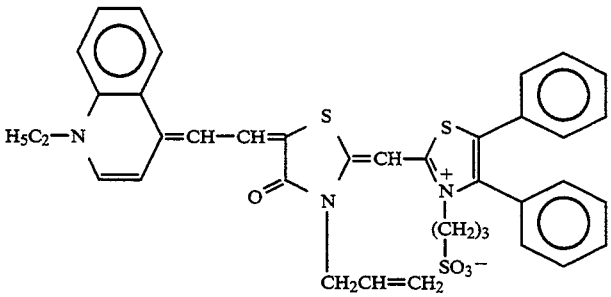
λmax = 705 nm
Eox = 0.6
(XIII-3)
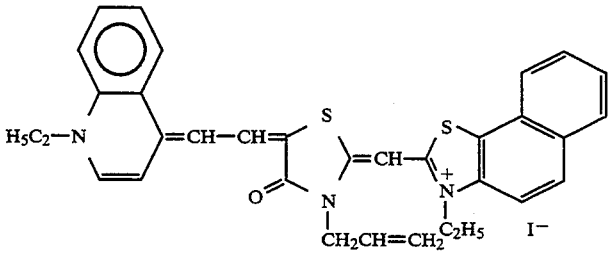
λmax = 715 nm
Eox = 0.55

-continued
(XIII-4)
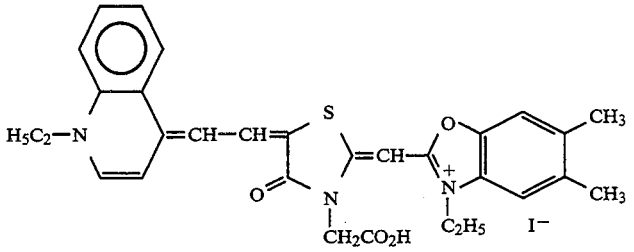
λmax = 698 nm
Eox = 0.63
(XIII-5)
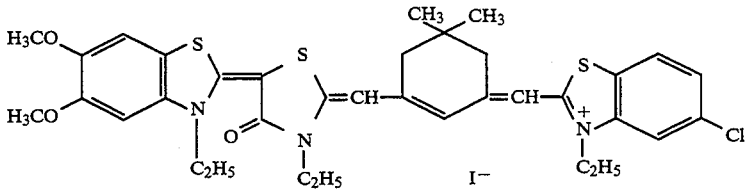
λmax = 720 nm
Eox = 0.4
(XIII-6)
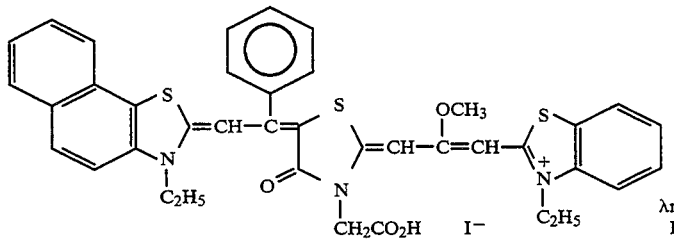
λmax = 740 nm
Eox = 0.43
(XIII-7)
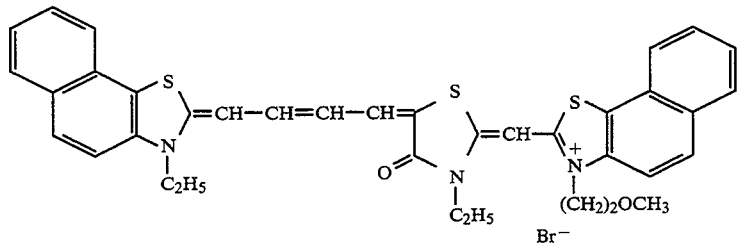
λmax = 750 nm
Eox = 0.47
(XIII-8)
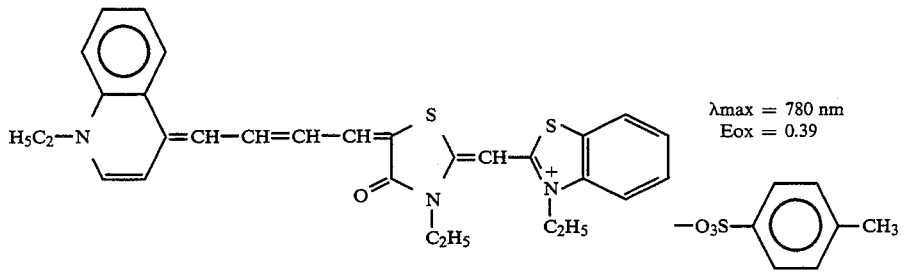
λmax = 780 nm
Eox = 0.39
(E) Sensitizing dyes satisfying the same conditions relating to oxidation potential and spectral sensitivity peak as the dyes of group (C) above and represented by formula (XIV):
(XIV-1)
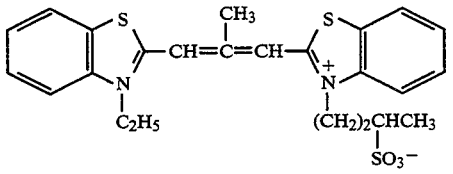
λmax = 605nm
Eox = 0.93

-continued
(XIV-2)
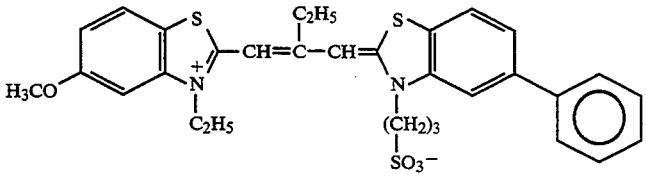
λmax = 665 nm
Eox = 0.89
(XIV-3)
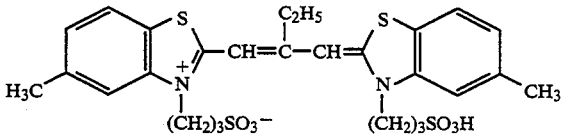
λmax = 654 nm
Eox = 0.82
(XIV-4)
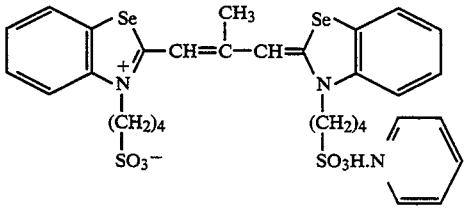
λmax = 630 nm
Eox = 0.945
(XIV-5)
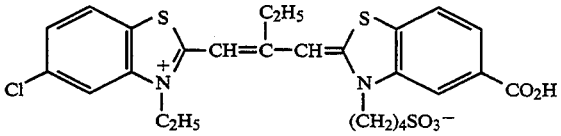
λmax = 649 nm
Eox = 0.86
(XIV-6)
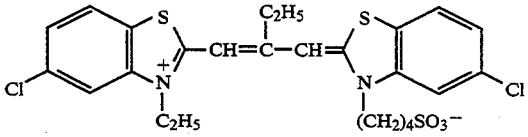
λmax = 650 nm
Eox = 0.91
(XIV-7)
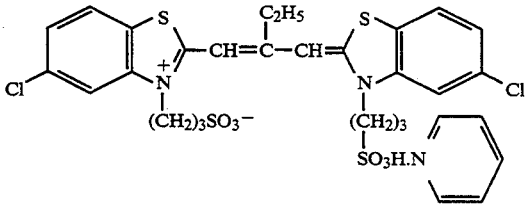
λmax = 654 nm
Eox = 0.91
(XIV-8)
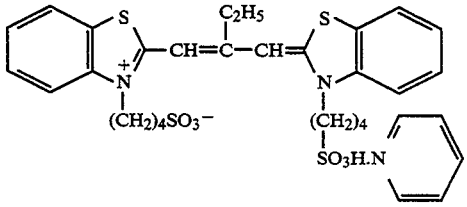
λmax = 600nm
Eox = 0.86
(XIV-9)
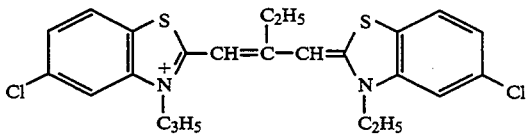
λmax = 639 nm
Eox = 0.915
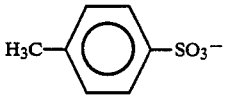

-continued
(XIV-10)
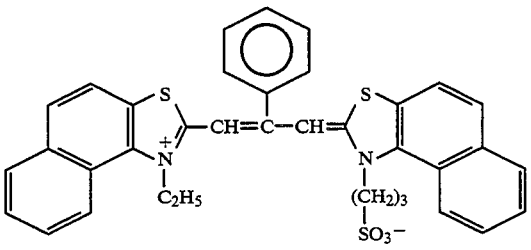
λmax = 650 nm
Eox = 0.89
(XIV-11)
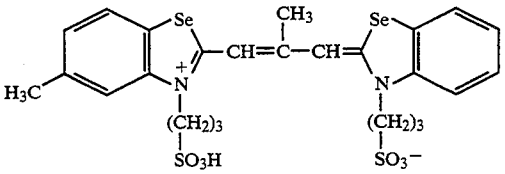
λmax = 640 nm
Eox = 0.9
(XIV-12)
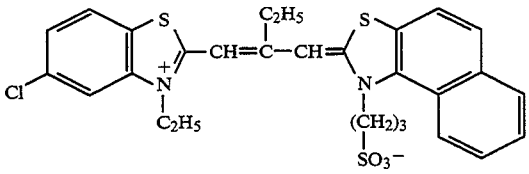
λmax = 660 nm
Eox = 0.9
(XIV-13)
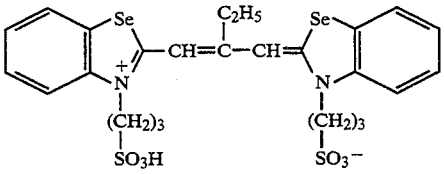
λmax = 600 nm
Eox = 0.91
(XIV-14)
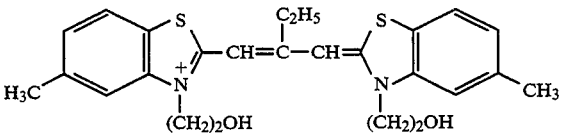
λmax = 650 nm
Eox = 0.86
(XIV-15)
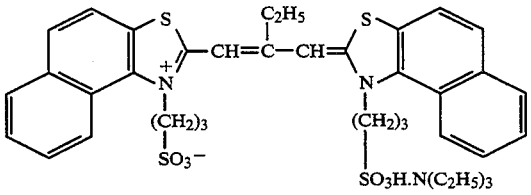
λmax = 670 nm
Eox = 0.7
(XIV-16)
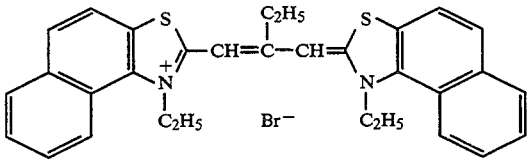
λmax = 658 nm
Eox = 0.7
(XIV-17)
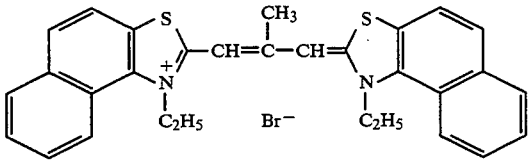
λmax = 640 nm
Eox = 0.71

-continued (XIV-18)

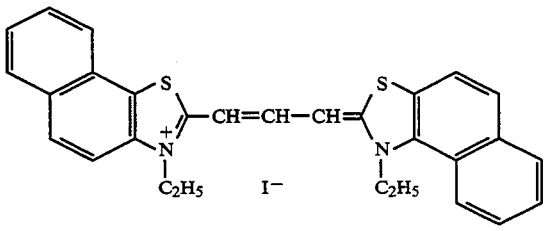

λmax = 610 nm
Eox = 0.75

(XIV-19)

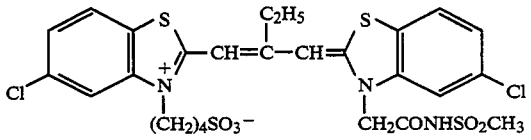

λmax = 660 nm
Eox = 0.9

(XIV-20)

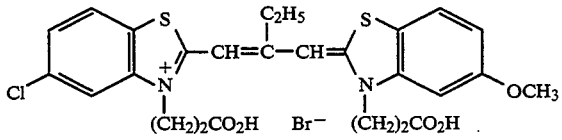

λmax = 645 nm
Eox = 0.88

(XIV-21)

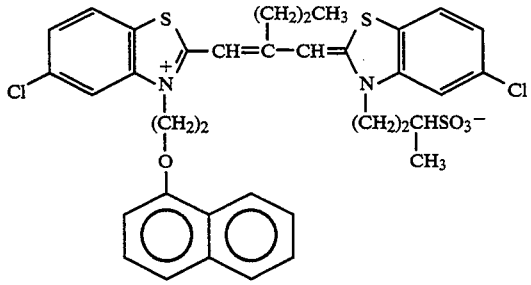

λmax = 650 nm
Eox = 0.91

(XIV-22)

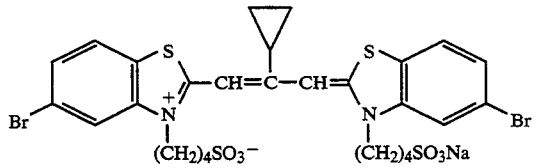

λmax = 660 nm
Eox = 0.89

The sensitizing dyes for use in the present invention can be produced in accordance with the methods described in, for example, F. M. Hamer, *Heterocyclic Compounds—Cyanine Dyes and Related Compounds* (published by John Wiley & Sons Co., New York, London, 1964); D. M Sturmer, *Heterocyclic Compounds—Special Topics in Heterocyclic Chemistry,* Chap. 18, Part 14, pp. 482–515 (published by John Wiley & Sons Co., New York, London, 1977); *Rodd's Chemistry of Carbon Compounds,* 2nd ed., Vol. IV, Part B (published by Elsvier Science Publishing Company Inc., New York, 1977), Chap. 15, pp. 369–422; and ibid., 2nd ed., Vol. IV, Part B (1985), Chap. 15, pp. 267–296.

To incorporate the compounds of formulae (i), (II), (III) and (IV) and the sensitizing dyes mentioned above into the silver halide emulsions of the photographic materials of the present invention, the respective compounds and dyes may be directly dispersed in the emulsions, or alternatively, they may previously be dissolved in a single solvent or a mixed solvent including at least two of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and/or N,N-dimethylformamide, formamide, and the resulting solution may be added to the emulsions.

Further employable are a method of dissolving the dyes or the compounds of formulae (I) to (IV) in a volatile organic solvent followed by dispersing the resulting solution in water or in a hydrophilic colloid and adding the resulting dispersion into the emulsion, as described in U.S. Pat. No. 3,469,987; a method of dispersing a water-insoluble dye or the compounds of formulae (I) to (IV) in a water-soluble solvent, without dissolving it, followed by adding the resulting dispersion to the emulsion, as described in JP-B-46-24185; a method of dissolving the dye or the compounds of formulae (I) to (IV) in an acid followed by adding the resulting solution to the emulsion, or dissolving the dye or the compounds of formulae (I) to (IV) in a mixture of an acid or a base to give an aqueous solution followed by adding the aqueous solution to the emulsion, as described in JP-B-44-23389, JP-B-44-27555 and JP-B-57-22091; a method of forming an aqueous solution or colloidal dispersion of the dye or compounds of formulae (I) to (IV) in the presence of a surfactant followed by adding the resulting solution or dispersion to the emulsion, as described in U.S. Pat. Nos. 3,822,135 and 4,006,026; a method of directly dispersing the dye or the compounds of formulae (I) to (IV) in a hydrophilic colloid followed by adding the resulting dispersion to the emulsion, as described in JP-A-53-102733 and JP-A-58-105141; and a method of dissolving the dye or the compounds of formulae (I) to (IV) along with a red-shifting compound followed by adding the resulting solution into the emulsion, as described in JP-A-51-74624.

If desired, ultrasonic waves may be employed in dissolving the dyes or the compounds of formulae (I) to (IV).

The time of adding the preceding sensitizing dyes or the compounds of formulae (I) to (IV) into the silver halide emulsions of the photographic materials of the present invention is not specifically limited and may be any time during production of the emulsions which has heretofore been recognized as useful. For instance, they may be added during the step of forming silver halide grains and/or before the step of de-salting the grains, or during the de-salting step and/or during the period after de-salting of the grains and before initiation of chemical ripening of them, as disclosed in U.S. Pat. Nos. 2,735,766, 3,268,960, 4,183,756 and 4,225,666, JP-A-58-184142, and JP-A-60-196749; or they may be added at any time before coating of the emulsion or in the period just before or during chemical ripening of the emulsion grains or in the period after chemical ripening of the grains and before coating of the emulsion, as disclosed in JP-A-58-113920. If desired, in accordance with the disclosures of U.S. Pat. No. 4,225,666 and JP-A-58-7629, a single compound or combination of plural compounds each having a different structure may be divided into plural parts and the divided parts may be added separately to the emulsions during the step of forming the grains or during or after the step of chemical ripening of the grains, or the dividual parts may be added separately to the grains before or after the step of chemical ripening of the grains, whereupon the kind of the single compound to be added as well as the kinds of the compounds to be combined for addition may be varied.

The amount of the sensitizing dye to be added to the emulsions of the photographic material of the present invention may vary, depending upon the shape and the size of the silver halide grains in the emulsions. Preferably, the amount is from $4\times10^{-8}$ to $8\times10^{-2}$ mol, more preferably from $4\times10^{-6}$ to $8\times10^{-3}$ mol, per mol of silver halide.

The time of adding the compound of formulae (I), (II), (III) and (IV) of the present invention to the emulsions is not specifically defined and may be any time before or after addition of sensitizing dyes thereto. The amount of the compound to be added is preferably from $1\times10^{-6}$ to $5\times10^{-1}$ mol, more preferably from $1\times10^{-5}$ to $2\times10^{-2}$ mol, especially preferably from $1\times10^{-4}$ to $1.6\times10^{-2}$ mol, per mol of silver halide.

The molar ratio of the sensitizing dye to the compound of formulae (I), (II), (III) and (IV) is also not specifically limited. Advantageously, the molar ratio is within the range of from 10/1 to 1/1000, especially preferably from 1/1 to 1/100, as sensitizing dye/compound of (I), (II), (III) or (IV).

The silver halide grains of the photographic emulsions of the photographic material of the present invention are not specifically limited with respect to the composition, crystal phase and size of them, and any known ones may be employed. Preferred examples of suitable grains are described in JP-A-2-269334, from page 19, right top column, line 17 to page 20, right top column, line 7.

The silver halide emulsions as prepared in accordance with the present invention may apply to both color photographic materials and black-and-white photographic materials.

As color photographic materials, especially mentioned are color papers, color picture-taking films and color reversal films; and as black-and-white photographic materials, especially mentioned are X-ray films, general picture-taking films and films for printing photographic materials.

Color papers are especially preferred as photographic materials.

The other additives to the photographic materials of the present invention are not specifically limited. For instance, the disclosures of *Research Disclosure,* Vol. 176, Item 17643 (RD 17643, December, 1978) and ibid., Vol. 187, Item 18716 (RD 18716, November, 1979) are referred to.

The relevant disclosures of RD 17643 and RD 18716 mentioning various photographic additives applicable to the present invention are listed in Table 1.

TABLE 1

| Kinds of Additives | RD 17643 | RD 18716 |
|---|---|---|
| 1 Chemical Sensitizer | page 23 | page 648, right column |
| 2 Sensitivity Enhancer | | page 648, right column |
| 3 Color Sensitizer, Super Color Sensitizer | pages 23 to 24 | page 648, right column to page 649, right column |
| 4 Brightening Agent | page 24 | |
| 5 Antifoggant, Stabilizer | pages 24 to 25 | page 649, right column |
| 6 Light Absorbent, Filter Dye, Ultraviolet Absorbent | pages 25 to 26 | page 649, right column to page 650, left column |
| 7 Stain Inhibitor | page 25, right column | page 650, left column to right column |
| 8 Color Image Stabilizer | page 25 | |
| 9 Hardening Agent | page 26 | page 651, left column |
| 10 Binder | page 26 | page 651, right column |
| 11 Plasticizer, Lubricant | page 27 | page 650, right column |
| 12 Coating Aid, Surfactant | pages 26 to 27 | page 650, right column |
| 13 Antistatic Agent | page 27 | page 650, right column |

Dyes other than sensitizing dye suitable for use in the photographic material of the present invention will be described in detail below.

The photographic material of the present invention may contain colloidal silver and other dyes for the purpose of anti-irradiation and anti-halation, and especially for separation of the spectral sensitivity distribution of each light-sensitive layer and for ensuring safety to a safelight.

Such dyes include, for example, oxonole dyes having pyrazolone nuclei, barbituric nuclei or barbituric acid nuclei, such as those described in U.S. Pat. Nos. 506,385, 1,177,429, 1,131,884, 1,338,799, 1,385,371, 1,467,214, 1,438,102 and 1,553,516, JP-A-48-85130, JP-A-49-114420, JP-A-52-117123, JP-A-55-161233, JP-A-59-111640, JP-B-39-22069, JP-B-43-13168, JP-B-62-273527, and U.S. Pat. Nos. 3,247,127, 3,469,985 and 4,078,933; other oxonole dyes, such as those described in U.S. Pat. Nos. 2,533,472 and 3,379,533, British Patent 1,278,621, JP-A-1-134447, and JP-A-1-183652; azo dyes such as those described in British Patents 575,691, 680,631, 599,623, 786,907, 907,125 and 1,045,609, U.S. Pat. No. 4,255,326, and JP-A-59-211043; azomethine dyes such as those described in JP-A-50-100116, JP-A-54-118247 and British Patents 2,014,598 and 750,031; anthraquinone dyes such as those described in U.S. Pat. No. 2,865,752; arylidene dyes such as those described in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286 and JP-B-59-37303; styryl dyes such as those described in JP-B-28-3082, JP-B-44-16594, and JP-B-59-28898; triarylmethane dyes such as those described in British Patents 446,538, and 1,335,422, and JP-A-59-228250; merocyanine dyes such as those described in British Patents 1,075,653, 1,153,341, 1,284,730, 1,475,228 and 1,542,807; and cyanine dyes such as those described in U.S. Pat. Nos. 2,843,486 and 3,294,539, and JP-A-1-291247.

For the purpose of preventing diffusion of these dyes in the photographic material of the present invention, various means may be employed. For instance, a ballast group may be introduced into the dyes so as to make them non-diffusive.

A hydrophilic polymer charged oppositely to the dissociated anion dye may be incorporated into a layer along with the dye as a mordant, whereby the dye is localized and fixed in the particular layer due to the interaction of the polymer and the dye molecule, as described in U.S. Pat. Nos. 2,548,564, 4,124,386 and 3,625,694.

A water-insoluble solid dye may be used for coloring a particular layer, as so described in JP-A-56-12639, JP-A-55-155350, JP-A-55-155351, JP-A-63-278838, JP-A-63-197943, and European Patent 15,601.

Fine grains of a metal salt to which dyes have been adsorbed may be used for coloring a particular layer, as described in U.S. Pat. Nos. 2,719,088, 2,496,841 and 2,496,842, and JP-A-60-45237.

The photographic material of the present invention may contain an antifoggant or stabilizer selected from, for example, azoles (e.g., benzothiazolium salts, nitroimidazoles, nitrobenzimidazoles, chlorobenzimidazoles, bromobenzimidazoles, nitroindazoles, benzotriazoles, aminotriazoles); mercapto compounds (e.g., mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines); thioketo compounds (e.g., oxazolinethiones); azaindenes (e.g., triazaindenes, tetrazaindenes (especially 4-hydroxy-substituted (1,3,3a,7)tetrazaindenes), pentazaindenes); benzenethiosulfonic acids; benzenesulfinic acids; and benzenesulfonic acid amides.

The photographic material of the present invention may contain color couplers, preferably non-diffusive couplers having a hydrophobic group called a ballast group in the molecule or polymerized couplers. The couplers may be either 4-equivalent or 2-equivalent with respect to silver ions. The photographic material of the present invention may also contain colored couplers having a color-correcting effect, or couplers capable of releasing a development inhibitor during development of the photographic material (so-called DIR couplers). The photographic material may also contain colorless DIR coupling compounds capable of producing a colorless product by a coupling reaction and releasing a development inhibitor.

Preferred examples of such couplers for use in the present invention are described in JP-A-62-215272, from page 91, right top column, line 4 to page 121, left top column, line 6; and JP-A-2-33144, from page 3, right top column, line 14 to page 18, left top column, last line, and from page 30, right top column, line 6 to page 35, right bottom column, line 11.

Specifically, suitable magenta couplers include 5-pyrazolone couplers, pyrazolobenzimidazole couplers, pyrazolotriazole couplers, pyrazolotetrazole couplers, cyanoacetylchroman couplers, and open-chain acylacetonitrile couplers; suitable yellow couplers include acylacetamide couplers (e.g., benzoylacetanilides, pivaloylacetanilides); and suitable cyan couplers include naphthol couplers and phenol couplers. Preferred cyan couplers include phenol couplers having an ethyl group at the meta-position of the phenol nucleus, 2,5-diacylamino-substitued phenol couplers, phenol couplers having a phenylureido group at the 2-position and having an acylamino group at the 5-position, and naphthol couplers having a sulfonamido or amido group at the 5-position of the naphthol nucleus, such as those described in U.S. Pat. Nos. 3,772,002, 2,772,162, 3,758,308, 4,126,396, 4,334,011, 4,327,173, 3,446,622, 4,333,999, 4,451,559 and 4,427,767, as they form fast images.

Two or more different kinds of the above-mentioned couplers may be incorporated into one and the same layer, or one and the same compound of the couplers may be added to two or more layers, for the purpose of satisfying the intended characteristics of the photographic material of the present invention.

The photographic material of the present invention may contain an anti-fading agent selected from, for example, hindered phenols such as hydroquinones, 6-hydroxychromans, 5-hydroxycoumarans, spirochromans, p-alkoxyphenols and hisphenols; and gallic acid derivatives, methylenedioxybenzenes, aminophenols, hindered amines and ether or ester derivatives of them formed by silylating or alkylating the phenolic hydroxyl group of the compounds. In addition, metal complexes such as bis(salicylaldoximato)nickel complexes and bis(N,N-dialkyldithiocarbamato)nickel complexes may also be used as an antifading agent.

For photographic processing of the photographic material of the present invention, any known method and any known processing solution may be employed. The processing temperature may be selected generally from the range between 18° C. and 50° C. However, it may be lower than 18° C. or higher than 50° C. In accordance with the object of the photographic material, either black-and-white development for forming a silver image or color development for forming a color image may be employed.

As a black-and-white developer for the former black-and-white development, any known developing agent, such as dihydroxybenzenes (e.g., hydroquinone), 3-pyrazolidones (e.g., 1-phenyl-3-pyrazolidone) and aminophenols (e.g., N-methyl-p-aminophenol) may be employed singly or in combinations of them.

The color developer for the latter color development is generally an alkaline aqueous solution containing a color developing agent. The color developing agent in it may be a known primary aromatic amine developing agent, such as phenylenediamines (e.g., 4-amino-N,N-diethylaniline, 3-methyl-4-amino-N,N-diethylaniline, 4-amino-N-ethyl-N$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline).

In addition, the color developing agents described in F. A. Meson, *Photographic Processing Chemistry* (published by Focal Press Co., 1966), pp. 226–229 and in U.S. Pat. Nos. 2,193,015 and 2,592,364, and JP-A-48-64933 may also be used.

The developer may additionally contain a pH buffer such as alkali metal sulfites, carbonates, borates or phosphates, as well as a development inhibitor or antifoggant such as bromides, iodides or organic antifoggants. If desired, it may also contain a water softener; a preservative such as hydroxylamine; an organic solvent such as benzyl alcohol or diethylene glycol; a development accelerator such as polyethylene glycol, quaternary ammonium salts or amines; a dye forming coupler; a competing coupler; a foggant such as sodium boronhydride; a developing aid such as 1-phenyl-3-pyrazolidone; a thickener; a polycarboxylic acid chelating agent such as those described in U.S. Pat. No. 4,083,723; and an antioxidant such as those described in German Patent OLS No. 2,622,950.

After being color-developed, the color photographic material is generally bleached. Bleaching of the material may be carried out simultaneously with or separately from fixation. Suitable bleaching agents to be used for bleaching the material include, for example, compounds of polyvalent metals such as iron(III), cobalt(III), chromium(VI) and copper(II), as well as peracids, quinones and nitroso compounds. Specific examples of suitable bleaching agents include ferricyanides; bichromates; organic complexes of iron(III) or cobalt(III), such as complexes with aminopolycarboxylic acids (e.g., ethylenediaminetetraacetic acid, nitrilotriacetic acid, 1,3-diamino-2-propanol-tetraacetic acid) or with organic acids (e.g., citric acid, tartaric acid, malic acid); persulfates; permanganates; and nitrosophenols. Of them, especially advantageous are potassium ferricyanide, sodium ethylenediaminetetraacetato/iron(III) and ammonium ethylenediaminetetraacetato/iron(III). Ethylenediaminetetraacetato/iron(III) complexes are useful both in an independent bleaching solution and in a one-bath bleach-fixing solution.

The bleaching solution or bleach-fixing solution to be used for processing the photographic material of the present invention may contain various additives, for example, a bleaching accelerator such as those described in U.S. Pat. Nos. 3,042,520 and 3,241,966, JP-B-45-8506, and JP-B-45-8836; and a thiol compound such as those described in JP-A-53-65732. After being bleached or bleach-fixed, the photographic material may be rinsed in water or may be directly stabilized in a stabilizing bath without rinsing in water.

The support of the photographic material of the present invention may be any ordinary transparent film support such as a cellulose nitrate film or polyethylene terephthalate film support, or a reflective support, which is used in forming ordinary photographic materials.

The "reflective support" of the photographic material of the present invention is one which elevates the reflectivity of the support itself to make the color image formed in the silver halide emulsion layer clear and sharp. Reflective supports of this kind include a support coated with a hydrophobic resin containing a dispersion of a photo-reflective substance, such as titanium oxide, zinc oxide, calcium carbonate or calcium sulfate, so as to elevate the reflectivity of the support to light within the visible ray wavelength range, and a support made of a hydrophobic resin containing a dispersion of such a photo-reflective substance. Examples of suitable reflective supports include a baryta paper, a polyethylene-coated paper, a polypropylene synthetic paper, and a transparent support coated with a reflective layer thereon or containing a reflective substance therein. Suitable transparent supports include, for example, a glass sheet, a polyester film such as polyethylene terephthalate, cellulose triacetate or cellulose nitrate film, as well as a polyamide film, a polycarbonate film, a polystyrene film, and a polyvinyl chloride resin film. These supports are suitably selected in accordance with the use and object of the photographic material.

Exposure of the photographic material of the present invention for forming a photographic image thereon may be effected by any ordinary means. For instance, any one of various known light sources, such as natural light (sunlight), a tungsten lamp, a fluorescent lamp, a mercury lamp, a xenon-arc lamp, a carbon-arc lamp, a xenon-flash lamp, lasers, an LED and a CRT can be used for exposure. The exposing time may be any ordinary one for ordinary cameras of from 1/1000 second to one second. As the case may be, shorter exposures of less than 1/1000 second, for example from $1/10^6$ to $1/10^4$ second, may be applied to the photographic material of the present invention by the use of a xenon-flash lamp; or longer exposures of more than one second may be applied thereto. If desired, a color filter may be used for exposure of the photographic material of the present invention for adjusting the spectral composition of the light to be applied thereto. Laser rays may be used for exposure of the material. If desired, the material may also be exposed with a light to be emitted from phosphors as excited with electron rays, X rays, $\gamma$ rays or $\alpha$ rays.

The present invention will be described in more detail by way of the following examples, which, however, are not intended to restrict the scope of the present invention.

EXAMPLE 1

1000 ml of water, 25 g of deionized bone gelatin, 15 ml of 50% aqueous $NH_4NO_3$ solution and 7.5 ml of 25% aqueous $NH_3$ solution were added to a reactor and kept at 50° C. With good stirring, 750 ml of 1 N aqueous $AgNO_3$solution and 1 N aqueous KBr solution were added thereto over a period of 50 minutes. The silver potential during the reaction was kept at +50 mV relative to a saturated calomel electrode.

The silver bromide grains thus obtained were monodispersed cubic grains having a mean side length of from 0.75 to 0.8 $\mu$m. A copolymer of isobutene and monosodium maleate was added to the emulsion, and the emulsion was flocculated and rinsed with water so as to de-salt it. 95 g of deionized bone gelatin and 430 ml of water were added to the emulsion, which was then adjusted to a pH of 6.5 and a pAg of 8.3 at 50° C. The emulsion was ripened with sodium thiosulfate at 55° C. for 50 minutes to obtain the optimum sensitivity. One kg of the emulsion contained 0.74 mol of silver bromide.

The sensitizing dye(s) as indicated in Table 2 to Table 15 below and subsequently a hydrazine compound of formula (I), (II), (III) or (IV) or a comparative compound (a-1) to (a-9) also as indicated in Table 2 to Table 15 were added to individual 45 g portions of the emulsion and the resulting emulsions were stirred at 40° C.

To each portion were further added 10 mg of 4-hydroxy-6-methyl-1,3,3a,7-tetrazaindene, 15 g of 10% gel of deionized gelatin and 55 ml of water. The resulting emulsions were then coated on a polyethylene terephthalate film base in the manner mentioned below.

The amount of each emulsion coated was 2.5 g/m$^2$ as silver and 3.8 g/m$^2$ as gelatin. Over each layer thus coated, was further coated a top coat layer having a gelatin content of 1.0 g/m$^2$. The coating liquid for the top coat layer was an aqueous solution consisting essentially of 0.22 g/liter of sodium dodecylbenzenesulfonate, 0.50 g/liter of sodium p-sulfostyrene homopolymer, 3.1 g/liter of sodium 2,4-dichloro-6-hydroxy-1,3,5-triazine and 50 g/liter of gelatin.

The samples thus formed were exposed to a tungsten light (2854° K.) for one second through a continuous wedge with a blue filter (band-pass filter transmitting light having a wavelength of from 395 nm to 440 nm) and a yellow filter (filter transmitting light having a wavelength longer than 520 nm).

After the exposure, the exposed samples were developed with a developer having the composition mentioned below, at 20° C. for 10 minutes. The density of each of the thus developed samples was measured with a densitometer (manufactured by Fuji Photo Film Co.) to obtain the yellow filter sensitivity (SR), the blue filter sensitivity (SB) and the fog of each sample. The reference point of the optical density for determining the sensitivity was a point of (fog +0.2). SR and SB each were determined as a sensitivity relative to 100 (control sensitivity).

Composition of Developer:

| Component | Amount |
|---|---|
| Metol (p-methylaminophenol sulfate, manufactured by Agfa, Co.) | 2.5 g |
| α-ascorbic Acid | 10.0 g |
| Potassium Bromide | 1.0 g |
| Nabox | 35.0 g |
| Water to make | 1.0 liter (pH 9.8) |

The results obtained are shown in Tables 2 to 15 below as relative values.

Comparative Compounds used were as follows:

(a-1)

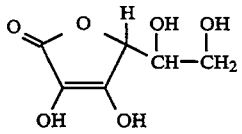

(a-2)

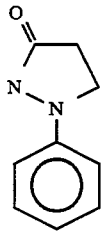

(a-3)

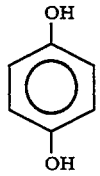

(a-4)

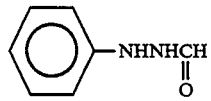

(a-5)

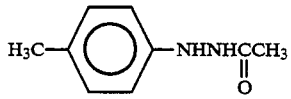

(a-6)

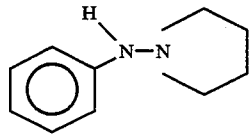

(a-7)

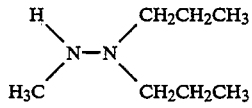

(a-8)

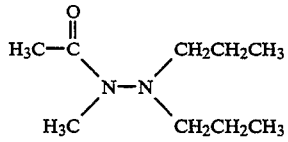

(a-9)

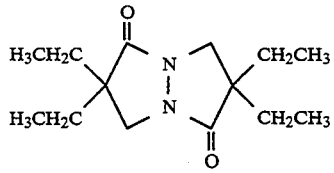

TABLE 2

| Test No. | Sensitizing Dye Added and Amount of it ($10^{-4}$ mol/mol-Ag) | | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | | Relative Sensitivity SB | Relative Sensitivity SR | Fog | Remarks |
|---|---|---|---|---|---|---|---|---|---|---|
| 1-1 | — | | — | — | — | | 100 (control) | — | 0.03 | Control |
| 1-2 | (A-8) | 3.0 | 1.07 | 578 | — | | 89 | 100 (control) | 0.04 | Control |
| 1-3 | (A-8) | 3.0 | 1.07 | 578 | (a-1) | 3.0 | 93 | 112 | 0.28 | Comparison |

TABLE 2-continued

| Test No. | Sensitizing Dye Added and Amount of it ($10^{-4}$ mol/mol-Ag) | | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | | Relative Sensitivity SB | Relative Sensitivity SR | Fog | Remarks |
|---|---|---|---|---|---|---|---|---|---|---|
| 1-4 | (A-8) | 3.0 | 1.07 | 578 | (a-4) | 3.0 | 91 | 107 | 0.20 | Comparison |
| 1-5 | (A-8) | 3.0 | 1.07 | 578 | (1-2) | 3.0 | 91 | 112 | 0.04 | Invention |
| 1-6 | (A-8) | 3.0 | 1.07 | 578 | (4-1) | 3.0 | 93 | 115 | 0.05 | Invention |
| 1-7 | (A-8) | 3.0 | 1.07 | 578 | (3-1) | 3.0 | 95 | 120 | 0.06 | Invention |
| 1-8 | (A-8) | 3.0 | 1.07 | 578 | (2-1) | 3.0 | 98 | 126 | 0.06 | Invention |

TABLE 3

| Test No. | Sensitizing Dye Added and Amount of it ($10^{-4}$ mol/mol-Ag) | | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | | Relative Sensitivity SB | Relative Sensitivity SR | Fog | Remarks |
|---|---|---|---|---|---|---|---|---|---|---|
| 1-1 | — | | — | — | — | | 100 (control) | — | 0.03 | Control |
| 1-9 | (B-2) | 3.0 | 0.91 | 595 | — | | 79 | 100 (control) | 0.04 | Control |
| 1-10 | (B-2) | 3.0 | 0.91 | 595 | (a-1) | 3.0 | 87 | 135 | 0.28 | Comparison |
| 1-11 | (B-2) | 3.0 | 0.91 | 595 | (a-4) | 3.0 | 83 | 126 | 0.20 | Comparison |
| 1-12 | (B-2) | 3.0 | 0.91 | 595 | (1-2) | 3.0 | 85 | 129 | 0.04 | Invention |
| 1-13 | (B-2) | 3.0 | 0.91 | 595 | (4-1) | 3.0 | 89 | 141 | 0.05 | Invention |
| 1-14 | (B-2) | 3.0 | 0.91 | 595 | (3-1) | 3.0 | 93 | 151 | 0.06 | Invention |
| 1-15 | (B-2) | 3.0 | 0.91 | 595 | (2-1) | 3.0 | 95 | 158 | 0.06 | Invention |

TABLE 4

| Test No. | Sensitizing Dye Added and Amount of it ($10^{-4}$ mol/mol-Ag) | | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | | Relative Sensitivity SB | Relative Sensitivity SR | Fog | Remarks |
|---|---|---|---|---|---|---|---|---|---|---|
| 1-1 | — | | — | — | — | | 100 (control) | — | 0.03 | Control |
| 1-16 | (C-3) | 3.0 | 0.50 | 660 | — | | 40 | 100 (control) | 0.06 | Control |
| 1-17 | (C-3) | 3.0 | 0.50 | 660 | (a-1) | 3.0 | 56 | 162 | 0.31 | Comparison |
| 1-18 | (C-3) | 3.0 | 0.50 | 660 | (a-4) | 3.0 | 52 | 151 | 0.23 | Comparison |
| 1-19 | (C-3) | 3.0 | 0.50 | 660 | (1-2) | 3.0 | 59 | 166 | 0.08 | Invention |
| 1-20 | (C-3) | 3.0 | 0.50 | 660 | (4-1) | 3.0 | 60 | 170 | 0.08 | Invention |
| 1-21 | (C-3) | 3.0 | 0.50 | 660 | (3-1) | 3.0 | 62 | 174 | 0.10 | Invention |
| 1-22 | (C-3) | 3.0 | 0.50 | 660 | (2-1) | 3.0 | 63 | 178 | 0.10 | Invention |

TABLE 5

| Test No. | Sensitizing Dye Added and Amount of it ($10^{-4}$ mol/mol-Ag) | | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | | Relative Sensitivity SB | Relative Sensitivity SR | Fog | Remarks |
|---|---|---|---|---|---|---|---|---|---|---|
| 1-1 | — | | — | — | — | | 100 (control) | — | 0.03 | Control |
| 1-23 | (XI-1) | 3.0 | 0.86 | 613 | — | | 47 | 100 (control) | 0.04 | Control |
| 1-24 | (XI-1) | 3.0 | 0.86 | 613 | (a-1) | 3.0 | 66 | 162 | 0.28 | Comparison |
| 1-25 | (XI-1) | 3.0 | 0.86 | 613 | (a-4) | 3.0 | 63 | 151 | 0.20 | Comparison |
| 1-26 | (XI-1) | 3.0 | 0.86 | 613 | (1-2) | 3.0 | 79 | 316 | 0.05 | Invention |
| 1-27 | (XI-1) | 3.0 | 0.86 | 613 | (4-1) | 3.0 | 85 | 363 | 0.06 | Invention |
| 1-28 | (XI-1) | 3.0 | 0.86 | 613 | (3-1) | 3.0 | 87 | 380 | 0.08 | Invention |
| 1-29 | (XI-1) | 3.0 | 0.86 | 613 | (2-1) | 3.0 | 89 | 389 | 0.08 | Invention |

TABLE 6

| Test No. | Sensitizing Dye Added and Amount of it ($10^{-4}$ mol/mol-Ag) | | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | | Relative Sensitivity SB | Relative Sensitivity SR | Fog | Remarks |
|---|---|---|---|---|---|---|---|---|---|---|
| 1-1 | — | | — | — | — | | 100 (control) | — | 0.03 | Control |
| 1-30 | (XIV-3) | 3.0 | 0.82 | 654 | — | | 25 | 100 | 0.06 | Control |

TABLE 6-continued

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| | | | | | | (control) | | |
| 1-31 | (XIV-3) 3.0 | 0.82 | 654 | (a-1) 3.0 | 59 | 251 | 0.31 | Comparison |
| 1-32 | (XIV-3) 3.0 | 0.82 | 654 | (a-4) 3.0 | 52 | 240 | 0.23 | Comparison |
| 1-33 | (XIV-3) 3.0 | 0.82 | 654 | (1-2) 3.0 | 76 | 407 | 0.08 | Invention |
| 1-34 | (XIV-3) 3.0 | 0.82 | 654 | (4-1) 3.0 | 79 | 417 | 0.08 | Invention |
| 1-35 | (XIV-3) 3.0 | 0.82 | 654 | (3-1) 3.0 | 81 | 427 | 0.09 | Invention |
| 1-36 | (XIV-3) 3.0 | 0.82 | 654 | (2-1) 3.0 | 85 | 447 | 0.10 | Invention |

TABLE 7

| Test No. | Sensitizing Dye Added and Amount of it ($10^{-4}$ mol/mol-Ag) | Sensitizing Dye Added and Amount of it ($10^{-4}$ mol/mol-Ag) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|
| 1-1 | — | — | — | 100 (control) | — | 0.03 | Control |
| 1-37 | (XIV-7) 2.7 | (XIV-15) 0.3 | — | 62 | 100 (control) | 0.05 | Control |
| 1-38 | (XIV-7) 2.7 | (XIV-15) 0.3 | (a-1) 3.0 | 68 | 120 | 0.29 | Comparison |
| 1-39 | (XIV-7) 2.7 | (XIV-15) 0.3 | (a-4) 3.0 | 65 | 114 | 0.22 | Comparison |
| 1-40 | (XIV-7) 2.7 | (XIV-15) 0.3 | (4-1) 3.0 | 83 | 372 | 0.07 | Invention |
| 1-41 | (XIV-7) 2.7 | (XIV-15) 0.3 | (2-1) 3.0 | 89 | 398 | 0.09 | Invention |

TABLE 8

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 1-1 | — | — | — | — | 100 (control) | — | 0.03 | Control |
| 1-42 | (B-1) 3.0 | 0.44 | 570 | — | 35 | 100 (control) | 0.06 | Control |
| 1-43 | (B-1) 3.0 | 0.44 | 570 | (a-1) 3.0 | 42 | 135 | 0.31 | Comparison |
| 1-44 | (B-1) 3.0 | 0.44 | 570 | (a-4) 3.0 | 37 | 126 | 0.23 | Comparison |
| 1-45 | (B-1) 3.0 | 0.44 | 570 | (1-2) 3.0 | 46 | 162 | 0.08 | Invention |
| 1-46 | (B-1) 3.0 | 0.44 | 570 | (4-1) 3.0 | 47 | 170 | 0.08 | Invention |
| 1-47 | (B-1) 3.0 | 0.44 | 570 | (3-1) 3.0 | 48 | 174 | 0.09 | Invention |
| 1-48 | (B-1) 3.0 | 0.44 | 570 | (2-1) 3.0 | 50 | 182 | 0.10 | Invention |

TABLE 9

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 1-1 | — | — | — | — | 100 (control) | — | 0.03 | Control |
| 1-49 | (C-1) 1.5 | 0.7 | 610 | — | 3 | 100 (control) | 0.04 | Control |
| 1-50 | (C-1) 1.5 | 0.7 | 610 | (a-1) 3.0 | 5 | 162 | 0.25 | Comparison |
| 1-51 | (C-1) 1.5 | 0.7 | 610 | (a-4) 3.0 | 4 | 141 | 0.20 | Comparison |
| 1-52 | (C-1) 1.5 | 0.7 | 610 | (1-2) 3.0 | 8 | 295 | 0.04 | Invention |
| 1-53 | (C-1) 1.5 | 0.7 | 610 | (4-1) 3.0 | 9 | 331 | 0.04 | Invention |
| 1-54 | (C-1) 1.5 | 0.7 | 610 | (3-1) 3.0 | 9 | 331 | 0.05 | Invention |
| 1-55 | (C-1) 1.5 | 0.7 | 610 | (2-1) 3.0 | 10 | 347 | 0.05 | Invention |

TABLE 10

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 1-1 | — | — | — | — | 100 (control) | — | 0.03 | Control |
| 1-56 | (XI-5) 3.0 | 0.60 | 620 | — | 45 | 100 | 0.05 | Control |

TABLE 10-continued

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| | | | | | | (control) | | |
| 1-57 | (XI-5) 3.0 | 0.60 | 620 | (a-1) 3.0 | 63 | 141 | 0.29 | Comparison |
| 1-58 | (XI-5) 3.0 | 0.60 | 620 | (a-4) 3.0 | 60 | 132 | 0.20 | Comparison |
| 1-59 | (XI-5) 3.0 | 0.60 | 620 | (1-2) 3.0 | 78 | 331 | 0.06 | Invention |
| 1-60 | (XI-5) 3.0 | 0.60 | 620 | (4-1) 3.0 | 83 | 372 | 0.06 | Invention |
| 1-61 | (XI-5) 3.0 | 0.60 | 620 | (3-1) 3.0 | 83 | 389 | 0.07 | Invention |
| 1-62 | (XI-5) 3.0 | 0.60 | 620 | (2-1) 3.0 | 85 | 407 | 0.07 | Invention |

TABLE 11

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 1-1 | — | — | — | — | 100 (control) | — | 0.03 | Control |
| 1-63 | (XI-14) 1.5 | 0.53 | 690 | — | 32 | 100 (control) | 0.04 | Control |
| 1-64 | (XI-14) 1.5 | 0.53 | 690 | (a-1) 3.0 | 47 | 158 | 0.29 | Comparison |
| 1-65 | (XI-14) 1.5 | 0.53 | 690 | (a-4) 3.0 | 43 | 145 | 0.22 | Comparison |
| 1-66 | (XI-14) 1.5 | 0.53 | 690 | (1-2) 3.0 | 68 | 324 | 0.04 | Invention |
| 1-67 | (XI-14) 1.5 | 0.53 | 690 | (4-1) 3.0 | 69 | 363 | 0.05 | Invention |
| 1-68 | (XI-14) 1.5 | 0.53 | 690 | (3-1) 3.0 | 71 | 389 | 0.05 | Invention |
| 1-69 | (XI-14) 1.5 | 0.53 | 690 | (2-1) 3.0 | 74 | 407 | 0.06 | Invention |

TABLE 12

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 1-1 | — | — | — | — | 100 (control) | — | 0.03 | Control |
| 1-70 | (XII-1) 3.0 | 0.42 | 680 | — | 22 | 100 (control) | 0.04 | Control |
| 1-71 | (XII-1) 3.0 | 0.42 | 680 | (a-1) 3.0 | 35 | 178 | 0.29 | Comparison |
| 1-72 | (XII-1) 3.0 | 0.42 | 680 | (a-4) 3.0 | 32 | 166 | 0.20 | Comparison |
| 1-73 | (XII-1) 3.0 | 0.42 | 680 | (1-2) 3.0 | 45 | 251 | 0.04 | Invention |
| 1-74 | (XII-1) 3.0 | 0.42 | 680 | (4-1) 3.0 | 46 | 263 | 0.05 | Invention |
| 1-75 | (XII-1) 3.0 | 0.42 | 680 | (3-1) 3.0 | 47 | 269 | 0.06 | Invention |
| 1-76 | (XII-1) 3.0 | 0.42 | 680 | (2-1) 3.0 | 49 | 282 | 0.06 | Invention |

TABLE 13

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 1-1 | — | — | — | — | 100 (control) | — | 0.03 | Control |
| 1-77 | (XII-8) 3.0 | 0.25 | 805 | — | 14 | 100 (control) | 0.11 | Control |
| 1-78 | (XII-8) 3.0 | 0.25 | 805 | (a-1) 3.0 | 22 | 166 | 0.40 | Comparison |
| 1-79 | (XII-8) 3.0 | 0.25 | 805 | (a-4) 3.0 | 20 | 148 | 0.39 | Comparison |
| 1-80 | (XII-8) 3.0 | 0.25 | 805 | (1-2) 3.0 | 29 | 224 | 0.12 | Invention |
| 1-81 | (XII-8) 3.0 | 0.25 | 805 | (4-1) 3.0 | 30 | 234 | 0.12 | Invention |
| 1-82 | (XII-8) 3.0 | 0.25 | 805 | (3-1) 3.0 | 32 | 240 | 0.13 | Invention |
| 1-83 | (XII-8) 3.0 | 0.25 | 805 | (2-1) 3.0 | 32 | 251 | 0.13 | Invention |

TABLE 14

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 1-1 | — | — | — | — | 100 | — | 0.03 | Control |

TABLE 14-continued

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| | | | | | (control) | | | |
| 1-84 | (XIII-1) 3.0 | 0.47 | 642 | — | 13 | 100 | 0.04 | Control |
| | | | | | | (control) | | |
| 1-85 | (XIII-1) 3.0 | 0.47 | 642 | (a-1) 3.0 | 25 | 214 | 0.28 | Comparison |
| 1-86 | (XIII-1) 3.0 | 0.47 | 642 | (a-4) 3.0 | 21 | 174 | 0.21 | Comparison |
| 1-87 | (XIII-1) 3.0 | 0.47 | 642 | (1-2) 3.0 | 35 | 302 | 0.04 | Invention |
| 1-88 | (XIII-1) 3.0 | 0.47 | 642 | (4-1) 3.0 | 38 | 339 | 0.04 | Invention |
| 1-89 | (XIII-1) 3.0 | 0.47 | 642 | (3-1) 3.0 | 38 | 355 | 0.05 | Invention |
| 1-90 | (XIII-1) 3.0 | 0.47 | 642 | (2-1) 3.0 | 40 | 363 | 0.07 | Invention |

TABLE 15

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 1-1 | — | — | — | — | 100 | — | 0.03 | Control |
| | | | | | (control) | | | |
| 1-91 | (XIII-3) 3.0 | 0.55 | 715 | — | 12 | 100 | 0.07 | Control |
| | | | | | | (control) | | |
| 1-92 | (XIII-3) 3.0 | 0.55 | 715 | (a-1) 3.0 | 25 | 209 | 0.35 | Comparison |
| 1-93 | (XIII-3) 3.0 | 0.55 | 715 | (a-4) 3.0 | 21 | 178 | 0.31 | Comparison |
| 1-94 | (XIII-3) 3.0 | 0.55 | 715 | (1-2) 3.0 | 35 | 302 | 0.08 | Invention |
| 1-95 | (XIII-3) 3.0 | 0.55 | 715 | (4-1) 3.0 | 35 | 324 | 0.08 | Invention |
| 1-96 | (XIII-3) 3.0 | 0.55 | 715 | (3-1) 3.0 | 38 | 324 | 0.09 | Invention |
| 1-97 | (XIII-3) 3.0 | 0.55 | 715 | (2-1) 3.0 | 40 | 339 | 0.10 | Invention |

As may be seen from the results in Tables 2 to 15 above, incorporation of a compound of formula (I), (II), (III) or (IV) into the photographic material along with the sensitizing dye(s) prevents desensitization of the material due to the sensitizing dye(s) (or so-called color desensitization, SB) so that the spectral sensitivity of the material (SR) is elevated.

For instance, in Table 6, the spectral sensitivity attained by incorporation of Dye (XIV-3) increased by about 4.5 times due to incorporation of Compound (2-1). In this case, elevation of the spectral sensitivity was higher than the recovery of the dye desensitization and the combination of Compound (2-1) and Dye (XIV-3) resulted in super-color sensitization.

Regarding the comparative samples in Table 6 where Comparative Compound (a-1) or (a-4) was incorporated, the sensitivity of these samples increased due to the compound but the fog of these samples also increased. As opposed to these samples, the sensitivity of the samples of the present invention each containing a compound of the invention increased more while the fog of the samples of the invention was low.

In Table 7, the sensitivity of Samples (1-40) and (1-41) of the present invention each containing two sensitizing dyes also increased while the fog of these samples was low.

EXAMPLE 2

6.5 g of potassium bromide, 1.2 g of potassium iodide and 4.9 g of potassium thiocyanate were added to one liter of 2% aqueous gelatin solution and stirred at 70° C. While still stirring at the 70° C. temperature, 0.4 liter of an aqueous solution containing 57.5 g of potassium bromide and 2.5 g of potassium iodide and 0.4 liter of an aqueous solution containing 85 g of silver nitrate were added thereto at the same flow rate by a double-jet method, over a period of 45 minutes.

Next, the emulsion thus formed was cooled to 65° C., and a methanol solution of a sensitizing dye as indicated in Tables 16 to 20 below was added thereto and stirred for further 15 minutes.

Next, a copolymer of isobutene and monosodium maleate was added to the emulsion, which was then adjusted to a pH of 3.8. This was flocculated and rinsed with water. Gelatin, water and phenol were added thereto, and the emulsion was adjusted to a pH of 6.8 and a pAg of 8.7. The silver halide grains thus formed had a mean diameter of 1.64 μm and a mean thickness of 0.47 μm, the ratio of mean diameter/mean thickness being 3.49. Next, the emulsion was ripened at 60° C., by adding sodium thiosulfate 5-hydrate and potassium tetraaurate thereto.

A compound of formula (I), (II), (III) or (IV) of the present invention as indicated in Tables 16 to 21 was added to the silver halide emulsion thus prepared and stirred at 40° C. The respective portions of the emulsion were coated on an antistatic polyethylene terephthalate film base in the same manner as in Example 1. The coated samples were then exposed and developed also in the same manner as in Example 1, and the sensitivity of them was determined.

The results are shown in Tables 16 to 21 below.

TABLE 16

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 2-1 | — | — | — | — | 100 (control) | — | 0.06 | Control |
| 2-2 | (XIV-15) 3.0 | 0.70 | 670 | — | 23 | 100 (control) | 0.09 | Control |
| 2-3 | (XIV-15) 3.0 | 0.70 | 670 | (a-1) 3.0 | 47 | 251 | 0.34 | Comparison |
| 2-4 | (XIV-15) 3.0 | 0.70 | 670 | (a-2) 3.0 | 41 | 200 | 0.30 | Comparison |
| 2-5 | (XIV-15) 3.0 | 0.70 | 670 | (a-3) 3.0 | 40 | 195 | 0.13 | Comparison |
| 2-6 | (XIV-15) 3.0 | 0.70 | 670 | (a-4) 3.0 | 41 | 200 | 0.28 | Comparison |
| 2-7 | (XIV-15) 3.0 | 0.70 | 670 | (a-5) 3.0 | 42 | 204 | 0.25 | Comparison |
| 2-8 | (XIV-15) 3.0 | 0.70 | 670 | (a-6) 3.0 | 19 | 79 | 0.27 | Comparison |
| 2-9 | (XIV-15) 3.0 | 0.70 | 670 | (a-7) 3.0 | 40 | 195 | 0.29 | Comparison |
| 2-10 | (XIV-15) 3.0 | 0.70 | 670 | (a-8) 3.0 | 23 | 100 | 0.09 | Comparison |
| 2-11 | (XIV-15) 3.0 | 0.70 | 670 | (a-9) 3.0 | 23 | 100 | 0.10 | comparison |
| 2-12 | (XIV-15) 3.0 | 0.70 | 670 | (1-32) 3.0 | 40 | 200 | 0.09 | Invention |

TABLE 17

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 2-1 | — | — | — | — | 100 (control) | — | 0.06 | Control |
| 2-2 | (XIV-15) 3.0 | 0.70 | 670 | — | 23 | 100 (control) | 0.09 | Control |
| 2-13 | (XIV-15) 3.0 | 0.70 | 670 | (1-30) 3.0 | 42 | 219 | 0.09 | Invention |
| 2-14 | (XIV-15) 3.0 | 0.70 | 670 | (1-23) 3.0 | 42 | 214 | 0.09 | Invention |
| 2-15 | (XIV-15) 3.0 | 0.70 | 670 | (1-33) 3.0 | 46 | 229 | 0.09 | Invention |
| 2-16 | (XIV-15) 3.0 | 0.70 | 670 | (1-34) 3.0 | 46 | 229 | 0.09 | Invention |
| 2-17 | (XIV-15) 3.0 | 0.70 | 670 | (1-35) 3.0 | 47 | 234 | 0.09 | Invention |
| 2-18 | (XIV-15) 3.0 | 0.70 | 670 | (1-36) 3.0 | 47 | 234 | 0.09 | Invention |
| 2-19 | (XIV-15) 3.0 | 0.70 | 670 | (1-41) 3.0 | 49 | 251 | 0.09 | Invention |
| 2-20 | (XIV-15) 3.0 | 0.70 | 670 | (1-39) 3.0 | 48 | 245 | 0.09 | Invention |
| 2-21 | (XIV-15) 3.0 | 0.70 | 670 | (1-20) 3.0 | 53 | 269 | 0.10 | Invention |
| 2-22 | (XIV-15) 3.0 | 0.70 | 670 | (1-15) 3.0 | 53 | 269 | 0.09 | Invention |

TABLE 18

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 2-1 | — | — | — | — | 100 (control) | — | 0.06 | Control |
| 2-2 | (XIV-15) 3.0 | 0.70 | 670 | — | 23 | 100 (control) | 0.09 | Control |
| 2-23 | (XIV-15) 3.0 | 0.70 | 670 | (1-14) 3.0 | 53 | 275 | 0.10 | Invention |
| 2-24 | (XIV-15) 3.0 | 0.70 | 670 | (1-2) 3.0 | 54 | 275 | 0.11 | Invention |
| 2-25 | (XIV-15) 3.0 | 0.70 | 670 | (1-6) 3.0 | 53 | 269 | 0.10 | Invention |
| 2-26 | (XIV-15) 3.0 | 0.70 | 670 | (1-37) 3.0 | 54 | 282 | 0.09 | Invention |
| 2-27 | (XIV-15) 3.0 | 0.70 | 670 | (1-45) 3.0 | 54 | 288 | 0.09 | Invention |
| 2-28 | (XIV-15) 3.0 | 0.70 | 670 | (1-43) 3.0 | 54 | 295 | 0.09 | Invention |
| 2-29 | (XIV-15) 3.0 | 0.70 | 670 | (1-44) 3.0 | 54 | 295 | 0.09 | Invention |
| 2-30 | (XIV-15) 3.0 | 0.70 | 670 | (1-38) 3.0 | 54 | 295 | 0.09 | Invention |
| 2-31 | (XIV-15) 3.0 | 0.70 | 670 | (1-40) 3.0 | 54 | 302 | 0.10 | Invention |
| 2-32 | (XIV-15) 3.0 | 0.70 | 670 | (4-15) 30 | 59 | 339 | 0.11 | Invention |

TABLE 19

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | Relative Sensitivity SR | Fog | Remarks |
|---|---|---|---|---|---|---|---|---|
| 2-1 | — | — | — | — | 100 (control) | — | 0.06 | Control |
| 2-2 | (XIV-15) 3.0 | 0.70 | 670 | — | 23 | 100 (control) | 0.09 | Control |
| 2-33 | (XIV-15) 3.0 | 0.70 | 670 | (4-6) 3.0 | 30 | 347 | 0.10 | Invention |

TABLE 19-continued

| Test No. | Sensitizing Dye Added and Amount of it ($10^{-4}$ mol/mol-Ag) | | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | | Relative Sensitivity SB | SR | Fog | Remarks |
|---|---|---|---|---|---|---|---|---|---|---|
| 2-34 | (XIV-15) | 3.0 | 0.70 | 670 | (4-2) | 3.0 | 63 | 347 | 0.10 | Invention |
| 2-35 | (XIV-15) | 3.0 | 0.70 | 670 | (4-3) | 3.0 | 65 | 355 | 0.10 | Invention |
| 2-36 | (XIV-15) | 3.0 | 0.70 | 670 | (3-21) | 3.0 | 71 | 380 | 0.12 | Invention |
| 2-37 | (XIV-15) | 3.0 | 0.70 | 670 | (3-26) | 3.0 | 73 | 389 | 0.14 | Invention |
| 2-38 | (XIV-15) | 3.0 | 0.70 | 670 | (3-24) | 3.0 | 76 | 417 | 0.11 | Invention |
| 2-39 | (XIV-15) | 3.0 | 0.70 | 670 | (3-1) | 3.0 | 76 | 417 | 0.11 | Invention |
| 2-40 | (XIV-15) | 3.0 | 0.70 | 670 | (3-6) | 3.0 | 76 | 427 | 0.11 | Invention |
| 2-41 | (XIV-15) | 3.0 | 0.70 | 670 | (3-16) | 3.0 | 76 | 437 | 0.11 | Invention |
| 2-42 | (XIV-15) | 3.0 | 0.70 | 670 | (3-23) | 3.0 | 76 | 437 | 0.13 | Invention |

TABLE 20

| Test No. | Sensitizing Dye Added and Amount of it ($10^{-4}$ mol/mol-Ag) | | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | | Relative Sensitivity SB | SR | Fog | Remarks |
|---|---|---|---|---|---|---|---|---|---|---|
| 2-1 | — | | — | — | — | | 100 (control) | — | 0.06 | Control |
| 2-2 | (XIV-15) | 3.0 | 0.70 | 670 | — | | 23 | 100 (control) | 0.09 | Control |
| 2-33 | (XIV-15) | 3.0 | 0.70 | 670 | (3-8) | 3.0 | 76 | 447 | 0.11 | Invention |
| 2-34 | (XIV-15) | 3.0 | 0.70 | 670 | (3-19) | 3.0 | 76 | 457 | 0.11 | Invention |
| 2-35 | (XIV-15) | 3.0 | 0.70 | 670 | (2-33) | 3.0 | 81 | 490 | 0.09 | Invention |
| 2-36 | (XIV-15) | 3.0 | 0.70 | 670 | (2-19) | 3.0 | 83 | 501 | 0.10 | Invention |
| 2-37 | (XIV-15) | 3.0 | 0.70 | 670 | (2-18) | 3.0 | 83 | 501 | 0.09 | Invention |
| 2-38 | (XIV-15) | 3.0 | 0.70 | 670 | (2-12) | 3.0 | 87 | 537 | 0.11 | Invention |
| 2-39 | (XIV-15) | 3.0 | 0.70 | 670 | (2-34) | 3.0 | 87 | 525 | 0.10 | Invention |
| 2-40 | (XIV-15) | 3.0 | 0.70 | 670 | (2-4) | 3.0 | 87 | 537 | 0.09 | Invention |
| 2-41 | (XIV-15) | 3.0 | 0.70 | 670 | (2-28) | 3.0 | 87 | 537 | 0.13 | Invention |
| 2-42 | (XIV-15) | 3.0 | 0.70 | 670 | (2-1) | 3.0 | 91 | 562 | 0.10 | Invention |

TABLE 21

| Test No. | Sensitizing Dye Added and Amount of it ($10^{-4}$ mol/mol-Ag) | Oxidation Potential of Sensitizing Dye Added (V vsSCE) | Absorption Peak of Sensitizing Dye Added (nm) | Hydrazine Compound or Comparative Compound Added and Amount of it ($10^{-2}$ mol/mol-Ag) | Relative Sensitivity SB | SR | Fog | Remarks |
|---|---|---|---|---|---|---|---|---|
| 2-1 | — | — | — | — | 100 (control) | — | 0.06 | Control |
| 2-53 | — | — | — | (1-2) | 102 | — | 0.07 | Invention |
| 2-54 | — | — | — | (4-2) | 105 | — | 0.06 | Invention |
| 2-55 | — | — | — | (3-1) | 107 | — | 0.06 | Invention |
| 2-56 | — | — | — | (2-1) | 110 | — | 0.06 | Invention |

The results of Tables 16 to 21 show that the samples of the present invention, in each of which the coated silver halide emulsion contained tabular core/shell grains (the core being silver bromide and the shell being silver iodobromide), had elevated blue sensitivity (SB) and spectral sensitivity (SR) and had a lowered fog.

EXAMPLE 3

Plural layers each having the composition mentioned below were coated on a cellulose triacetate film support previously coated with a subbing layer, to prepare multi-layer color photographic material Sample (3-3).

Compositions of Photographic Layers

The numeral for each component indicates the amount thereof coated in units of g/m$^2$. The amount of silver halide coated is represented by the amount of silver therein. The sensitizing dyes coated are given in terms of the moles of dye per mol of silver halide in the same layer.

Sample (3-3) (Sample of the invention):

| Component | Amount |
|---|---|
| First Layer: Anti-halation Layer | |
| Black Colloidal Silver | 0.18 as Ag |
| Gelatin | 1.40 |
| Second Layer: Interlayer | |
| 2,5-Di-t-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third Layer: First Red-sensitive Emulsion Layer | |
| Emulsion A | 0.25 as Ag |
| Emulsion B | 0.25 as Ag |
| Sensitizing Dye (XI-1) | $6.9 \times 10^{-5}$ |
| Sensitizing Dye (XI-15) | $1.8 \times 10^{-5}$ |
| Sensitizing Dye (XIV-7) | $3.1 \times 10^{-4}$ |

-continued

Sample (3-3) (Sample of the invention):

| Component | Amount |
|---|---|
| Compound (2-1) | $3.0 \times 10^{-3}$ |
| EX-2 | 0.34 |
| EX-10 | 0.020 |
| U-1 | 0.070 |
| U-2 | 0.050 |
| U-3 | 0.070 |
| HBS-1 | 0.060 |
| Gelatin | 0.87 |
| Fourth Layer: | |
| Second Red-sensitive Emulsion Layer | |
| Emulsion G | 1.00 as Ag |
| Sensitizing Dye (XI-1) | $5.1 \times 10^{-5}$ |
| Sensitizing Dye (XIV-15) | $1.4 \times 10^{-5}$ |
| Sensitizing Dye (XIV-7) | $2.3 \times 10^{-4}$ |
| Compound (2-1) | $2.3 \times 10^{-3}$ |
| EX-2 | 0.40 |
| EX-3 | 0.050 |
| EX-10 | 0.015 |
| U-1 | 0.070 |
| U-2 | 0.050 |
| U-3 | 0.070 |
| Gelatin | 1.30 |
| Fifth Layer: Third Red-sensitive Emulsion Layer | |
| Emulsion D | 1.60 as Ag |
| Sensitizing Dye (XI-1) | $5.4 \times 10^{-5}$ |
| Sensitizing Dye (XIV-15) | $1.4 \times 10^{-5}$ |
| Sensitizing Dye (XIV-7) | $2.4 \times 10^{-4}$ |
| Compound (2-1) | $2.4 \times 10^{-3}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth Layer: Interlayer | |
| EX-5 | 0.04 |
| HBS-1 | 0.020 |
| Gelatin | 0.80 |
| Seventh Layer: | |
| First Green-sensitive Emulsion Layer | |
| Emulsion A | 0.15 as Ag |
| Emulsion B | 0.15 as Ag |
| Sensitizing Dye (B-6) | $3.0 \times 10^{-5}$ |
| Sensitizing Dye (B-9) | $1.0 \times 10^{-4}$ |
| Sensitizing Dye (B-2) | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Eighth Layer: | |
| Second Green-sensitive Emulsion Layer | |
| Emulsion C | 0.45 as Ag |
| Sensitizing Dye (B-6) | $2.1 \times 10^{-5}$ |
| Sensitizing Dye (B-9) | $7.0 \times 10^{-5}$ |
| Sensitizing Dye (B-2) | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Ninth Layer: | |

-continued

Sample (3-3) (Sample of the invention):

| Component | Amount |
|---|---|
| Third Green-sensitive Emulsion Layer | |
| Emulsion E | 1.20 as Ag |
| Sensitizing Dye (B-6) | $3.5 \times 10^{-5}$ |
| Sensitizing Dye (B-9) | $8.0 \times 10^{-5}$ |
| Sensitizing Dye (B-2) | $3.0 \times 10^{-4}$ |
| EX-1 | 0.025 |
| EX-11 | 0.10 |
| EX-13 | 0.015 |
| HBS-1 | 0.25 |
| HBS-2 | 0.10 |
| Gelatin | 1.54 |
| Tenth Layer: Yellow Filter Layer | |
| Yellow Colloidal Silver | 0.050 as Ag |
| EX-5 | 0.080 |
| HBS-1 | 0.030 |
| Gelatin | 0.95 |
| Eleventh Layer: | |
| First Blue-sensitive Emulsion Layer | |
| Emulsion A | 0.080 as Ag |
| Emulsion B | 0.070 as Ag |
| Emulsion F | 0.070 as Ag |
| Sensitizing Dye (A-2) | $3.5 \times 10^{-4}$ |
| EX-8 | 0.042 |
| EX-9 | 0.72 |
| HBS-1 | 0.28 |
| Gelatin | 1.10 |
| Twelfth Layer: | |
| Second Blue-sensitive Emulsion Layer | |
| Emulsion G | 0.45 as Ag |
| Sesitizing Dye (A-2) | $2.1 \times 10^{-4}$ |
| EX-9 | 0.15 |
| EX-10 | $7.0 \times 10^{-3}$ |
| HBS-1 | 0.050 |
| Gelatin | 0.78 |
| Thirteenth Layer: | |
| Third Blue-sensitive Emulsion Layer | |
| Emulsion H | 0.77 as Ag |
| Sensitizing Dye (A-2) | $2.2 \times 10^{-4}$ |
| EX-9 | 0.20 |
| HBS-1 | 0.070 |
| Gelatin | 0.69 |
| Fourteenth Layer: First Protective Layer | |
| Emulsion I | 0.20 as Ag |
| U-4 | 0.11 |
| U-5 | 0.17 |
| HBS-1 | $5.0 \times 10^{-2}$ |
| Gelatin | 1.00 |
| Fifteenth Layer: Second Protective Layer | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

To all the layers were added W-1, W-2, W-3, B-4, B-5, F-1, F-2, F-3, F-4, F-5, F-6, F-7, F-8, F-9, F-10, F-11, F-12, F-13, and iron salt, lead salt, gold salt, platinum salt, iridium salt and rhodium salt, for the purpose of improving the storage stability, processability, pressure resistance, fungicidal and bactericidal property, antistatic property and coatability.

The properties of Emulsion A to I above are shown in Table 22 below.

TABLE 22

| | Mean AgI Content (%) | Mean Grain Size (μm) | Variation Coefficient of Grain Size (%) | Ratio of Diameter/ Thickness | Ratio of Silver Amounts (AgI content %) |
|---|---|---|---|---|---|
| Emulsion A | 4.0 | 0.45 | 27 | 1 | core/shell = 1/3 (13/1), two-layer grains |
| Emulsion B | 8.9 | 0.70 | 14 | 1 | core/shell = 3/7 (25/1), two-layer grains |

TABLE 22-continued

| | Mean AgI Content (%) | Mean Grain Size (μm) | Variation Coefficient of Grain Size (%) | Ratio of Diameter/ Thickness | Ratio of Silver Amounts (AgI content %) |
|---|---|---|---|---|---|
| Emulsion C | 10 | 0.75 | 30 | 2 | core/shell = 1/2 (24/3), two-layer grains |
| Emulsion D | 16 | 1.05 | 35 | 2 | core/shell = 4/6 (40/0), two-layer grains |
| Emulsion E | 10 | 1.05 | 35 | 3 | core/shell = 1/2 (24/3), two-layer grains |
| Emulsion F | 4.0 | 0.25 | 28 | 1 | core/shell = 1/3 (13/1), two-layer grains |
| Emulsion G | 14.0 | 0.75 | 25 | 2 | core/shell = 1/2 (42/0), two-layer grains |
| Emulsion H | 14.5 | 1.30 | 25 | 3 | core/shell = 37/63 (34/3), two-layer grains |
| Emulsion I | 1 | 0.07 | 15 | 1 | uniform grains |

Compounds used above are shown below.

EX-1

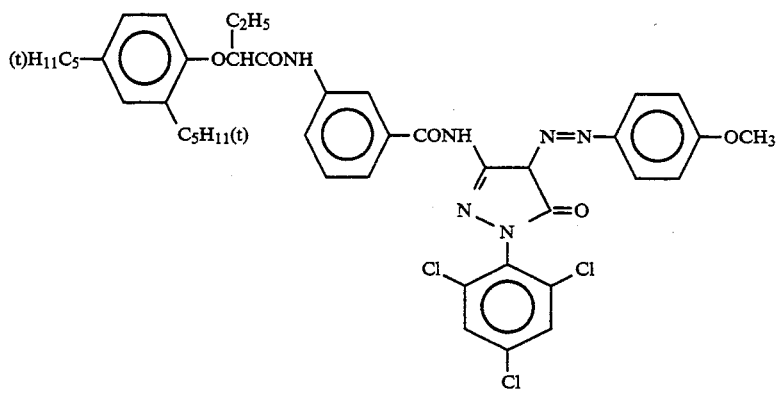

EX-2

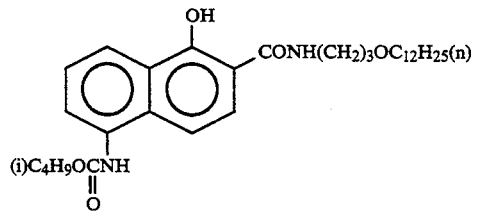

EX-3

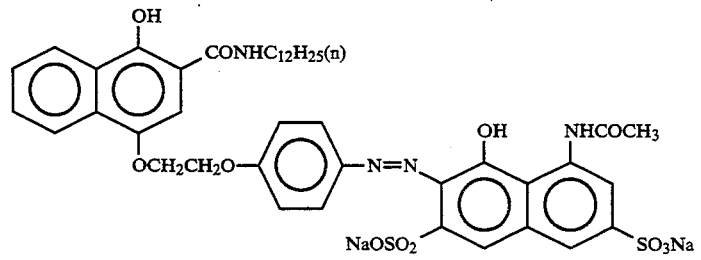

EX-4

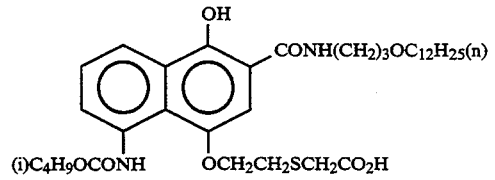

-continued
EX-5
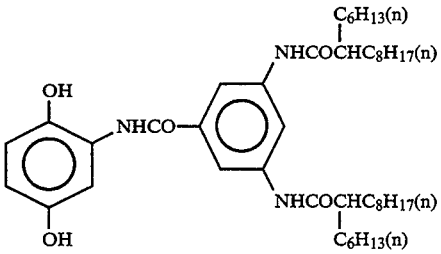
EX-6
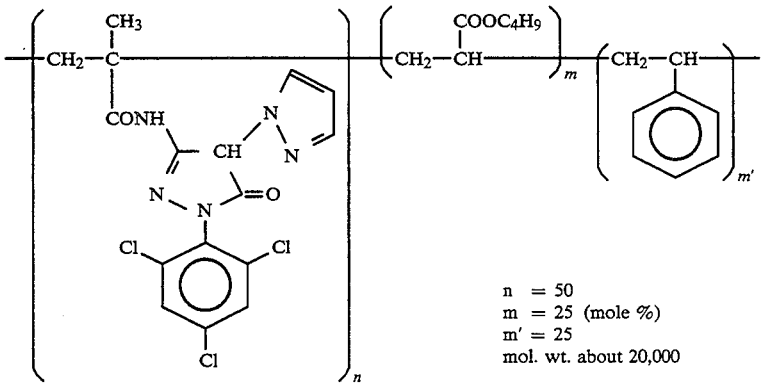
n = 50
m = 25 (mole %)
m' = 25
mol. wt. about 20,000
EX-7
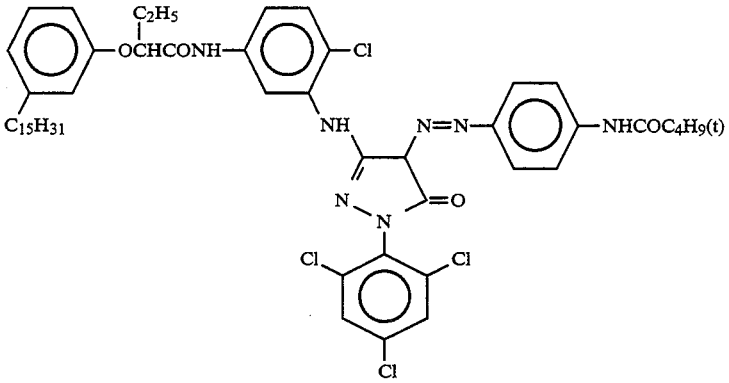
EX-8
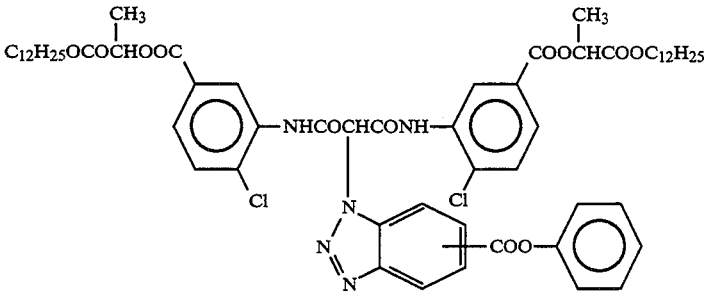
EX-9
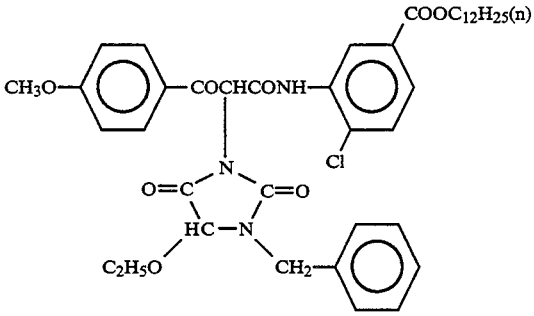

-continued
EX-10
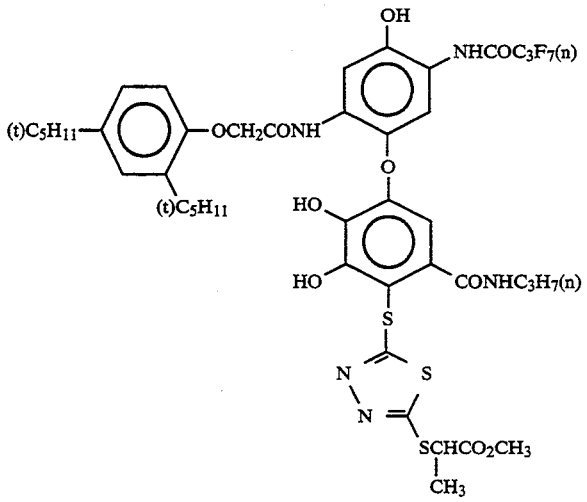
EX-11
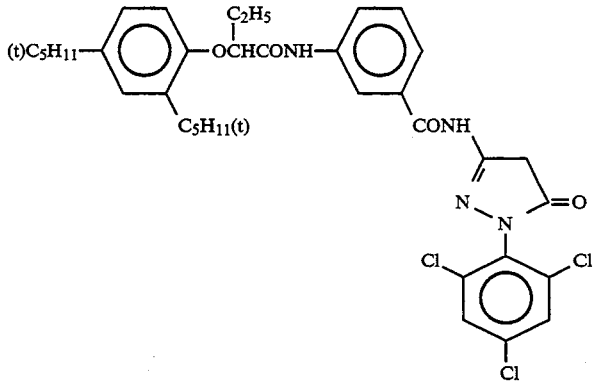
EX-12
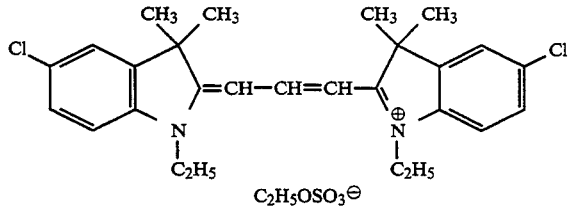
EX-13
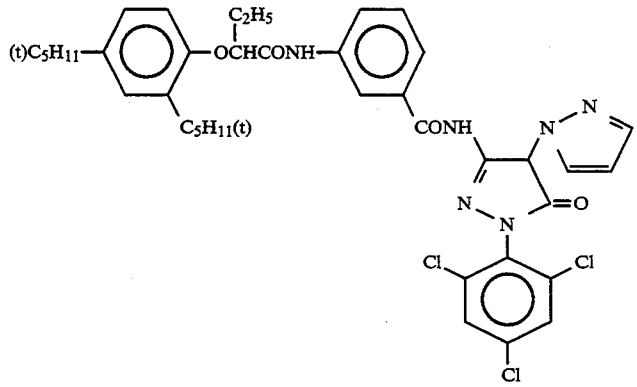
U-1
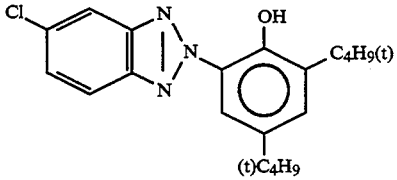

-continued
U-2
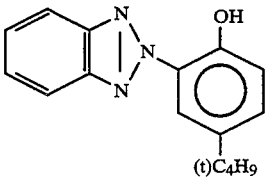
U-3
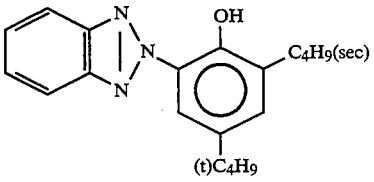
U-4
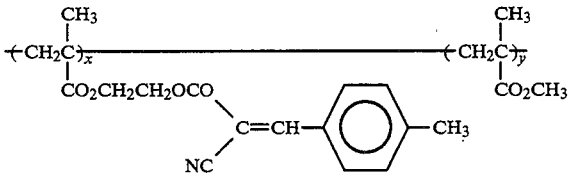
x:y = 70:30 (wt %)
U-5
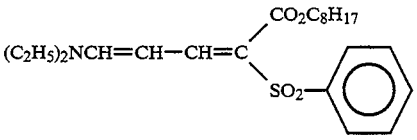
Tricresyl Phosphate HBS-1
Di-n-butyl Phthalate HBS-2
HBS-3
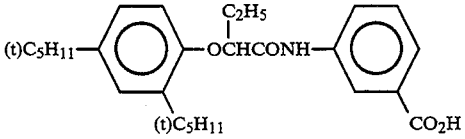
S-1
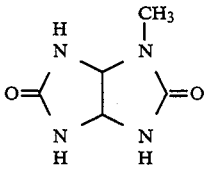
H-1
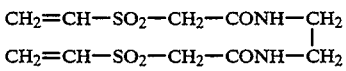
B-1
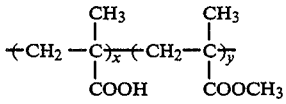
x/y = 10/90 (by moles)
B-2
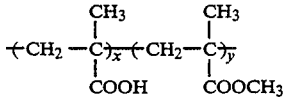
x/y = 40/60 (by moles)
B-3
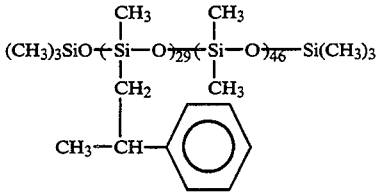

-continued
B-4
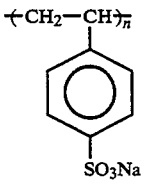
B-5
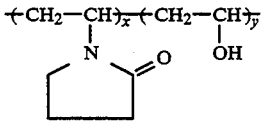
x/y = 70/30 (by moles)
W-1
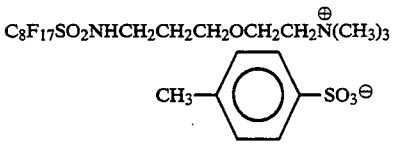
W-2
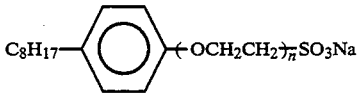
n = 2 ~ 4
W-3
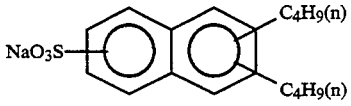
F-1
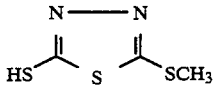
F-2
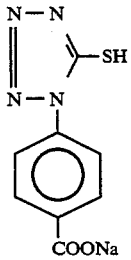
F-3
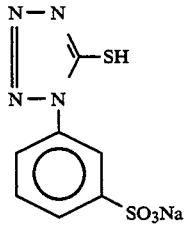
F-4
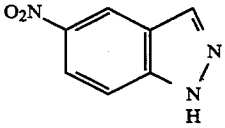
F-5
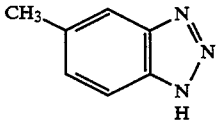

-continued

F-6

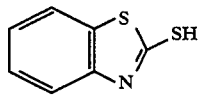

F-7

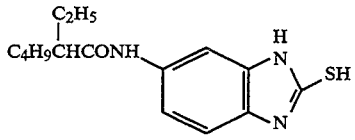

F-8

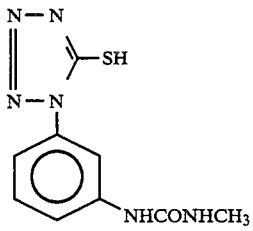

F-9

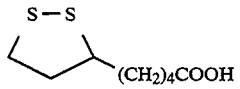

F-10

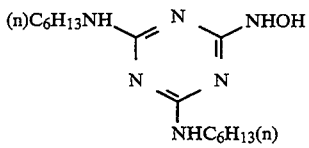

F-11

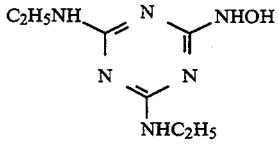

F-12

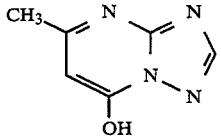

F-13

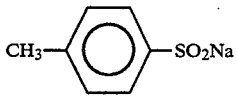

Comparative Sample (3-2) was prepared in the same manner, except that Comparative Compound (a-1) was incorporated into the third, fourth and fifth layers in place of Compound (2-1), and the amount of Comparative Compound (a-1) was the same as that of Compound (2-1).

The samples thus formed were exposed for 1/100 second through a continuous wedge with a blue filter (band-pass filter transmitting light having a wavelength of from 395 nm to 440 nm) and a yellow filter (filter transmitting light having a wavelength longer than 520 nm) and then developed with a developer having the composition mentioned below. The density of each of the thus developed samples was measured. The reference point for the optical density for determining the sensitivity was a point of (fog +0.1). The sensitivity was represented by a value relative to the sensitivity (100) of Control Sample (301) not containing Compound (2-1) and Comparative Compound (a-1). The results are shown in Table 23 below.

The increment of the fog of each of the processed samples was represented by the difference between the fog of Samples (3-2) and (3-3) and that of Control Sample (3-1) not containing Compound (2-1).

| Processing Steps: | | | | |
|---|---|---|---|---|
| Step | Time | Temperature | Amount of Replenisher | Tank Capacity |
| Color Development | 2 min 45 sec | 38° C. | 33 ml | 20 liters |
| Bleaching | 6 min 30 sec | 38° C. | 25 ml | 40 liters |
| Rinsing | 2 min 10 sec | 24° C. | 1200 ml | 2 liters |
| Fixation | 4 min 20 sec | 38° C. | 25 ml | 30 liters |
| Rinsing (1) | 1 min 05 sec | 24° C. | counter-current cascade system from | 10 liters |

-continued

| Processing Steps: | | | | |
|---|---|---|---|---|
| Step | Time | Temperature | Amount of Replenisher | Tank Capacity |
| | | | (2) to (1) | |
| Rinsing (2) | 1 min 00 sec | 24° C. | 1200 ml | 10 liters |
| Stabilization | 1 min 05 sec | 38° C. | 25 ml | 10 liters |
| Drying | 4 min 20 sec | 55° C. | | |

The amount of replenisher was per meter of 35 mm-wide sample.

Compositions of the processing solutions used above are given below.

| Component | Mother Liquid(g) | Replenisher(g) |
|---|---|---|
| Color Developer: | | |
| Diethylenetriamine-pentaacetic Acid | 1.0 | 1.1 |
| 1-Hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-ethyl-N-β-hydroxyethylamino]-2-methylaniline Sulfate | 4.5 | 5.5 |
| Water to make | 1.0 liter | 1.0 liter |
| pH | 10.05 | 10.10 |
| Bleaching Solution: | | |
| Sodium Ethylenediaminetetraacetato/ferric Complex Trihydrate | 100.0 | 120.0 |
| Disodium Ethylenediaminetetraacetate | 10.0 | 11.0 |
| Ammonium Bromide | 140.0 | 160.0 |
| Ammonium Nitrate | 30.0 | 35.0 |
| Aqueous Ammonia (27%) | 6.5 ml | 4.0 ml |
| Water to make | 1.0 liter | 1.0 liter |
| pH | 6.0 | 5.7 |
| Fixing Solution: | | |
| Sodium Ethylenediaminetetraacetate | 0.5 | 0.7 |
| Sodium Sulfite | 7.0 | 8.0 |
| Sodium Bisulfite | 5.0 | 5.5 |
| Ammonium Thiosulfate Aqueous Solution (70%) | 170.0 ml | 200.0 ml |
| Water to make | 1.0 liter | 1.0 liter |
| pH | 6.7 | 6.6 |
| Stabilizing Solution: | | |
| Formalin (37%) | 2.0 ml | 3.0 ml |
| Polyoxyethylene p-monononylphenyl Ether (mean polymerization degree 10) | 0.3 | 0.45 |
| Disodium Ethylenediaminetetraacetate | 0.05 | 0.08 |
| Water to make | 1.0 liter | 1.0 liter |

-continued

| Component | Mother Liquid(g) | Replenisher(g) |
|---|---|---|
| pH | 5.0 to 8.0 | 5.8 to 8.0 |

TABLE 23

| Test No. | Hydrazine Compound or Comparative Compound Added | Relative Sensitivity SB | Relative Sensitivity SR | Increment of Fog | Remarks |
|---|---|---|---|---|---|
| 3-1 | — | 100 | 100 | — | Control |
| 3-2 | (a-1) | 105 | 110 | 0.30 | Comparison |
| 3-3 | (2-1) | 112 | 120 | 0.05 | Invention |

The results in Table 23 above show that Test No. 3-3 containing Compound (2-1) of the present invention was free from desensitization due to incorporation of sensitizing dyes thereinto and therefore had an elevated spectral sensitivity.

The results also show that the fog of Test No. 3-3 containing Compound (2-1) of the present invention was smaller than that of Test No. 3-2 containing Comparative Compound (a-1) in place of Compound (2-1).

EXAMPLE 4

Samples (1-1), (1-30), (1-31), (1-34) and (1-36) as prepared in Example 1 were stored under conditions of 50° C. and 70% RH for 3 days and then exposed and developed in the same manner as in Example 1. The sensitivity and fog of each sample were measured. The sensitivity was represented by a value relative to the sensitivity (100) of the corresponding fresh (not stored) sample. The results are shown in Table 24 below.

TABLE 24

| Test No. | Sample No. | Fresh Sample SB | Fresh Sample SR | Fresh Sample Fog | After storage at 70% RH and 50° C. for 3 days SB | After storage at 70% RH and 50° C. for 3 days SR | After storage at 70% RH and 50° C. for 3 days Fog | Remarks |
|---|---|---|---|---|---|---|---|---|
| 4-1 | (1-1) | 100 (control) | — | 0.03 | 95 | — | 0.04 | Control |
| 4-2 | (1-30) | 25 | 100 (control) | 0.06 | 24 | 93 | 0.08 | Control |
| 4-3 | (1-32) | 52 | 240 | 0.23 | 32 | 145 | 0.53 | Comparison |
| 4-4 | (1-34) | 79 | 417 | 0.08 | 71 | 372 | 0.12 | Invention |
| 4-5 | (1-36) | 85 | 447 | 0.10 | 81 | 427 | 0.13 | Invention |

The results in Table 24 above show that the samples of the present invention did not desensitize and were free from increase of fog, even after storage under conditions of 70% RH and 50° C. Thus, it is understood that the present invention provides an excellent photographic technology yielding a photographic material which is free from depression of the sensitivity and from increase of fog even after being exposed to a high-humidity condition of 70% RH.

EXAMPLE 5

Samples (2-1), (2--2), (2-3), (2-6), (2-35) and (2-52) as prepared in Example 2 were stored at room temperature for one year and then exposed and developed in the same manner as in Example 2. The sensitivity and fog of the thus processed samples were measured.

The sensitivity was represented as a value relative to the sensitivity (100) of the corresponding sample as sealed in argon gas and stored in a refrigerator at −30° C. for one year. The results are shown in Table 25 below.

TABLE 25

| Test No. | Sample No. | Relative Sensitivity, after storage in argon gas at −30° C. for 1 year | | | Relative Sensitivity, after storage at room temperature for 1 year | | | Remarks |
|---|---|---|---|---|---|---|---|---|
| | | SB | SR | Fog | SB | SR | Fog | |
| 5-1 | (2-1) | 100 (control) | — | 0.06 | 95 | — | 0.06 | Control |
| 5-2 | (2-2) | 23 | 100 (control) | 0.09 | 19 | 87 | 0.09 | Control |
| 5-3 | (2-3) | 47 | 251 | 0.34 | 35 | 178 | 0.58 | Comparison |
| 5-4 | (2-6) | 41 | 200 | 0.28 | 30 | 141 | 0.41 | Comparison |
| 5-5 | (2-35) | 65 | 355 | 0.10 | 60 | 331 | 0.12 | Invention |
| 5-6 | (2-52) | 91 | 562 | 0.10 | 89 | 550 | 0.13 | Invention |

The results in Table 25 above show that the samples of the present invention did not desensitize and were free from increase of fog even after storage at room temperature for one year. Thus, the advantages of the technology of the present invention are understood more clearly from the results.

From the results in Examples 1, 2, 3, 4 and 5, it is understood that the hydrazine compounds represented by formulae (I) to (IV) of the present invention are effective for elevating the sensitivity of silver halide photographic materials, especially color-sensitized ones, without increasing fog. In addition, it is also understood that photographic materials containing the hydrazine compounds of the present invention have good storage stability.

Thus, the hydrazine compounds represented by formulae (I) to (IV) of the present invention are useful for elevating the sensitivity of silver halide photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing at least one hydrazine compound represented by formula (II):

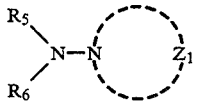

(II)

wherein $R_5$ and $R_6$ each represents an alkyl group, an aryl group or a heterocyclic group; or $R_5$ and $R_6$ may be bonded to each other to form a non-aromatic ring; and $Z_1$ represents an alkylene group having 4 or 6 carbon atoms;

provided that the carbon atoms of $R_5$, $R_6$, and $Z_1$ which are directly bonded to a nitrogen atom of the hydrazine core of the compound are not substituted by an oxo group.

2. The silver halide photographic material as in claim 1, wherein the photographic material contains at least one sensitizing dye which has an oxidation potential of 0.95 (V vsSCE) or less, which has a spectral sensitivity peak at 600 nm or more, and which is represented by formula (XIV):

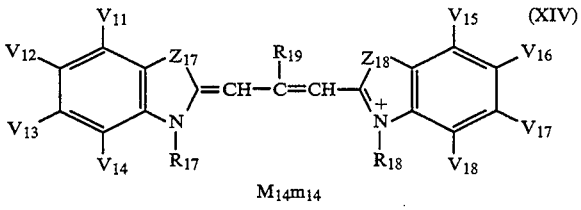

(XIV)

wherein $Z_{17}$ and $Z_{18}$ each represents a sulfur atom or a selenium atom;

$R_{17}$ and $R_{18}$ each represents an alkyl group;

$R_{19}$, $V_{11}$, $V_{12}$, $V_{13}$, $V_{14}$, $V_{15}$, $V_{16}$, $V_{17}$ and $V_{18}$ each represents a hydrogen atom or a monovalent substituent;

$M_{14}$ represents a charge-neutralizing pair ion; and $m_{14}$ represents a number of 0 or more necessary for neutralizing the molecular charge.

3. The silver halide photographic material containing the compound of formula (II) as in claim 1, wherein $Z_1$ represents an alkylene group having 4 carbon atoms.

4. The silver halide photographic material containing the compound of formula (II) as in claim 1, wherein $R_5$ and $R_6$ each represents an unsubstituted alkyl group or a substituted alkyl group; or $R_5$ and $R_6$ may be bonded to each other to form a ring of an alkylene group which may optionally be substituted.

5. The silver halide photographic material containing the compound of formula (II) as in claim 4, wherein the unsubstituted alkyl group is a methyl group, an ethyl group, a propyl group or a butyl group.

6. The silver halide photographic material containing the compound of formula (II) as in claim 4, wherein the substituted alkyl group is a sulfoalkyl group, a carboxyalkyl group, or a hydroxyalkyl group.

7. The silver halide photographic material containing the compound of formula (II) as in claim 4, wherein the ring of an alkylene group is a 5-membered or 7-membered ring.

8. The silver halide photographic material containing the compound of formula (II) as in claim 1, wherein $R_5$ and $R_6$ each represents a methyl group; or $R_5$ and $R_6$ are bonded to each other to form an unsubstituted tetramethylene group; and $Z_1$ represents an unsubstituted tetramethylene group.

9. A silver halide photographic material containing at least one hydrazine compound represented by formula (III):

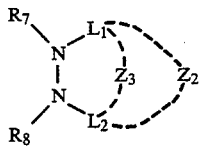

(III)

wherein $R_7$ and $R_8$ each represents an alkyl group, an aryl group or a heterocyclic group; or $R_7$ and $R_8$ may be bonded to each other to form a non-aromatic ring;

$Z_2$ represents an alkylene group having 2 carbon atoms;

$Z_3$ represents an alkylene group having 1 or 2 carbon atoms; and $L_1$ and $L_2$ each represents a methine group;

provided that the carbon atoms of $R_7$ and $R_8$ which are directly bonded to a nitrogen atom of the hydrazine core of the compound are not substituted by an oxo group.

10. The silver halide photographic material containing the compound of formula (III) as in claim 9, wherein $R_7$and $R_8$ each represents an unsubstituted alkyl group or a substituted alkyl group; or $R_7$ and $R_8$ may be bonded to each other to form a ring of an alkylene group which may optionally be substituted.

11. The silver halide photographic material containing the compound of formula (III) as in claim 10, wherein the unsubstituted alkyl group is a methyl group, an ethyl group, a propyl group or a butyl group.

12. The silver halide photographic material containing the compound of formula (III) as in claim 10, wherein the substituted alkyl group is a sulfoalkyl group, a carboxyalkyl group, or a hydroxyalkyl group.

13. The silver halide photographic material containing the compound of formula (III) as in claim 10, wherein the ring of an alkylene group is a 5-membered or 7-membered ring.

14. The silver halide photographic material containing the compound of formula (III) as in claim 9, wherein $R_7$ and $R_8$ each represents a methyl group, or $R_7$ and $R_8$ are bonded to each other to form a trimethylene group;

$Z_2$ represents an unsubstituted ethylene group;

$Z_3$ represents an unsubstituted methylene or ethylene group; and $L_1$ and $L_2$ each represents an unsubstituted methine group.

15. The silver halide photographic material as in claim 9, wherein the photographic material contains at least one sensitizing dye which has an oxidation potential of 0.95 (V vsSCE) or less, which has a spectral sensitivity peak at 600 nm or more, and which is represented by formula (XIV):

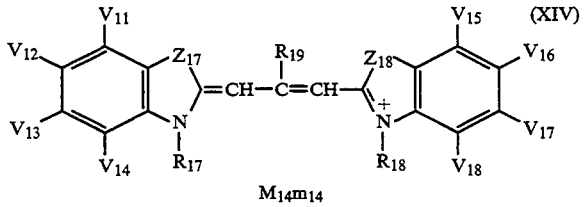

(XIV)

$M_{14}m_{14}$ wherein $Z_{17}$ and $Z_{18}$ each represents a sulfur atom or a selenium atom;

$R_{17}$ and $R_{18}$ each represents an alkyl group;

$R_{19}$, $V_{11}$, $V_{12}$, $V_{13}$, $V_{14}$, $V_{15}$, $V_{16}$, $V_{17}$ and $V_{18}$ each represents a hydrogen atom or a monovalent substituent;

$M_{14}$ represents a charge-neutralizing pair ion; and $m_{14}$ represents a number of 0 or more necessary for neutralizing the molecular charge.

16. A silver halide photographic material containing at least one hydrazine compound represented by formula (IV):

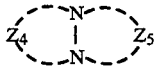

(IV)

wherein $Z_4$ and $Z_5$ each represents an alkylene group having 3 carbon atoms;

provided that the carbon atoms of $Z_4$ and $Z_5$ which are directly bonded to a nitrogen atom of the hydrazine core of the compound are not substituted by a oxo group.

17. The silver halide photographic material as in claim 16, wherein the photographic material contains at least one sensitizing dye which has an oxidation potential of 0.95 (V vsSCE) or less, and which has a spectral sensitivity peak at 600 nm or more, and which is represented by formula (XIV):

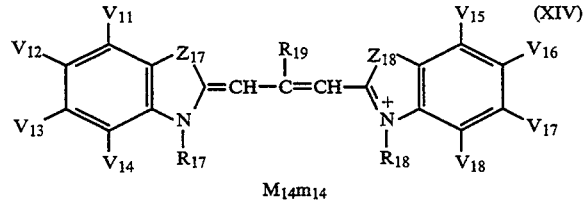

(XIV)

$M_{14}m_{14}$ wherein $Z_{17}$ and $Z_{18}$ each represents a sulfur atom or a selenium atom;

$R_{17}$ and $R_{18}$ each represents an alkyl group;

$R_{19}$, $V_{11}$, $V_{12}$, $V_{13}$, $V_{14}$, $V_{15}$, $V_{16}$, $V_{17}$ and $V_{18}$ each represents a hydrogen atom or a monovalent substituent;

$M_{14}$ represents a charge-neutralizing pair ion; and $m_{14}$ represents a number of 0 or more necessary for neutralizing the molecular charge.

18. The silver halide photographic material containing the compound of formula (IV) as in claim 16, wherein $Z_4$ and $Z_5$ each represents an unsubstituted trimethylene group or a trimethylene group substituted by one or more unsubstituted alkyl groups.

* * * * *